US011147426B2

(12) United States Patent
Nguyen et al.

(10) Patent No.: US 11,147,426 B2
(45) Date of Patent: Oct. 19, 2021

(54) SURFACE CLEANING APPARATUS AND TRAY

(71) Applicant: BISSELL Inc., Grand Rapids, MI (US)

(72) Inventors: Tom Minh Nguyen, Grand Rapids, MI (US); Jacob S. Boles, Grand Rapids, MI (US); Jacob Resch, Grand Rapids, MI (US); Ying Chun Wong, Hong Kong (CN); Jian Hua Tang, Hu Nan (CN); Yunfu Wang, Ganzhou (CN)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 17/122,690

(22) Filed: Dec. 15, 2020

(65) Prior Publication Data

US 2021/0100419 A1 Apr. 8, 2021

Related U.S. Application Data

(63) Continuation of application No. 17/119,300, filed on Dec. 11, 2020, which is a continuation of application No. PCT/US2019/038423, filed on Jun. 21, 2019.

(Continued)

(51) Int. Cl.

*A47L 11/34* (2006.01)
*A47L 11/40* (2006.01)

(Continued)

(52) U.S. Cl.

CPC ..... *A47L 11/4005* (2013.01); *A47L 5/30* (2013.01); *A47L 9/0477* (2013.01); *A47L 9/12* (2013.01); *A47L 9/2857* (2013.01); *A47L 9/2884* (2013.01); *A47L 11/302* (2013.01); *A47L 11/34* (2013.01); *A47L 11/4008* (2013.01);

(Continued)

(58) Field of Classification Search

CPC A47L 11/4005; A47L 11/302; A47L 11/4016; A47L 11/4082; A47L 11/4083; A47L 11/4088; A47L 2201/022

See application file for complete search history.

(56) References Cited

U.S. PATENT DOCUMENTS 8,671,510 B2 3/2014 Han et al.
10,092,155 B2 * 10/2018 Xia ..... A47L 11/4088

(Continued)

FOREIGN PATENT DOCUMENTS

CN 1951310 A 4/2007
CN 106725135 A 5/2017

(Continued)

OTHER PUBLICATIONS

International Search Report corresponding to PCT/US2019/038423 dated Oct. 7, 2019.

(Continued)

*Primary Examiner* — Dung Van Nguyen
(74) *Attorney, Agent, or Firm* — McGarry Bair PC

(57) ABSTRACT

A surface cleaning apparatus adapted for movement across a surface to be cleaned. The surface cleaning apparatus can dock within a storage tray and charge a power supply. Electrical contacts on the surface cleaning apparatus and the storage tray can be shielded when the surface cleaning apparatus is not docked within the storage tray. Furthermore, the storage tray can include a reservoir for a self-cleaning mode.

21 Claims, 46 Drawing Sheets

Related U.S. Application Data

(60) Provisional application No. 62/789,661, filed on Jan. 8, 2019, provisional application No. 62/688,439, filed on Jun. 22, 2018.

(51) Int. Cl.

| | |
|---|---|
| ***A47L 11/30*** | (2006.01) |
| ***A47L 5/30*** | (2006.01) |
| ***A47L 9/04*** | (2006.01) |
| ***A47L 9/12*** | (2006.01) |
| ***A47L 9/28*** | (2006.01) |

(52) U.S. Cl.

CPC ..... *A47L 11/4016* (2013.01); *A47L 11/4022* (2013.01); *A47L 11/4027* (2013.01); *A47L 11/4041* (2013.01); *A47L 11/4072* (2013.01); *A47L 11/4083* (2013.01); *A47L 11/4088* (2013.01); *A47L 11/305* (2013.01); *A47L 2201/022* (2013.01)

(56) References Cited

U.S. PATENT DOCUMENTS

| | | | | |
|---|---|---|---|---|
| 10,758,101 | B2 * | 9/2020 | Fogarty, Jr. ..... | A47L 9/0411 |
| 2002/0066153 | A1 | 6/2002 | Sclafani et al. | |
| 2006/0101604 | A1 | 5/2006 | Frederick et al. | |
| 2007/0226946 | A1 * | 10/2007 | Best ..... | A47L 5/28 15/329 |
| 2008/0040883 | A1 | 2/2008 | Beskow et al. | |
| 2008/0047093 | A1 | 2/2008 | Gordon | |
| 2008/0148512 | A1 | 6/2008 | Beskow et al. | |
| 2012/0137464 | A1 | 6/2012 | Thatcher et al. | |
| 2012/0242279 | A1 | 9/2012 | Tso et al. | |
| 2015/0032259 | A1 | 1/2015 | Kim et al. | |
| 2016/0051109 | A1 | 2/2016 | Hwang et al. | |
| 2017/0100006 | A1 | 4/2017 | Lenkiewicz et al. | |
| 2017/0119225 | A1 | 5/2017 | Xia et al. | |
| 2017/0319034 | A1 | 11/2017 | Kim et al. | |
| 2017/0324259 | A1 | 11/2017 | Jung et al. | |
| 2018/0110388 | A1 | 4/2018 | Xia et al. | |
| 2018/0333018 | A1 | 11/2018 | Deng et al. | |
| 2019/0254495 | A1 | 8/2019 | Zhang | |
| 2020/0214526 | A1 | 7/2020 | Huang et al. | |

FOREIGN PATENT DOCUMENTS

| | | | |
|---|---|---|---|
| CN | 107007213 | A | 8/2017 |
| CN | 108075509 | A | 5/2018 |
| JP | H07220800 | A | 8/1995 |
| JP | 2016137165 | A | 8/2016 |
| KR | 1020160023134 | A | 3/2016 |
| WO | 2017124625 | A1 | 7/2017 |

OTHER PUBLICATIONS

European Patent Office, Communication pursuant to Article 94(3) EPC re Corresponding Application No. 21159646.5-1016, dated Apr. 12, 2021, 5 pages, Munich. Germany.

European Patent Office, Communication pursuant to Article 94(3) EPC re Corresponding Application No. 21154555.3-1016, dated Apr. 1, 2021, Munich, Germany.

IP Australia, Examination report No. 1 for standard patent application re Application No. 2019288675, dated Apr. 1, 2021, 9 pages, Australia.

IP Australia, Examination report No. 1 for standard patent application re Application No. 2021201370, dated Apr. 1, 2021, 9 pages, Australia.

IP Australia, Examination report No. 1 for standard patent application re Application. 2021201371, dated Apr. 22, 2021, 9 pages, Australia.

Japanese Patent Office, Office Action re Corresponding Application No. 20020-571587, dated Jul. 29, 2021, 3 pages, Japan.

* cited by examiner

SURFACE CLEANING APPARATUS AND TRAY

CROSS-REFERENCE TO RELATED APPLICATIONS

This application is a continuation of U.S. patent application Ser. No. 17/119,300, filed Dec. 11, 2020, now allowed, which is a continuation of International Application No. PCT/US2019/038423 filed Jun. 21, 2019, which claims the benefit of U.S. Provisional Patent Application No. 62/688,439, filed Jun. 22, 2018, and the benefit of U.S. Provisional Patent Application No. 62/789,661, filed Jan. 8, 2019, all of which are incorporated herein by reference in their entirety.

BACKGROUND

Multi-surface vacuum cleaners are adapted for cleaning hard floor surfaces such as tile and hardwood and soft floor surfaces such as carpet and upholstery. Some multi-surface vacuum cleaners comprise a fluid delivery system that delivers cleaning fluid to a surface to be cleaned and a fluid recovery system that extracts spent cleaning fluid and debris (which may include dirt, dust, stains, soil, hair, and other debris) from the surface. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. An agitator can be provided for agitating the cleaning fluid on the surface. The fluid recovery system typically includes a recovery tank, a nozzle adjacent the surface to be cleaned and in fluid communication with the recovery tank through a working air conduit, and a source of suction in fluid communication with the working air conduit to draw the cleaning fluid from the surface to be cleaned and through the nozzle and the working air conduit to the recovery tank. Other multi-surface cleaning apparatuses include "dry" vacuum cleaners which can clean different surface types, but do not dispense or recover liquid.

BRIEF DESCRIPTION

An aspect of the disclosure relates to a surface cleaning apparatus, comprising an upright body comprising a handle and a frame, the frame comprising a main support section supporting a selectively removable supply tank and a selectively removable recovery tank, the handle defining an upper distal end, a base operably coupled with a lower end of the upright body, a suction nozzle provided with the base at a forward portion, a recovery system comprising the suction nozzle, a suction source in fluid communication with the suction nozzle for generating a working air stream, and the selectively removable recovery tank, a fluid delivery system comprising the supply tank and a fluid distributor provided on the base, an agitator selectively receivable within the base, and a rechargeable battery provided at a reward portion of the upright body, the rechargeable battery configured to selectively supply power to the suction source

DETAILED DESCRIPTION

Aspects of the disclosure generally relate to a cordless surface cleaning apparatus, which may be in the form of a multi-surface wet vacuum cleaner.

Figure 1:
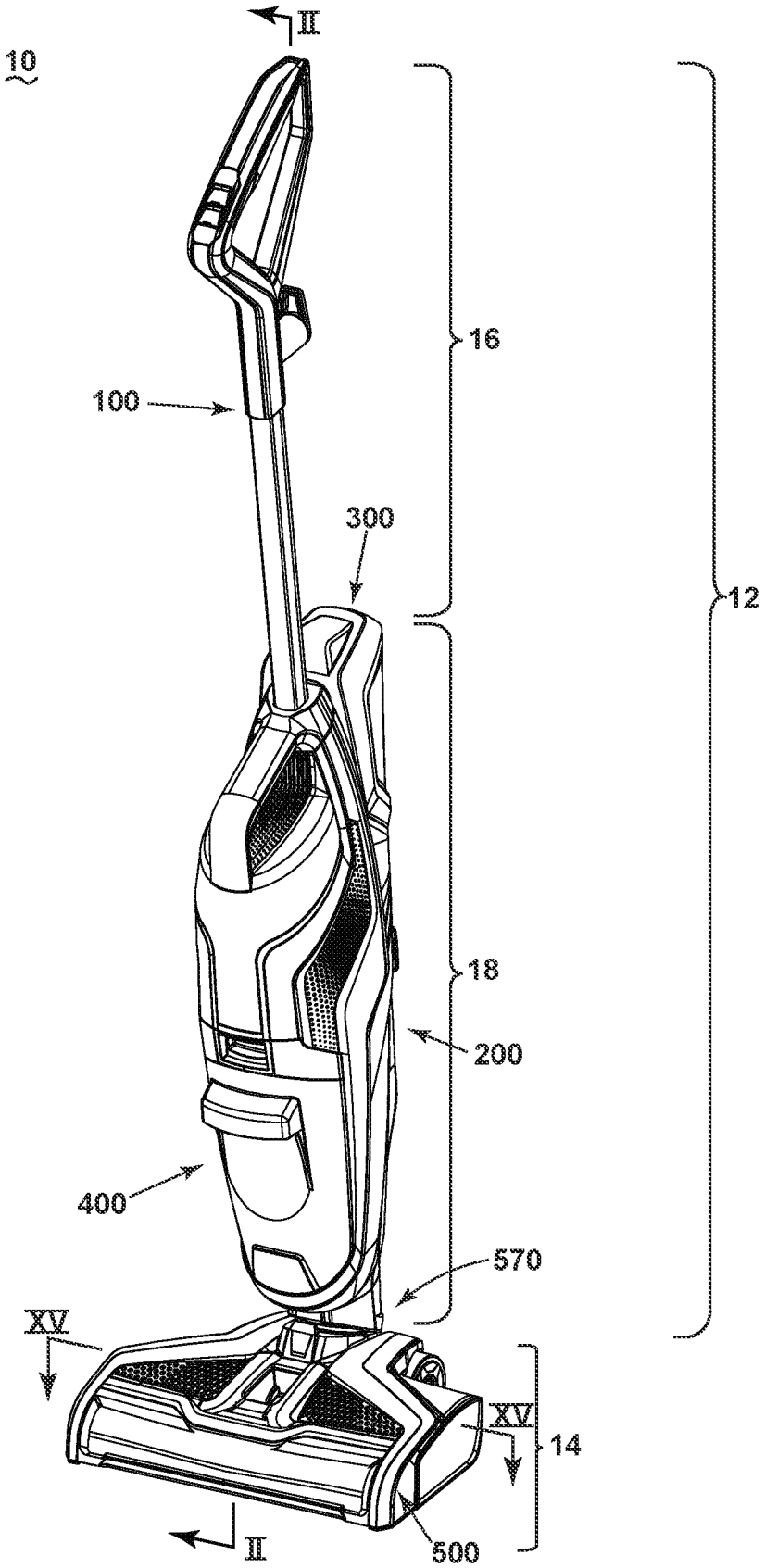
FIG. 1 is a perspective view of a surface cleaning apparatus according to an aspect of the disclosure.

FIG. 1 is a perspective view illustrating one non-limiting example of a surface cleaning apparatus in the form of multi-surface wet surface cleaning apparatus 10, according to one example of the invention. As illustrated herein, the multi-surface wet surface cleaning apparatus 10 is an upright multi-surface wet vacuum cleaner having a housing that includes an upright body or handle assembly 12 and a base 14 pivotally and/or swivel mounted to the upright handle assembly 12 and adapted for movement across a surface to be cleaned. For purposes of description related to the figures, the terms "upper," "lower," "right," "left," "rear," "front," "vertical," "horizontal," "inner," "outer," and derivatives thereof shall relate to the invention as oriented in FIG. 1 from the perspective of a user behind the multi-surface wet surface cleaning apparatus 10, which defines the rear of the multi-surface wet surface cleaning apparatus 10. However, it is to be understood that the invention may assume various alternative orientations, except where expressly specified to the contrary.

The upright handle assembly 12 includes an upper handle 16 and a frame 18. Upper handle 16 includes a handle assembly 100. Frame 18 includes a main support section or body assembly 200 supporting at least a clean tank assembly 300 and a dirty tank assembly 400, and may further support additional components of the handle assembly 12. The base 14 includes a foot assembly 500. The multi-surface wet surface cleaning apparatus 10 can include a fluid delivery or supply pathway, including and at least partially defined by the clean tank assembly 300, for storing cleaning fluid and delivering the cleaning fluid to the surface to be cleaned and a fluid recovery pathway, including and at least partially defined by the dirty tank assembly 400, for removing the spent cleaning fluid and debris from the surface to be cleaned and storing the spent cleaning fluid and debris until emptied by the user.

A pivotable swivel joint assembly 570 is formed at a lower end of the frame 18 and moveably mounts the base 14 to the upright assembly 12. In the example shown herein, the base 14 can pivot up and down about at least one axis relative to the upright assembly 12. The pivotable swivel joint assembly 570 can alternatively include a universal joint, such that the base 14 can pivot about at least two axes relative to the upright assembly 12. Wiring and/or conduits supplying air and/or liquid between the base 14 and the upright assembly 12, or vice versa, can extend though the pivotable swivel joint assembly 570. A swivel locking mechanism 586 (FIG. 2) can be provided to lock and/or release the swivel joint assembly 570 for movement.

Figure 2:
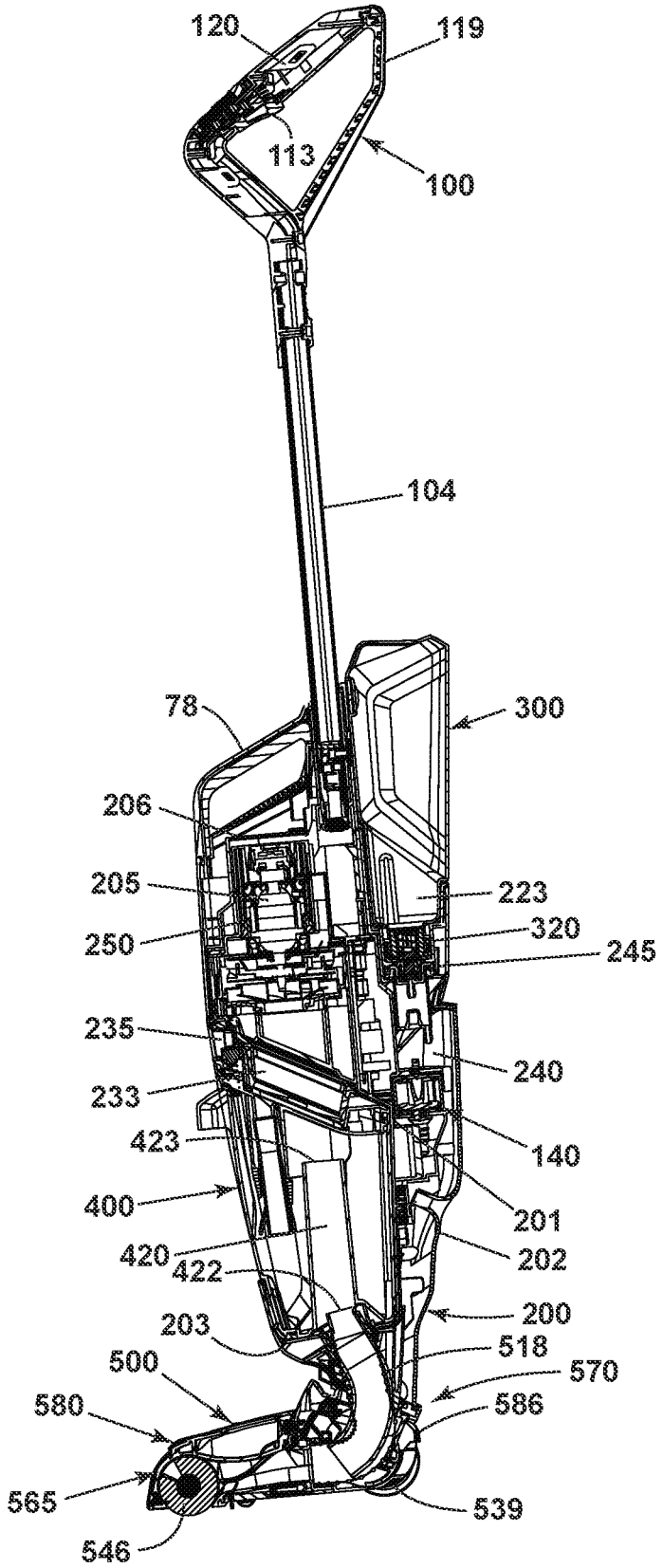
FIG. 2 is a cross-sectional view of the surface cleaning apparatus through line of FIG. 1.

FIG. 2 is a cross-sectional view of the surface cleaning apparatus 10 through line II-II FIG. 1 according to one aspect of the present disclosure. The handle assembly 100 generally includes a handgrip 119 and a user interface assembly 120. In other examples, the user interface assembly 120 can be provided elsewhere on the surface cleaning apparatus 10, such as on the body assembly 200. In the present example, handle assembly 100 further includes a hollow handle pipe 104 that extends vertically and connects the handle assembly 100 to the body assembly 200. The user interface assembly 120 can be any configuration of actuating controls such as but not limited to buttons, triggers, toggles, switches, or the like, operably connected to systems in the apparatus 10 to affect and control function. In the present example, a trigger 113 is mounted to the handgrip 119 and operably communicates with the fluid delivery system of the surface cleaning apparatus 10 to control fluid delivery from the surface cleaning apparatus 10. Other actuators, such as a thumb switch, can be provided instead of the trigger 113.

The lower end of handle pipe 104 terminates into the body assembly 200 in the upper portion of the frame 18. Body assembly 200 generally includes a support frame to support the components of the fluid delivery system and the recovery system described for FIG. 1. In the present example, body assembly 200 includes a central body 201, a front cover 203 and a rear cover 202. Additionally, a battery housing 24 (FIG. 20) can be coupled with the body assembly 200. Front cover 203 can be mounted to central body 201 to form a front cavity 235. Rear cover 202 can be mounted to central body 201 to form a rear cavity 240. A motor housing assembly 250 can be mounted to an upper portion of the front cover 203. A carry handle 78 can be disposed on the body assembly, forwardly of the handle assembly 100, at an angle relative to the hollow handle pipe 104 to facilitate manual lifting and carrying of the multi-surface wet surface cleaning apparatus 10. Motor housing assembly 250 further includes a cover 206 disposed beneath carry handle 78, a lower motor bracket 233, and a suction motor/fan assembly 205 positioned between the cover 206 and the motor bracket 233 in fluid communication with the dirty tank assembly 400.

Rear cavity 240 includes a receiving support 223 at the upper end of rear cavity 240 for receiving the clean tank assembly 300, and a pump assembly 140 beneath and in fluid communication with the clean tank assembly 300.

Clean tank assembly 300 can be mounted to the frame 18 in any configuration. In the present example, clean tank assembly 300 is removably mounted to the body assembly 200 such that it partially rests in the upper rear portion of the central body 201 of body assembly 200 and can be removed for filling and/or cleaning.

Dirty tank assembly 400 can be removably mounted to the front of the body assembly 200, below the motor housing assembly 250, and is in fluid communication with the suction motor/fan assembly 205 when mounted to the surface cleaning apparatus 10. A flexible conduit hose 518 couples the dirty tank assembly 400 to the foot assembly 500 and passes through the swivel joint assembly 570.

Optionally, a heater (not shown) can be provided for heating the cleaning fluid prior to delivering the cleaning fluid to the surface to be cleaned. In one example, an in-line heater can be located downstream of the clean tank assembly 300, and upstream or downstream of the pump assembly 140. Other types of heaters can also be used. In yet another example, the cleaning fluid can be heated using exhaust air from a motor-cooling pathway for the suction motor/fan assembly 205.

Foot assembly 500 includes a removable suction nozzle assembly 580 that can be adapted to be adjacent the surface to be cleaned as the base 14 moves across the surface and is in fluid communication with dirty tank assembly 400 through flexible conduit 518. An agitator 546 can be provided in suction nozzle assembly 580 for agitating the surface to be cleaned. Some examples of agitators include, but are not limited to, a horizontally-rotating brushroll, dual horizontally-rotating brushrolls, one or more vertically-rotating brushrolls, or a stationary brush. A pair of rear wheels 539 are positioned for rotational movement about a central axis on the rearward portion of the foot assembly 500 for maneuvering the multi-surface wet surface cleaning apparatus 10 over a surface to be cleaned.

In the present example, agitator 546 can be a hybrid brushroll positioned within a brushroll chamber 565 for rotational movement about a central rotational axis, which is discussed in more detail below. A single brushroll 546 is illustrated; however, it is within the scope of aspects described herein for dual rotating brushrolls to be used. Moreover, it is within the scope of aspects described herein for the brushroll 546 to be mounted within the brushroll chamber 565 in a fixed or floating vertical position relative to the chamber 565.

Figure 3:
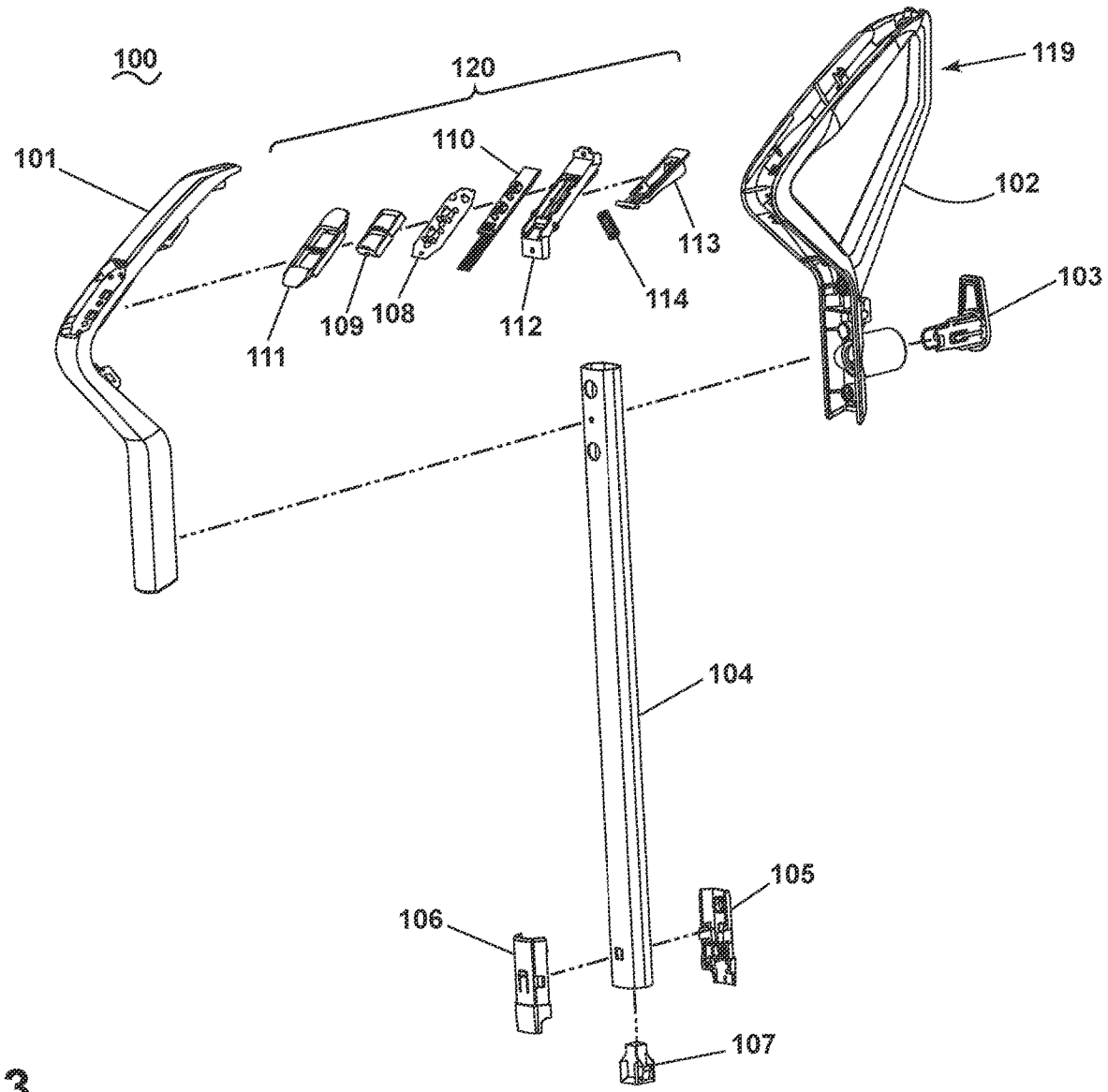
FIG. 3 is an exploded perspective view of a handle assembly of the surface cleaning apparatus of FIG. 1.

FIG. 3 is an exploded perspective view of the handle assembly 100. Handgrip 119 can include a front handle 101 and a back handle 102 mated fixedly to the handle pipe 104. The user interface assembly 120 can be provided on the front handle 101. The user interface assembly 120 of the illustrated example includes a control panel 111 connected to a floating key 109 and mounted with a water proof seal 108 through the front portion of front handle 101 to engage a printed circuit board assembly (PCBA) 110 and a bracket 112 provided on the back side of front handle 101. Bracket 112 engages a spring 114 that biases the trigger 113 mounted to the back handle 102, with a portion of the trigger 113 projecting inward in the recess formed by the mating of front handle 101 to back handle 102. The trigger 113 can electronically communicate with the fluid delivery system. The trigger 113 alternatively can mechanically communicate with the fluid delivery system, such as via a push rod (not shown) that runs through the handle pipe 104. Hollow handle pipe 104 terminates in the frame 18 (FIG. 1) by a bracket connection formed by a right bracket 106, a left bracket 105, and a female connector 107 joined together at the terminal end of handle pipe 104.

Figure 4:
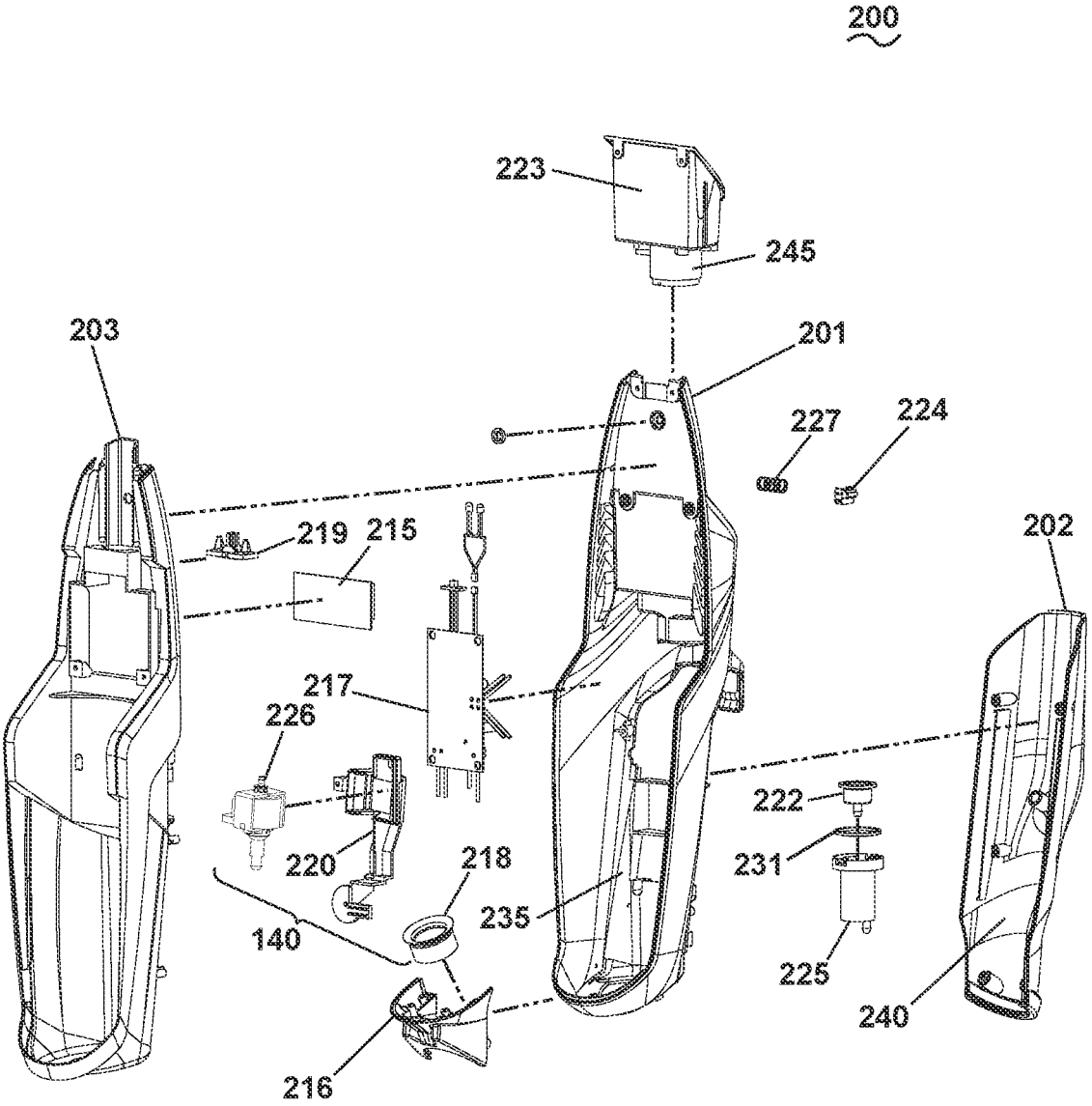
FIG. 4 is an exploded perspective view of a body assembly of the surface cleaning apparatus of FIG. 1.

FIG. 4 is an exploded perspective view of the body assembly 200. Body assembly 200 includes front cover 203, central body 201, and rear cover 202, and terminates with a bottom cover 216. Front cover 203 and rear cover 202 can mount to central body 201 forming at least partially enclosed cavities 235 and 240. In the present example, front cavity 235 generally contains electrical components such as a printed circuit board 217 (PCB) and other required circuitry 215 electrically connected to various component parts of the fluid delivery and recovery systems. Pump assembly 140 can include a connector 219, a pump 226, a clamp 220 and a gasket 218 and can be mounted in front cavity 235. Alternatively, pump assembly 140 can be mounted in rear cavity 240, or partially mounted in both front and rear cavities 235 and 240 respectively. The pump 226 can be a solenoid pump having a single, dual, or variable speed.

In the present example, rear cavity 240 generally contains a receiving assembly 245 for the clean tank assembly 300 (FIG. 2). Receiving assembly 245 can include the receiving support 223, a spring insert 227, a clamp 224, a receiving body 222, a receiving gasket 231 and a clamp cover 225 at the upper portion of rear cavity 240 for receiving the clean tank assembly 300. The pump assembly 140 can be mounted beneath and in fluid communication with the receiving assembly 245.

Figure 5:
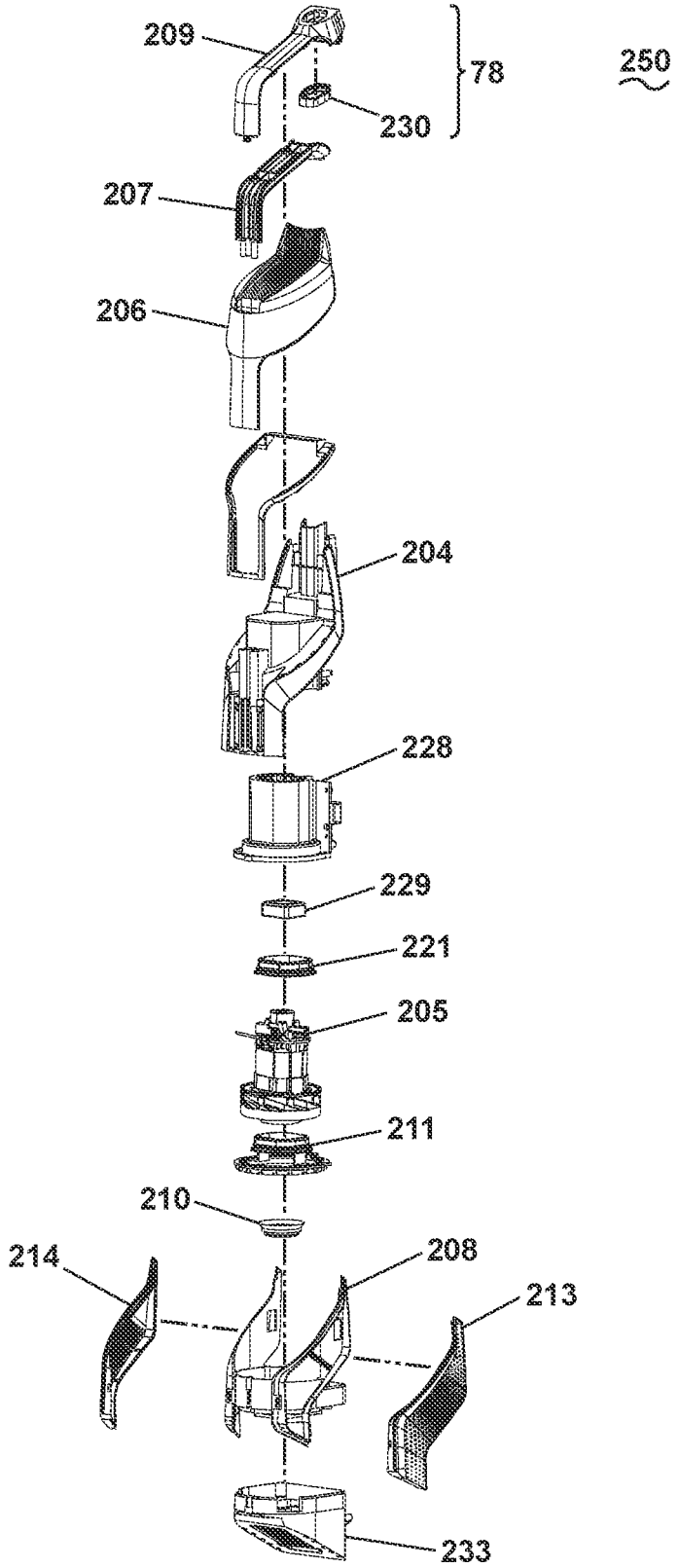
FIG. 5 is an exploded perspective view of a motor assembly of the surface cleaning apparatus of FIG. 1.

FIG. 5 is an exploded perspective view of the motor housing assembly 250. Carry handle 78 includes a handle top 209 mounted to a handle bottom 207 with a gasket 230 mounted therebetween, and is secured to the cover 206. Motor housing assembly 250 can further include an upper motor housing body 204 and a lower motor housing body 208, and a vacuum motor cover 228 provided therebetween to partially enclose the suction motor/fan assembly 205. A top motor gasket 229 and a rubber gasket 221 are provided on the upper portion of the suction motor/fan assembly 205, and lower vacuum motor gaskets 210 and 211 are provided on the lower portion of the suction motor/fan assembly 205. A clean air outlet of the working air path through the vacuum cleaner can be defined by a left vent 213 and a right vent 214 in the lower motor housing body.

Figure 6:
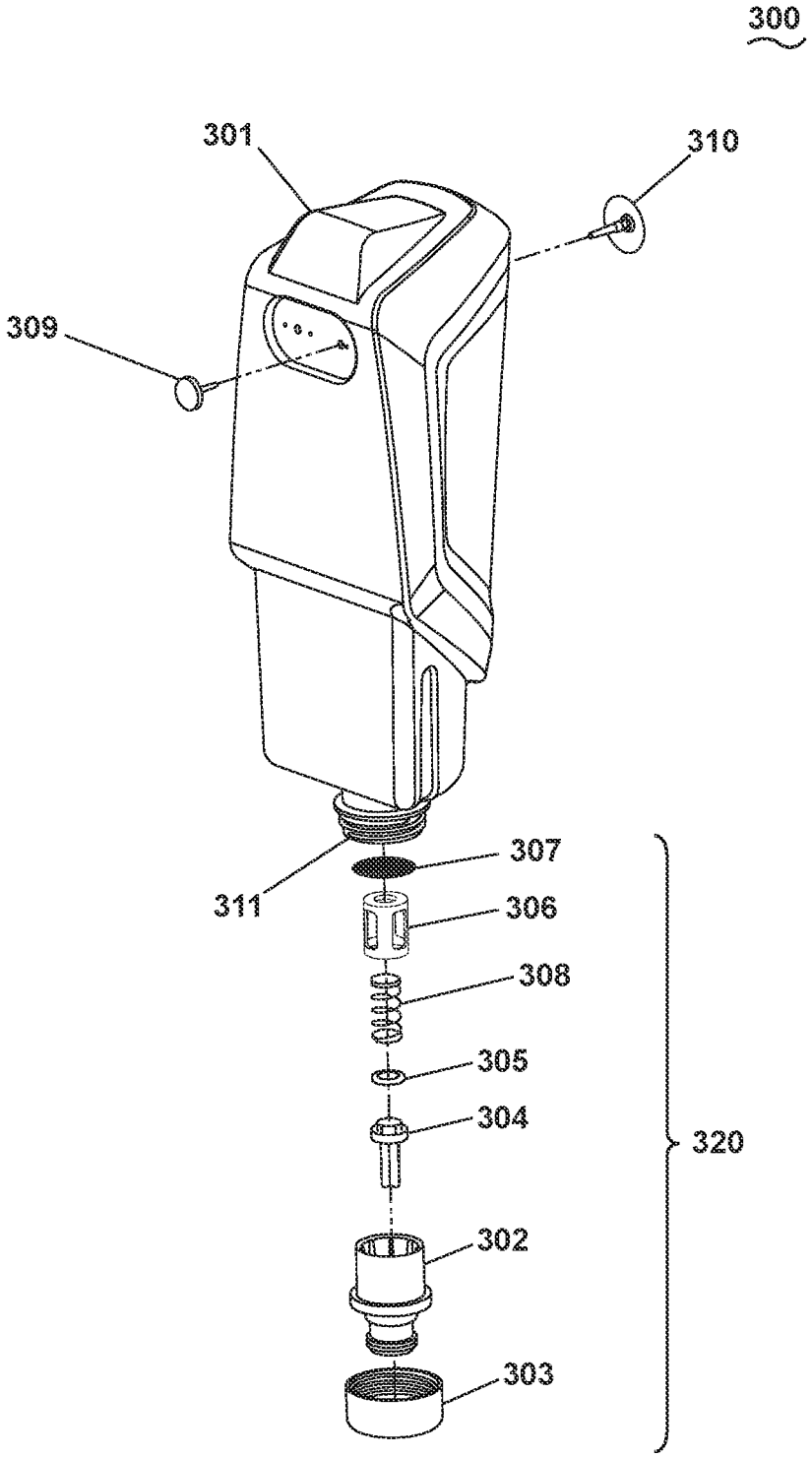
FIG. 6 is an exploded perspective view of a clean tank assembly of the surface cleaning apparatus of FIG. 1.

FIG. 6 is an exploded perspective view of the clean tank assembly 300. Clean tank assembly 300 generally includes at least one supply tank 301 and a supply valve assembly 320 controlling fluid flow through an outlet 311 of the supply tank 301. Alternatively, clean tank assembly 300 can include multiple supply chambers, such as one chamber containing water and another chamber containing a cleaning agent. A check valve 310 and a check valve umbrella 309 can be provided on supply tank 301. Supply valve assembly 320 mates with the receiving assembly 245 and can be configured to automatically open when seated. The supply valve assembly 320 includes an assembly outlet 302 that is mounted to the outlet of the fluid supply tank 301 by a threadable cap 303, a rod release insert 304 held in place with the assembly outlet 302 by an O-ring 305, and an insert spring 308 inside a spring housing 306 biasing the valve assembly 320 to a closed position. When the valve assembly 320 is coupled with the receiving assembly 245, the valve assembly 320 opens to release fluid to the fluid delivery pathway. A screen mesh insert 307 can be provided between the tank outlet and the valve outlet to prevent particulates of a certain size from entering the pump assembly 140.

Figure 7:
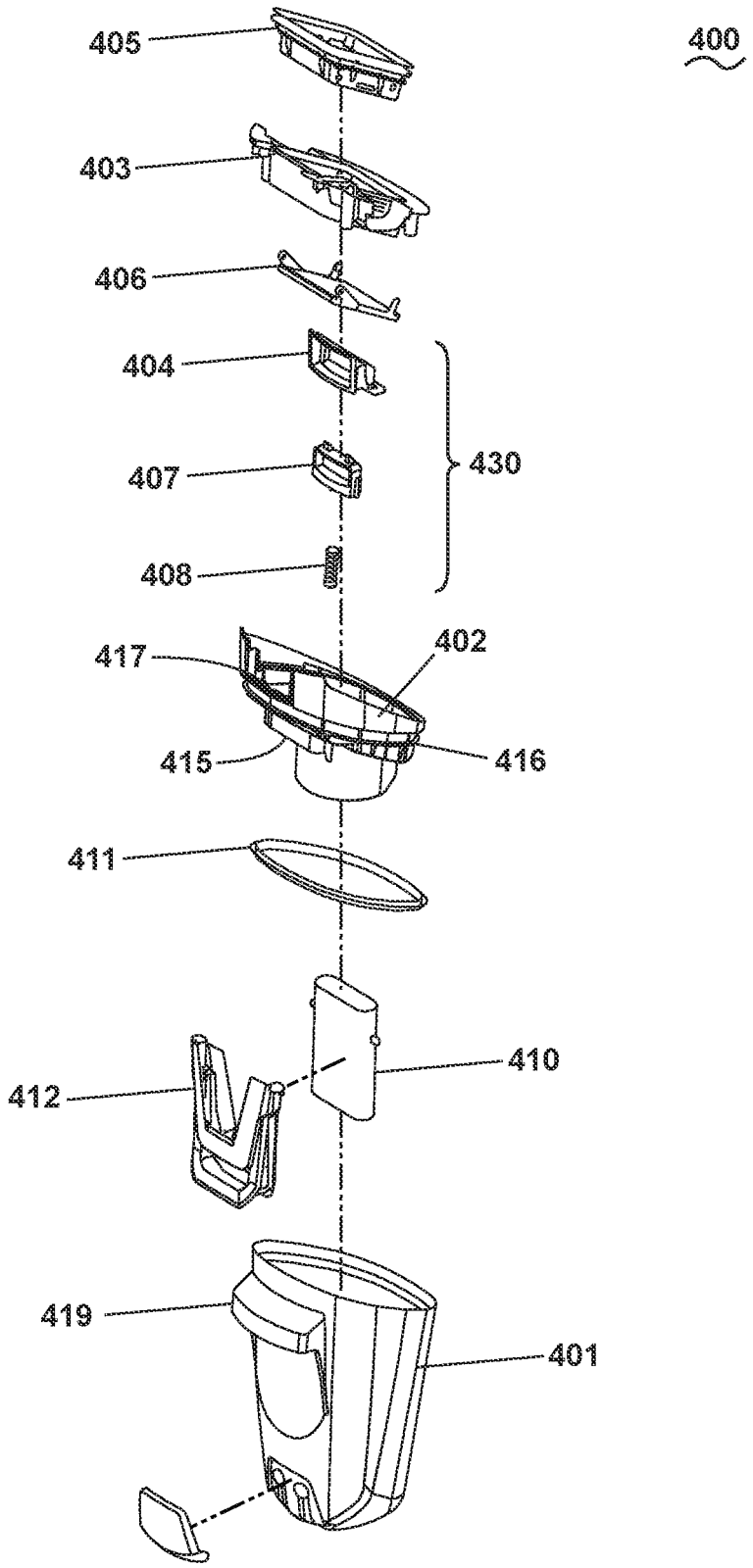
FIG. 7 is an exploded perspective view of a dirty tank assembly of the surface cleaning apparatus of FIG. 1.

FIG. 7 is an exploded perspective view of the dirty tank assembly 400. The dirty tank assembly 400 generally includes the collection container for the fluid recovery system. In the present example, dirty tank assembly 400 includes a recovery tank 401 with an integral hollow standpipe 420 (FIG. 2) formed therein. The standpipe 420 is oriented such that it is generally coincident with a longitudinal axis of the recovery tank 401. The standpipe 420 forms a flow path between an inlet 422 (FIG. 2) formed at a lower end of the recovery tank 401 and an outlet 423 (FIG. 2) on the interior of the recovery tank 401. When the recovery tank 401 is mounted to the body assembly 200 (FIG. 2), the inlet 422 is aligned with the flexible conduit hose 518 to establish fluid communication between the foot assembly 500 and the recovery tank 401. A lid 402 sized for receipt on the recovery tank 401 supports a pleated filter 405 in a filter cover plate 403 mounted to the lid 402 with a mesh screen 406 therebetween. Preferably, the pleated filter 405 is made of a material that remains porous when wet. The surface cleaning apparatus 10 can also be provided with one or more additional filters upstream or downstream. A gasket 411 positioned between mating surfaces of the lid 402 and the recovery tank 401 creates a seal therebetween for prevention of leaks.

A shut-off valve can be provided for interrupting suction when fluid in the recovery tank 401 reaches a predetermined level. The shut-off valve includes a float bracket 412 fixedly attached to a bottom wall 416 of the lid 402 in a position offset from the standpipe 420 and a moveable float 410 carried by the float bracket 412. The float 410 is buoyant and oriented so that the top of the float 410 can selectively seal an air outlet 415 of the recovery tank 401 leading to the downstream suction source when the fluid in the recovery tank 401 reaches a predetermined level.

A releasable latch 430 is provided to facilitate removal of the dirty tank assembly 400 for emptying and/or cleaning, and can be positioned in an aperture 417 on a front side of the lid 402. The releasable latch 430 can include a latch button 407 held within a latch bracket 404 and biased with latch spring 408 toward an engaged or latched position. The latch button 407 releasably engages with the front cover 203 to removably secure the dirty tank assembly 400 to the body assembly 200 (FIG. 2). A hand grip 419 can be provided on the recovery tank 401 and located below the latch 407 to facilitate handling of the dirty tank assembly 400*g*.

Figure 8:
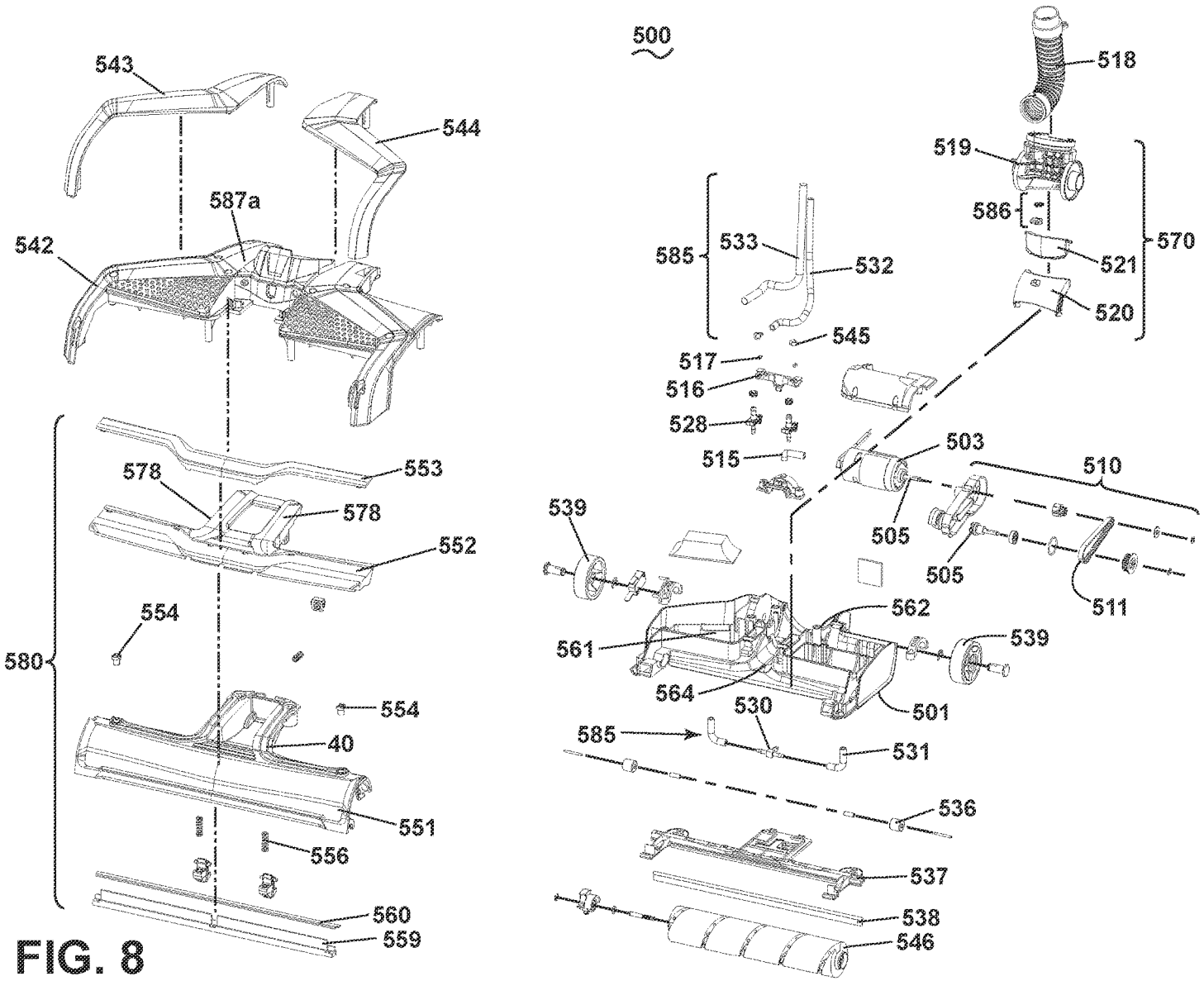
FIG. 8 is an exploded perspective view of a foot assembly of the surface cleaning apparatus of FIG. 1.
Figure 10:
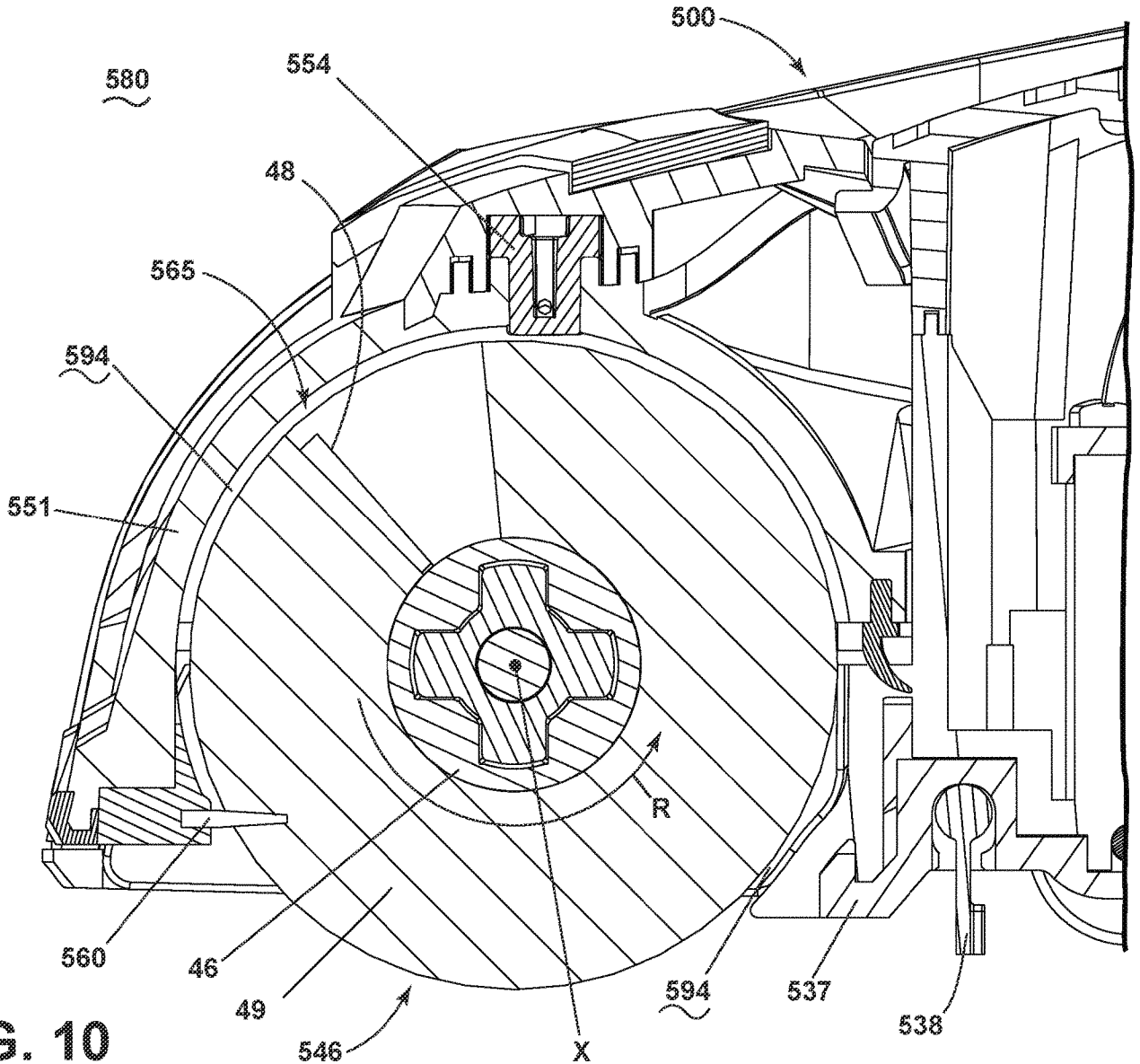
FIG. 10 is a close-up sectional view through a forward section of a suction nozzle assembly of the surface cleaning apparatus of FIG. 1.

FIG. 8 is an exploded perspective view of the foot assembly 500. Foot assembly 500 generally includes a housing supporting at least some of the components of the fluid delivery system and fluid recovery system. In the present example, the housing includes an upper cover 542 and a lower cover 501 coupled with the upper cover 542 and defining a partially enclosed cavity 561 therebetween for receiving at least some components of the fluid delivery and recovery pathways. The housing can further include a cover base 537 coupled with a lower forward portion of the lower cover to defined a portion of the brushroll chamber 565 (FIG. 10). The upper cover 542 extends from approximately the middle to rear of foot assembly 500 and can have decorative panels 543 and 544 mounted to an upper surface. Upper cover 542 can be configured to releasably receive the suction nozzle assembly 580.

Suction nozzle assembly 580 can be configured to include at least one inlet nozzle for recovering fluid and debris from the surface to be cleaned and at least one outlet for delivering fluid to the surface to be cleaned. In one example, suction nozzle assembly 580 can include a nozzle housing 551 and a nozzle cover 552, which mate to form a pair of fluid delivery channels 40 therebetween that are each fluidly connected to a spray connector 528 at one terminal end. At the opposite, or second terminal, end of each fluid delivery channel 40, a fluid dispenser 554 is configured with at least one outlet to deliver fluid to the surface to be cleaned. Fluid dispenser 554 may be include of one or more spray tips configured to deliver cleaning fluid from the fluid delivery channel 40 to the brush chamber 565. In the present example, fluid dispenser 554 is a pair of spray tips fluidly connected to the fluid delivery channel 40. Spray tip 554 is mounted in the nozzle housing 551 and has an outlet in fluid communication with the brush chamber 565. Nozzle cover 552 can have a decorative cover 553, and one or both can be composed of a translucent or transparent material. Nozzle housing 551 can further include a front interference wiper 560 mounted at a forward position relative to the brushroll chamber 565 and disposed horizontally.

The lower cover 501 further includes a plurality of upstanding bosses 562 that project into cavity 561 for mounting interior components thereto. A rear portion of the lower cover 501 pivotally mounts to swivel joint assembly 570 for maneuvering the multi-surface wet surface cleaning apparatus 10 over a surface to be cleaned. The rear wheels 539 are positioned for rotational movement about a central axis on opposite sides of the lower cover 501 for maneuvering the multi-surface wet surface cleaning apparatus 10 over a surface to be cleaned. Swivel joint assembly 570 can include swivel joint 519, covers 520 and 521, and a swivel locking mechanism 586 for releasing the swivel joint assembly 570 for pivoting and swivel movements.

A conduit assembly 585 is partially disposed in cavity 561 and extends through the swivel joint 519, along with the flexible conduit hose, to couple with components in the upper body assembly 200 (FIG. 2). Conduit assembly 585 includes a fluid supply conduit 532 and a wiring conduit 533. Fluid supply conduit 532 passes interiorly to swivel joint assembly 570 and fluidly connects the clean tank assembly 300 to the spray connectors 528 through a T-connector 530 having a pair spray tube connectors 531. Wiring conduit 533 provides a passthrough for electrical wiring from the upright assembly 12 to the base 14 through swivel joint assembly 570. For example, the wiring can be used to supply electrical power to at least one electrical component in the foot assembly 500. One example of an electrical component is a brush motor 503. Another example is an indicator light assembly. In the present example, the indicator light assembly includes an LED base 516 configured to mount a pair of indicator lights 517 and a pair of lenses 545 over the lights 517. The lights 517 may include light emitting diodes (LED) or other illumination sources.

A central lower portion of the partially enclosed cavity 561 and a rearward lower portion of suction nozzle assembly 580 can be molded to form a foot conduit 564 of the fluid recovery pathway that is fluidly connected to the flexible conduit 518. Flexible conduit 518 fluidly connects dirty tank assembly 400 (FIG. 2) to suction nozzle assembly 580.

The brushroll 546 can be provided at a forward portion of the lower cover 501 and received in brushroll chamber 565. In the present example, the cover base 537 rotatably receives the brushroll 546, and also mountably receives a wiper 538 positioned rearwardly of the brushroll 546. Optionally, brushroll 546 can be configured to be removed by the user from the foot assembly 500 for cleaning and/or drying. A pair of forward wheels 536 are positioned for rotational movement about a central axis on the terminal surface of the cover base 537 for maneuvering the multi-surface wet surface cleaning apparatus 10 over a surface to be cleaned.

In the example, the brushroll 546 can be operably coupled to and driven by a drive assembly including a dedicated brush motor 503 disposed in the cavity 561 of the lower cover 501 and one or more belts, gears, shafts, pulleys or combinations thereof to provide the coupling. Here, a transmission 510 operably connects the motor 503 to the brushroll 546 for transmitting rotational motion of a motor shaft 505 to the brushroll 546. In the present example, transmission 510 can include a drive belt 511 and one or more gears, shafts, pulleys, or combinations thereof. Alternatively, a single motor/fan assembly (not shown) can provide both vacuum suction and brushroll rotation in the multi-surface wet surface cleaning apparatus 10. A brush motor exhaust tube 515 can be provided to the brush motor 503 and configured to exhaust air to the outside of the multi-surface wet surface cleaning apparatus 10.

Figure 9:
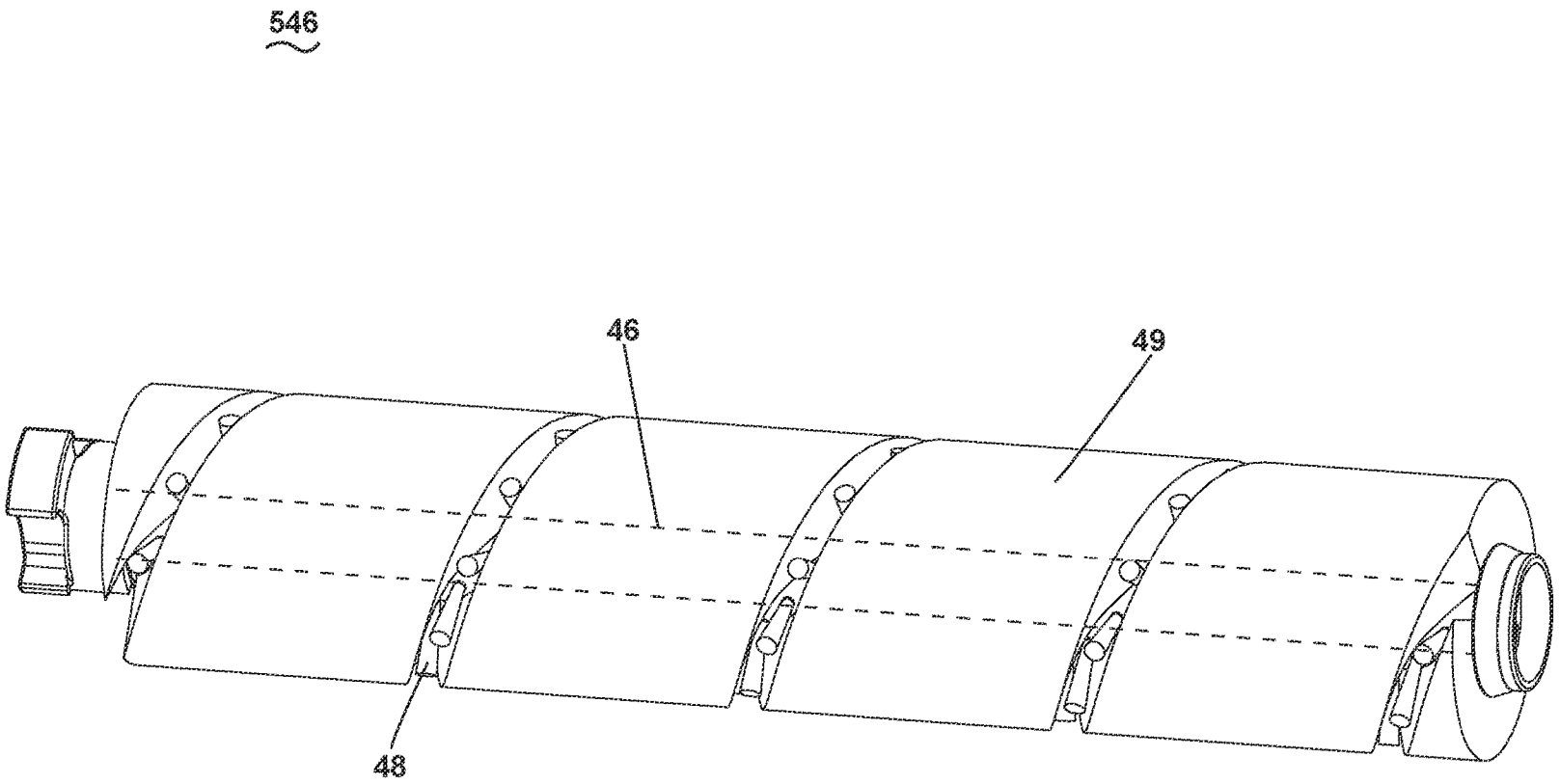
FIG. 9 is a perspective view of a brushroll of the surface cleaning apparatus of FIG. 1.

FIG. 9 is a perspective view of the hybrid brushroll 546. Hybrid brushroll 546 is suitable for use on both hard and soft surfaces, and for wet or dry vacuum cleaning. In this exemplary aspect, brushroll 546 includes a dowel 46, a plurality of tufted bristles 48 or unitary bristle strips extending from the dowel 46, and microfiber material 49 provided on the dowel 46, arranged between the bristles 48. Dowel 46 can be constructed of a polymeric material such as acrylonitrile butatdiene styrene (ABS), polypropylene or styrene, or any other suitable material such as plastic, wood, or metal. Bristles 48 can be tufted or unitary bristle strips and constructed of nylon, or any other suitable synthetic or natural fiber. The microfiber material 49 can be constructed of polyester, polyamides, or a conjugation of materials including polypropylene or any other suitable material known in the art from which to construct microfiber.

In one non-limiting example, dowel 46 is constructed of ABS and formed by injection molding in one or more parts. Bristle holes (not shown) can be formed in the dowel 46 by drilling into the dowel 46 after molding, or can be integrally molded with the dowel 46. The bristles 48 are tufted and constructed of nylon with a 0.15 mm diameter. The bristles 48 can be assembled to the dowel 46 in a helical pattern by pressing bristles 48 into the bristle holes and securing the bristles 48 using a fastener (not shown), such as, but not limited to, a staple, wedge, or anchor. The microfiber material 49 is constructed of multiple strips of polyester treated with Microban© and glued onto the dowel 46 between bristles 48. Alternatively, one continuous microfiber strip 49 can be used and sealed by hot wire to prevent the single strip from detaching from the dowel 46. The polyester material can be 7-14 mm thick with weight of 912 g/m$^2$. The polyester material can be an incipient absorption of 269 wt % and a total absorption of 1047 wt %.

FIG. 10 is a close-up sectional view through a forward section of the suction nozzle assembly 580. The brushroll 546 is positioned for rotational movement in a direction R about a central rotational axis X. The suction nozzle assembly 580 includes a suction nozzle 594 defined within the brush chamber 565 that is in fluid communication with the foot conduit 564 and configured to extract liquid and debris from the brushroll 546 and the surface to be cleaned. The suction nozzle 594 defines a dirty air inlet of the working air path or recovery pathway through the vacuum cleaner. Suction nozzle 594 is further fluidly connected through the foot conduit 564 and the flexible hose conduit 518, to dirty tank assembly 400 (see FIG. 16B). Front interference wiper 560, mounted at a forward position of the nozzle housing 551, is provided in the brush chamber 565, and is configured to interface with a leading portion of the brushroll 546, as defined by the direction of rotation R of the brushroll 546. Spray tips 554 are mounted to the nozzle housing 551 with an outlet in the brushroll chamber 565 and oriented to spray fluid inwardly onto the brushroll 546. The wetted portion brushroll 546 then rotates past the interference wiper 560, which scrapes excess fluid off the brushroll 546, before reaching the surface to be cleaned. Rear wiper squeegee 538 is mounted to the cover base 537 behind the brushroll 546 and is configured to contact the surface as the base 14 moves across the surface to be cleaned. The rear wiper squeegee 538 wipes residual liquid from the surface to be cleaned so that it can be drawn into the fluid recovery pathway via the suction nozzle 594, thereby leaving a moisture and streak-free finish on the surface to be cleaned.

Front interference wiper 560 and rear wiper 538 can be squeegees constructed of a polymeric material such as polyvinyl chloride, a rubber copolymer such as nitrile butadiene rubber, or any material known in the art of sufficient rigidity to remain substantially undeformed during normal use of the surface cleaning apparatus 10, and can be smooth or optionally include nubs on the ends thereof. Wiper 560 and wiper 538 can be constructed of the same material in the same manner or alternatively constructed of different materials providing different structure characteristics suitable for function.

Figure 11:
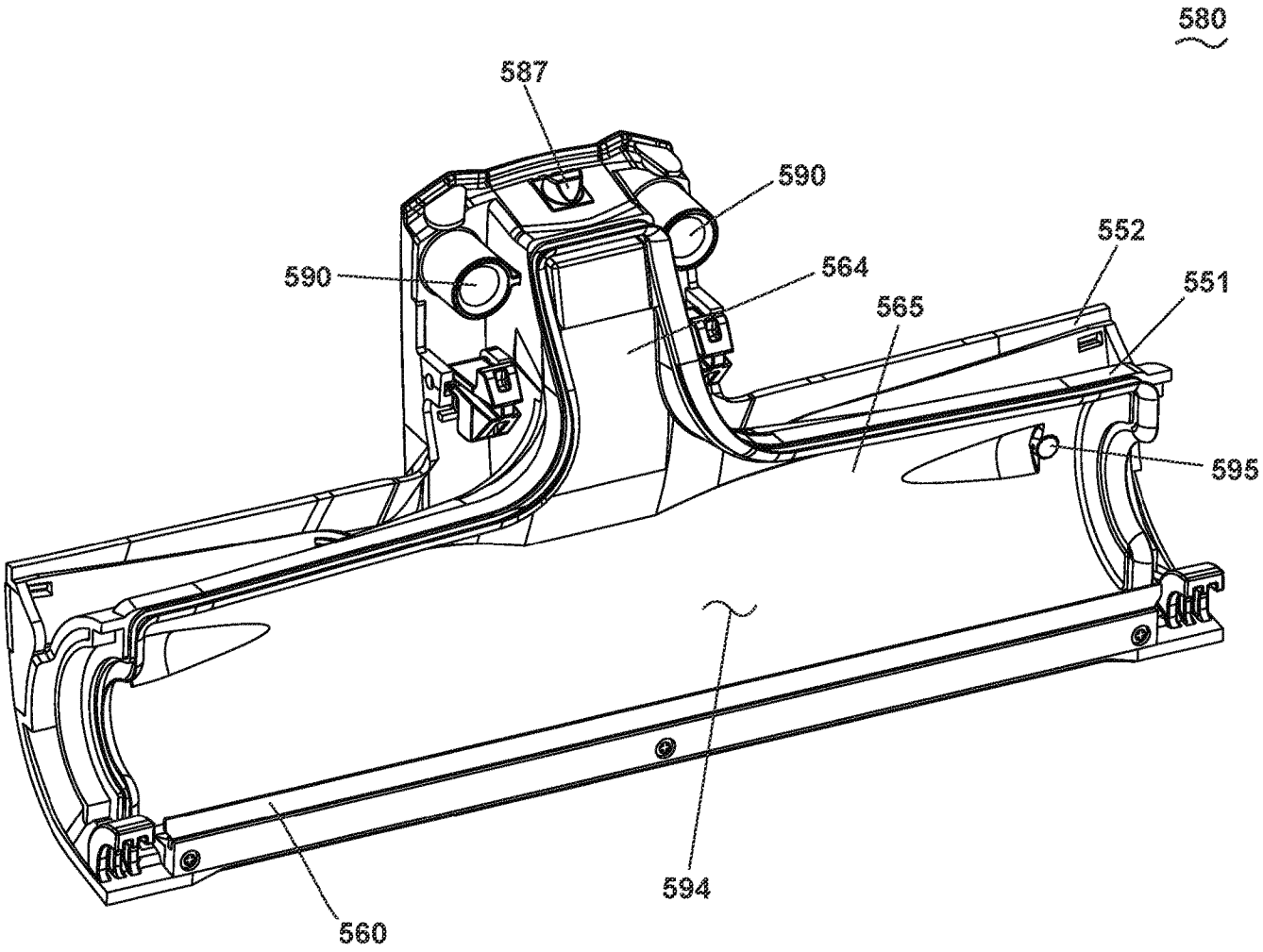
FIG. 11 is a perspective view of the underside of the suction nozzle assembly, with portions cut away to show internal features of the suction nozzle assembly.

FIG. 11 is a perspective view of the underside of the suction nozzle assembly 580, with some portions cut away to show some internal features of the suction nozzle assembly 580. Brushroll chamber 565 is defined on the underside of suction nozzle assembly 580 forward of the foot conduit 564. A pair of spray tip outlets 595 can be provided in the brush chamber 565. A latch mechanism 587 is provided at the rearward portion of suction nozzle assembly 580 and is configured to be received in the upper cover 542 (FIG. 8). Latch mechanism 587 can be received in a latch receiving depression 587*a* (FIG. 8) provided on the upper cover 542 base 14 and is configured for a user to remove and/or lock the suction nozzle assembly 580 onto the base 14. The suction nozzle assembly 580 can be biased by springs 556 to release suction nozzle assembly 580 away from foot assembly 500 when the latch mechanism 587 is actuated. A pair of spray connector inlets 590 are provided on the underside of nozzle housing 551 and are fluidly connected to the first terminal end of fluid delivery channels 40 on the upper side of the nozzle housing 551 (FIG. 8). Front interference wiper 560 is provided in the forward most portion of brushroll chamber 565.

Figure 12:
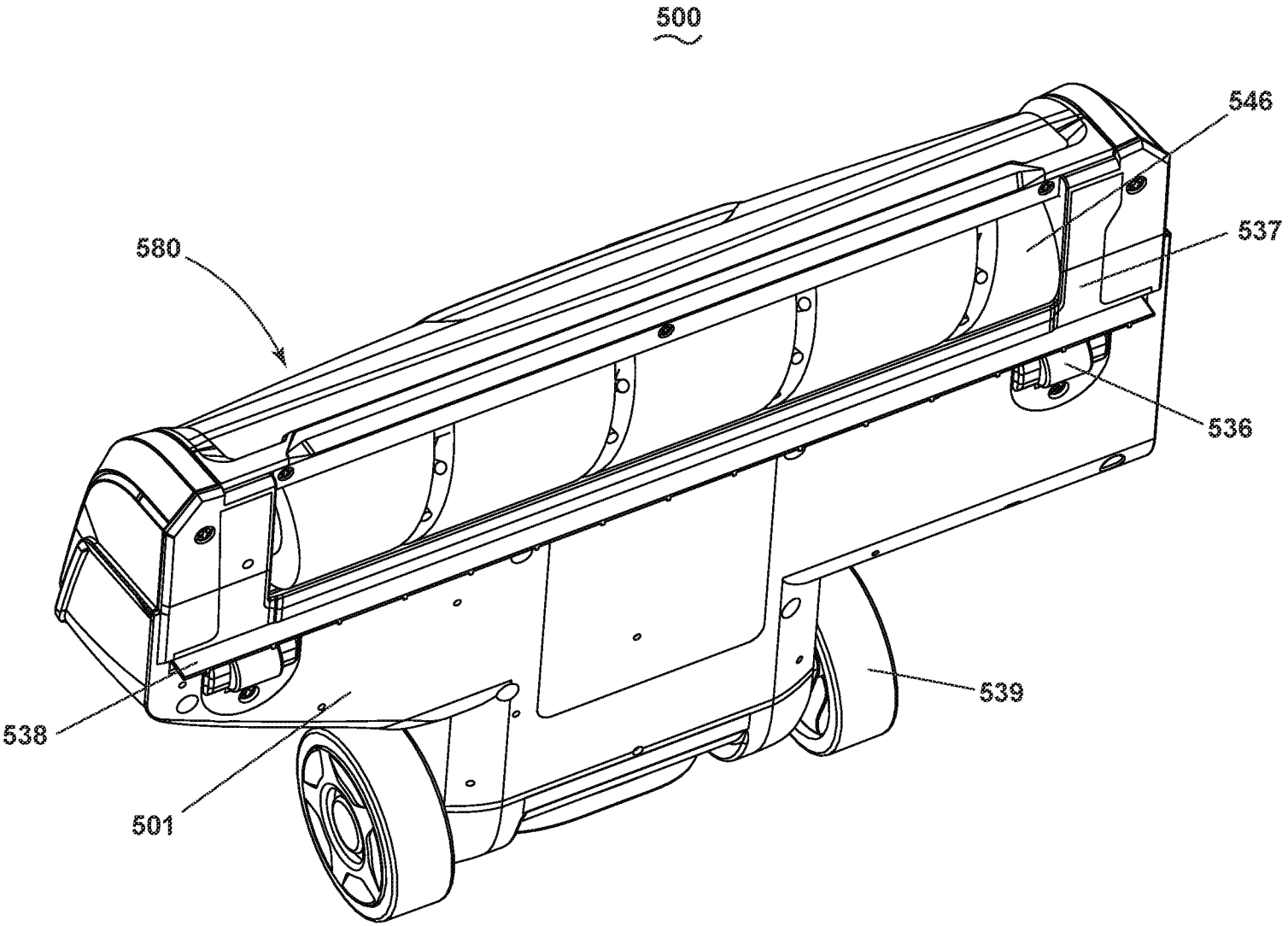
FIG. 12 is a bottom perspective view of the foot assembly of suction nozzle assembly FIG. 1.

FIG. 12 is a bottom perspective view of the foot assembly 500. Rear wiper 538 is provided on the cover base 537, rearward of brushroll 546, and configured to contact the surface to be cleaned.

Figure 13A:
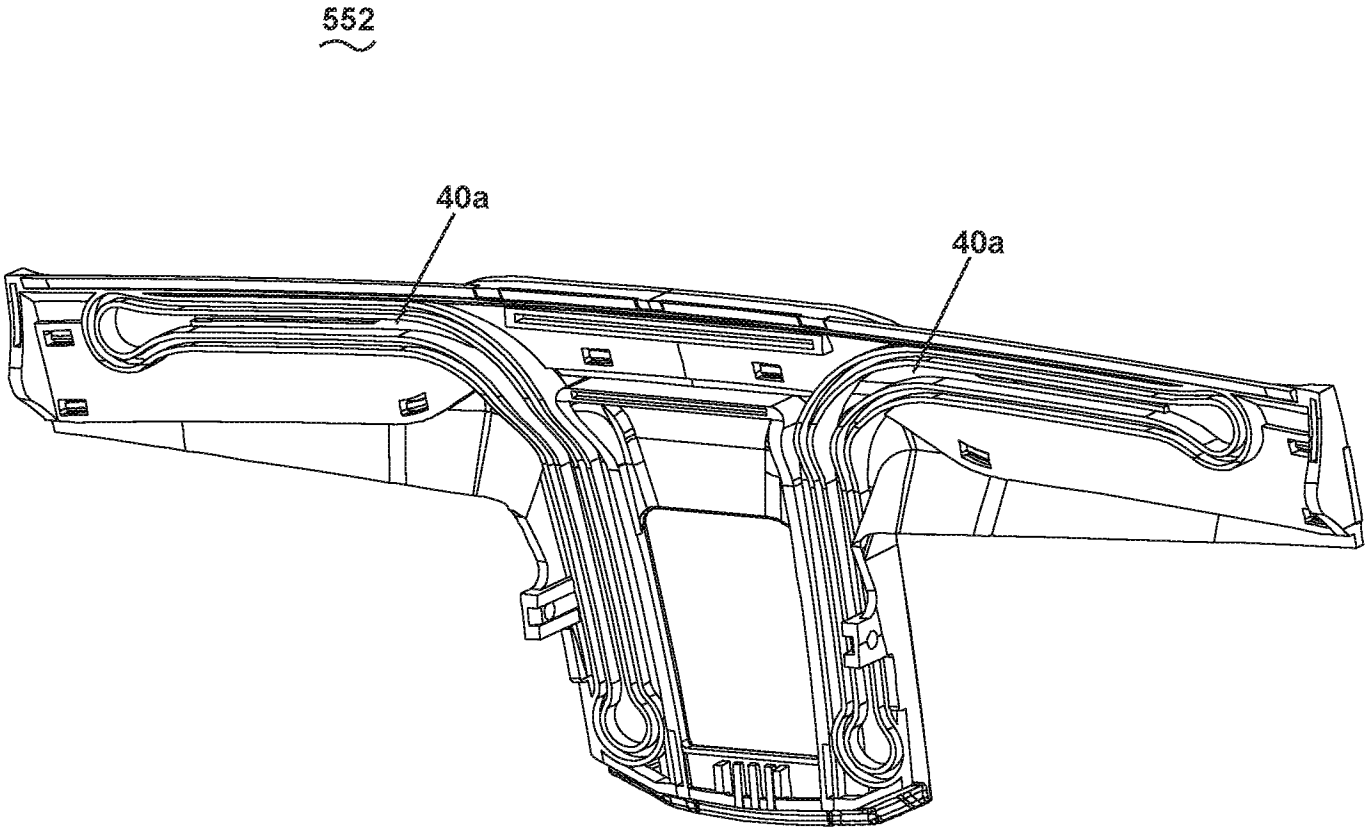
FIG. 13A is a perspective view of a lens cover of the suction nozzle assembly.
Figure 13B:
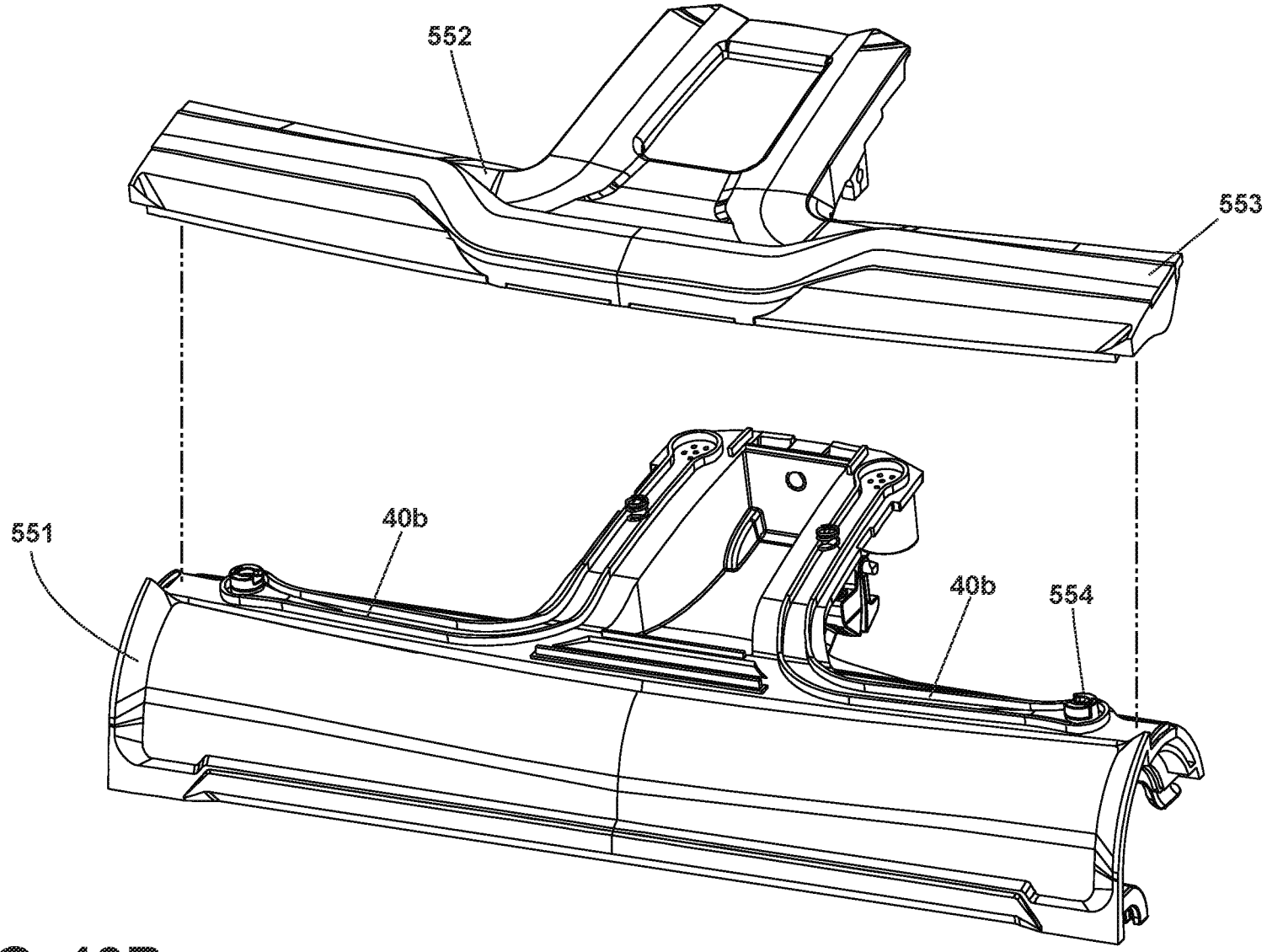
FIG. 13B is an exploded perspective view of the suction nozzle assembly.

FIG. 13A is a perspective view of the underside of the nozzle cover 552 and FIG. 13B is an exploded perspective view of the suction nozzle assembly 580. The nozzle cover 552 includes of two fluid channel portions 40*a* that form an upper portion of the flow channels 40 when mated with nozzle housing 551. The nozzle housing 551 includes two fluid channel portions 40*b* that form lower portions of the flow channels 40 when mated with the nozzle cover 552. Fluid channel portions 40*a* and 40*b* mate to form the fluid delivery flow channels 40 therebetween containing the spray tips 554 at the second terminal ends partially therein.

The nozzle housing 551 can define a lens for the brush chamber 565 and can include a translucent or transparent material to allow the brushroll 546 to be viewed therethough. Likewise, the nozzle cover 552 can define a lens cover, and can include a translucent or transparent material, which permits a user to view the flow of fluid through the flow channels 40.

Figure 14:
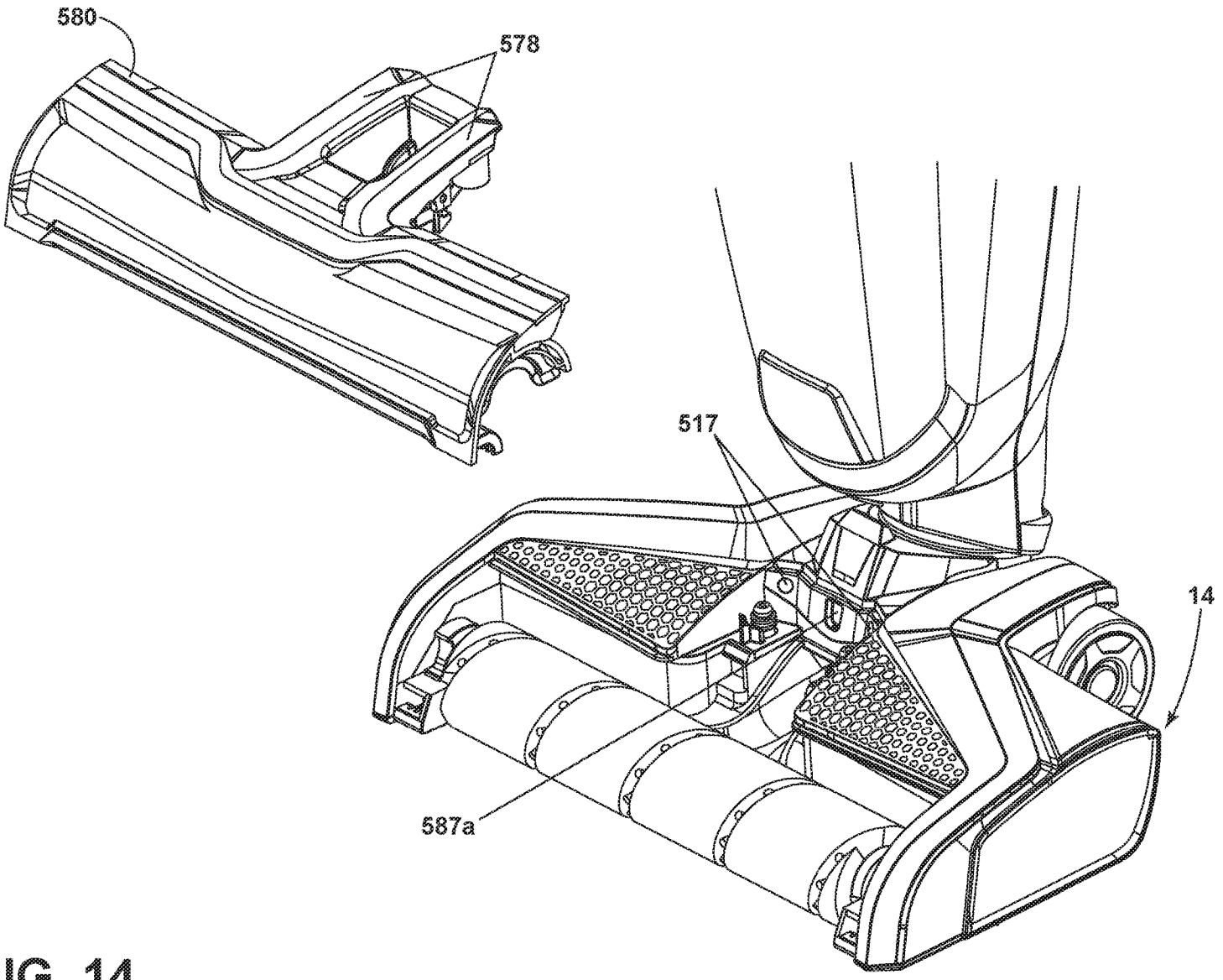
FIG. 14 is a partially exploded view of the foot assembly.

FIG. 14 is a partially exploded view of the base. In FIG. 14, suction nozzle assembly 580 is removed to expose the indicator lights 517. The indicator lights 517 can be configured to activate in combination with the pump assembly 140 when trigger 113 is depressed to deliver fluid (FIG. 2). A portion of the base can form a light tube or light pipe 578 that is illuminated by the indicator lights 517 when fluid is delivered, indicating to the user that fluid is being delivered to the surface underneath the base 14. The light pipe 578 can be any physical structure capable of transporting or distributing light from the indicator lights 517. The light pipe 578 can be a hollow structure that contain the light with a reflective lining, or a transparent solid structure that contain the light by total internal reflection. In the illustrated example, light pipes 578 are solid structures formed on the suction nozzle assembly 580 and are elongated to extend along the fluid delivery channels 40 and configured to distribute of light over its length. More specifically, the light pipes 578 are embodied as raised rails molded onto the surface of the nozzle cover 552, generally above the fluid delivery channels 40.

Figure 15:
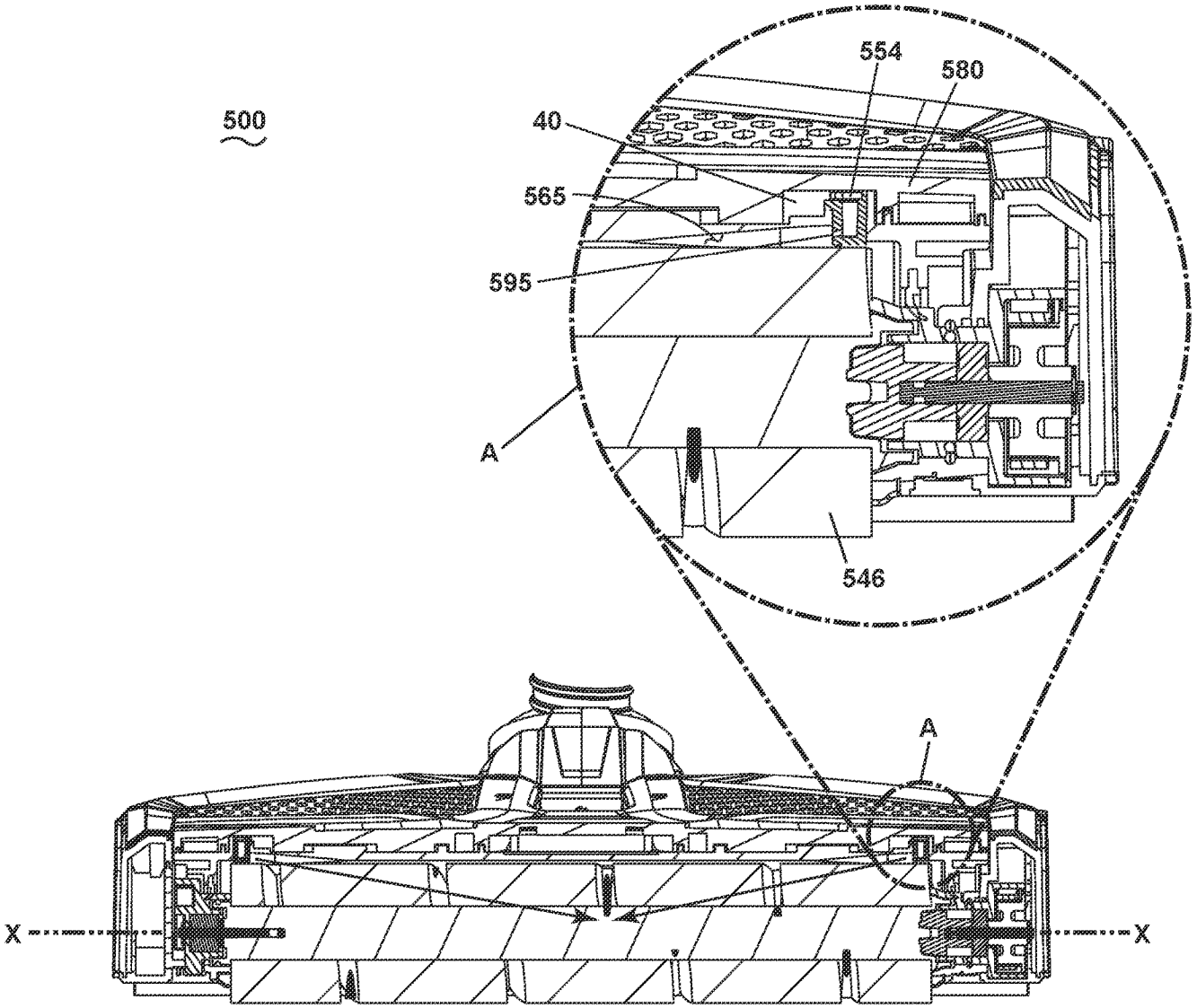
FIG. 15 is a cross-sectional view of the foot assembly of FIG. 1 through line XV-XV of FIG. 1 and includes an enlarged view of section A, showing a fluid dispenser of the surface cleaning apparatus of FIG. 1.

FIG. 15 is a cross-sectional view of the foot assembly 500 through line XV-XV of FIG. 1, with portion A enlarged for a close up view of a fluid dispenser in the form of the spray tip 554. The spray tip 554 is mounted in each of the terminal ends of each of the fluid delivery flow channels 40 of the suction nozzle assembly 580 and can be configured to terminate in the brush chamber 565. Each spray tip 554 includes an orifice 595 oriented to spray onto the brushroll 546 as depicted by the solid arrows in FIG. 15. The spray tips 554 can be oriented to spray along a horizontal axis which may be parallel to the rotational axis X of the brushroll 546 or at a substantially horizontal angle relative to the rotational axis X in order to wet the entire length of the brushroll 546 during fluid dispensing. By "substantially horizontal" the angle of spray of the orifice 595 can be 0 to 30 degrees, depending on the length of the brushroll and the spacing of the spray tips 554 in order to cover the entire brushroll 546 with fluid. The angle of the spray tips 554 may be static or adjustable while the multi-surface wet surface cleaning apparatus 10 is in operation or prior to operation. The spray tip outlet orifice 595 can have any diameter suitable to deliver fluid at the desired pressure, pattern, and/or volume from the spray tip 554. In the present example, spray tips 554 have an outlet orifice diameter of 1.0 mm and are oriented to spray inwardly onto a top of the brushroll 546 at an angle of 15 degrees from the horizontal.

Figure 16A:
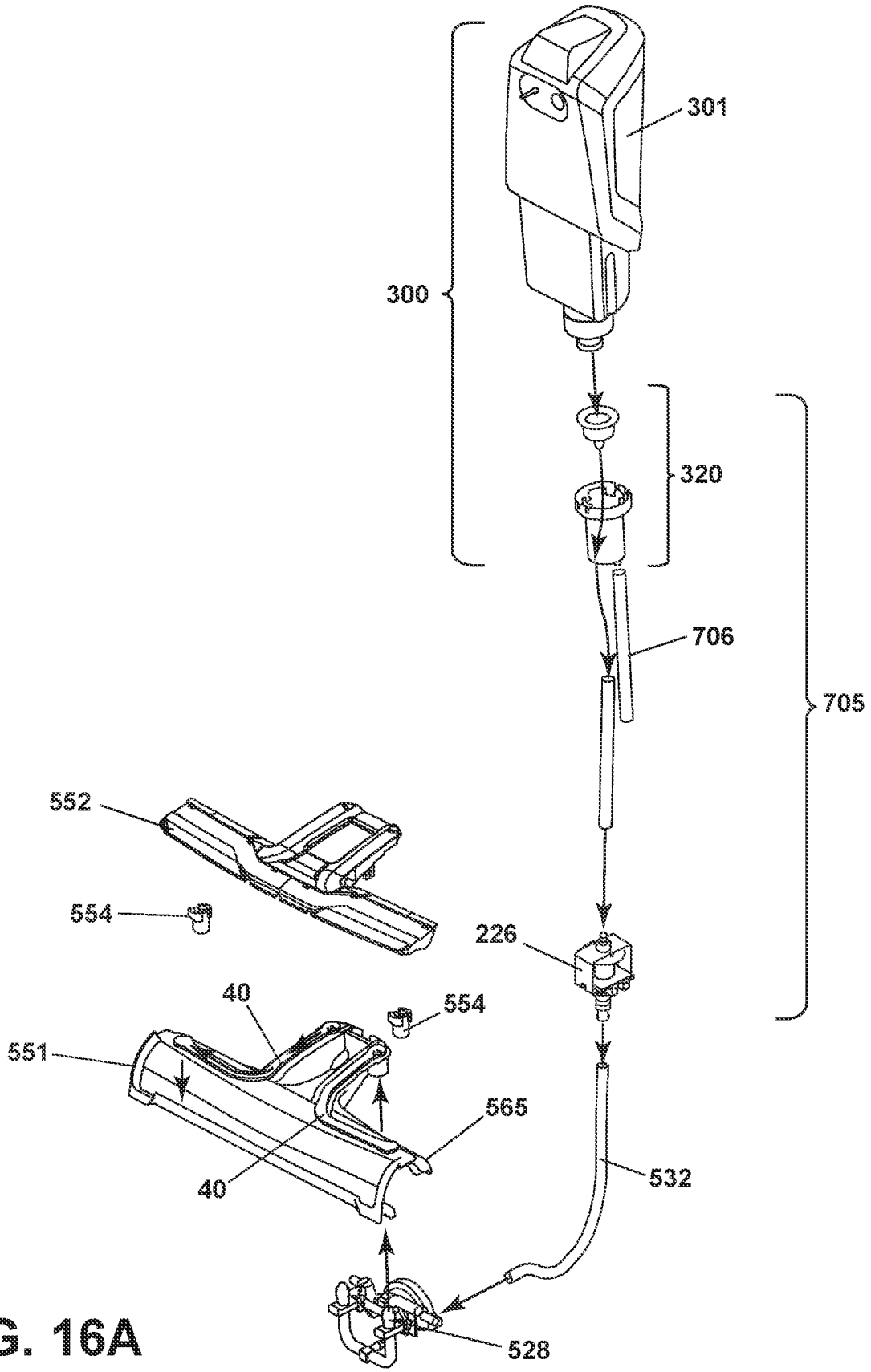
FIG. 16A is a schematic diagram of a fluid delivery pathway of the surface cleaning apparatus of FIG. 1.

FIG. 16A is a schematic diagram of a fluid supply pathway of the surface cleaning apparatus 10. The arrows present designate the directional flow of fluid in the fluid supply pathway according to the present example. The fluid supply pathway can include the supply tank 301 for storing a supply of fluid. The fluid can include one or more of any suitable cleaning fluids, including, but not limited to, water, compositions, concentrated detergent, diluted detergent, etc., and mixtures thereof. For example, the fluid can include a mixture of water and concentrated detergent.

Figure 19:
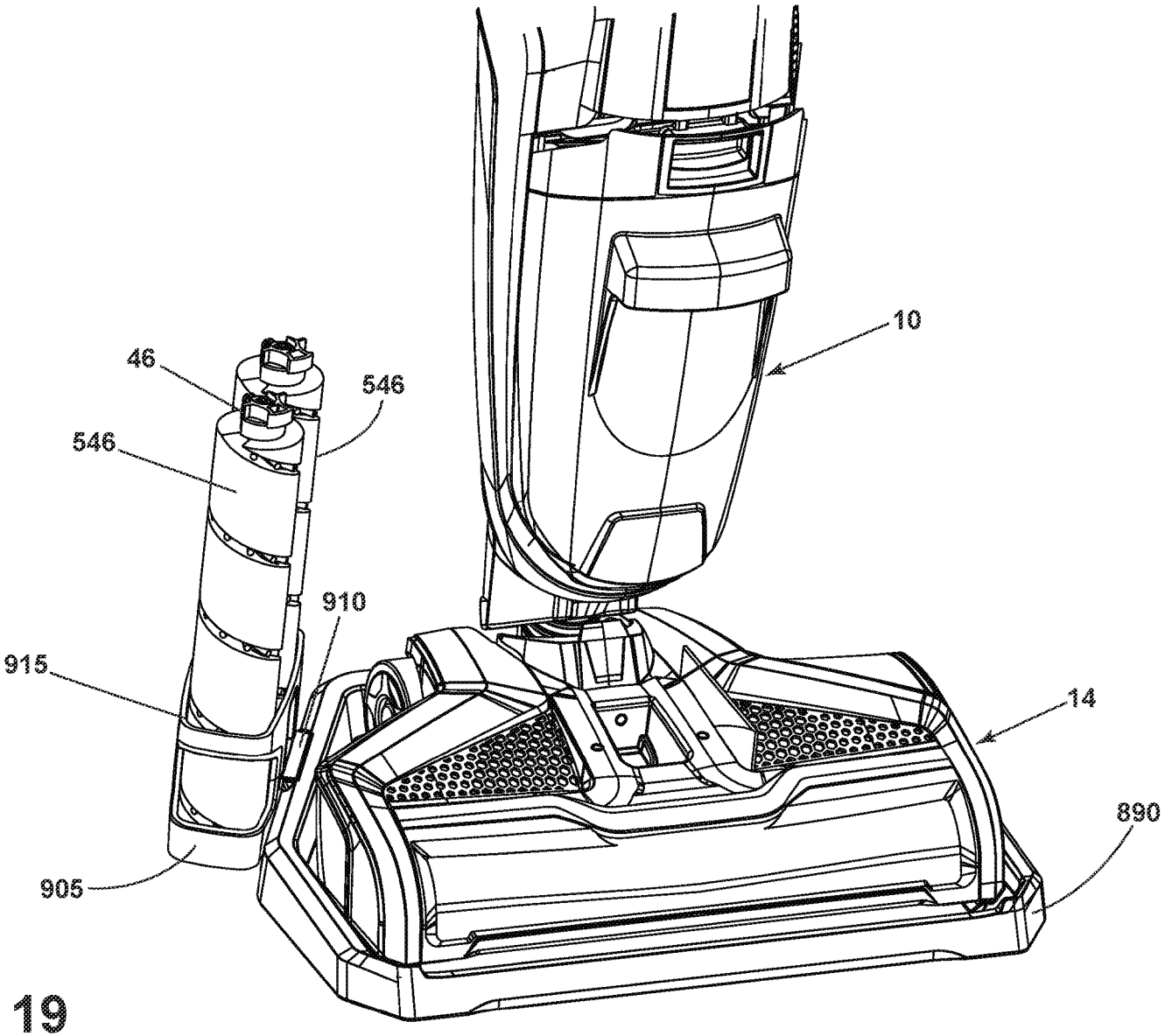
FIG. 19 is a perspective view of a storage tray to receive the surface cleaning apparatus of FIG. 1 and at least one extra brushroll.

The fluid supply pathway can further include a flow control system 705 for controlling the flow of fluid from the supply tank 301 to fluid supply conduit 532. In one configuration, the flow control system 705 can include pump 226, which pressurizes the system, and supply valve assembly 320, which controls the delivery of fluid to the fluid supply conduit 532. In this configuration, fluid flows from the supply tank 301, through pump 226, to the fluid supply conduit 532. A drain tube 706 provides a pathway for draining any fluid that may leak from the supply tank 301 while the surface cleaning apparatus 10 is not in active operation to a drain hole (not pictured) in foot assembly 500 to collect in a storage tray 900 (FIG. 19). From the fluid supply conduit 532, fluid flows sequentially through the spray connectors 528, through the fluid delivery channels 40, through the spray tips 554, and onto the brushroll 546 (FIG. 15), which applies the fluid to the surface to be cleaned.

The trigger 113 (FIG. 2) can be depressed to actuate the flow control system 705 and dispense fluid to the fluid dispenser 554. The trigger 113 can be operably coupled to the supply valve 320 such that pressing the trigger 113 will open the valve 320. The valve 320 can be electrically actuated, such as by providing an electrical switch between the valve 320 and a power source 22 (FIG. 18) that is selectively closed when the trigger 113 is pressed, thereby powering the valve 320 to move to an open position. In one example, the valve 320 can be a solenoid valve. The pump 226 can also be coupled with the power source 22. In one example, the pump 226 can be a centrifugal pump. In another example, the pump 226 can be a solenoid pump.

In another configuration of the fluid supply pathway, the pump 226 can be eliminated and the flow control system 705 can include a gravity-feed system having a valve fluidly coupled with an outlet of the supply tank(s) 301, whereby when valve is open, fluid will flow under the force of gravity to the fluid dispenser 554. The valve 320 can be mechanically actuated or electrically actuated, as described above.

Figure 16B:
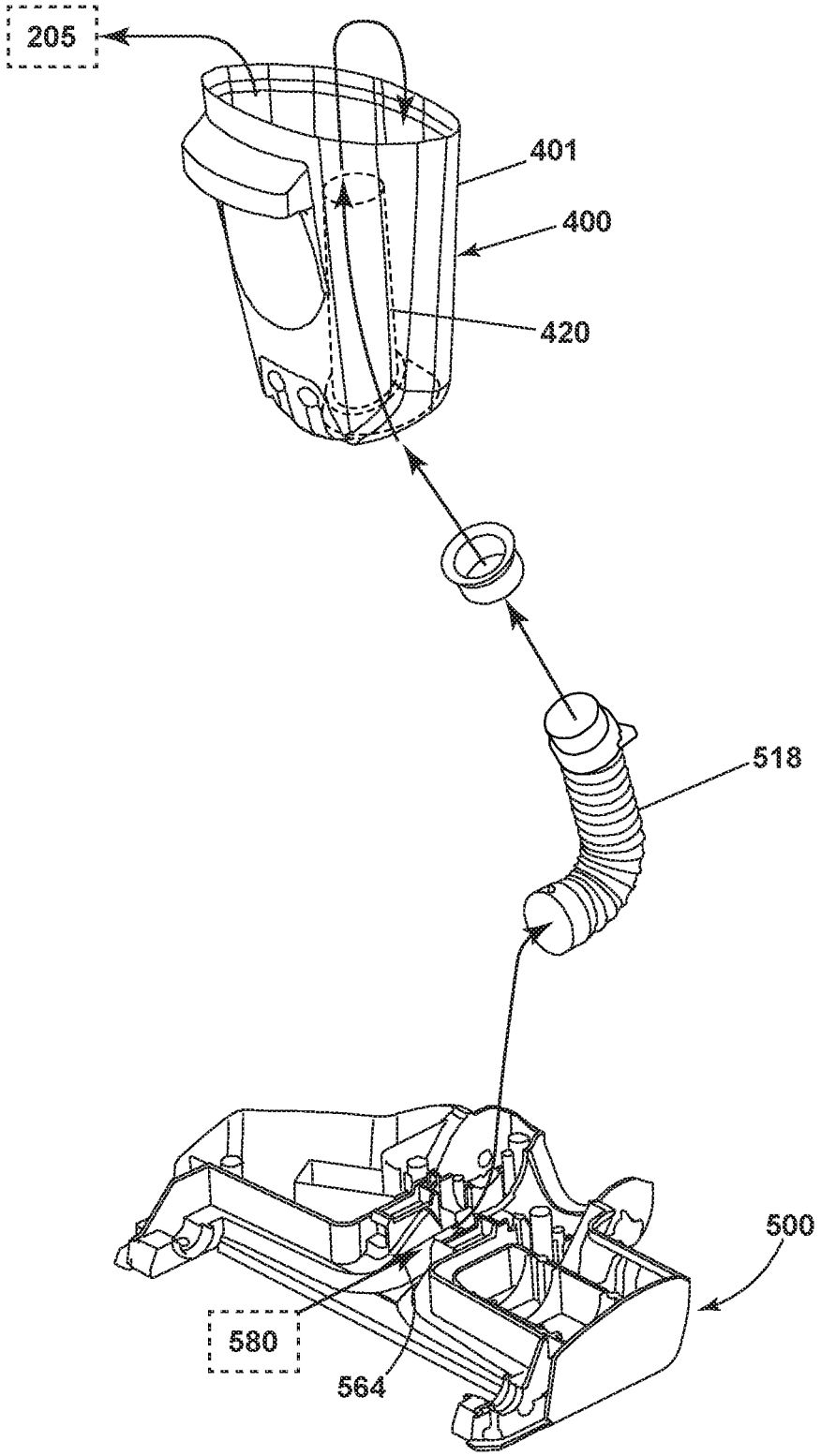
FIG. 16B is a schematic diagram of a fluid recovery pathway of the surface cleaning apparatus of FIG. 1.

FIG. 16B is a schematic diagram of a fluid recovery pathway of the surface cleaning apparatus 10. The arrows present designate the directional flow of fluid in the fluid recovery pathway. The fluid recovery pathway can include the suction nozzle assembly 580, the foot conduit 564, the flexible conduit hose 518, the suction motor/fan assembly 205 in fluid communication the suction nozzle assembly 580 for generating a working air steam, and recovery tank 401 for separating and collecting fluid and debris from the working airstream for later disposal. Standpipe 420 can be formed in a portion of recovery tank 401 for separating fluid and debris from the working airstream. The suction motor/fan assembly 205 provides a vacuum source in fluid communication with the suction nozzle assembly 580 to draw the fluid and debris from the surface to be cleaned through the flexible hose conduit 518 to the recovery tank 401.

Figure 17:
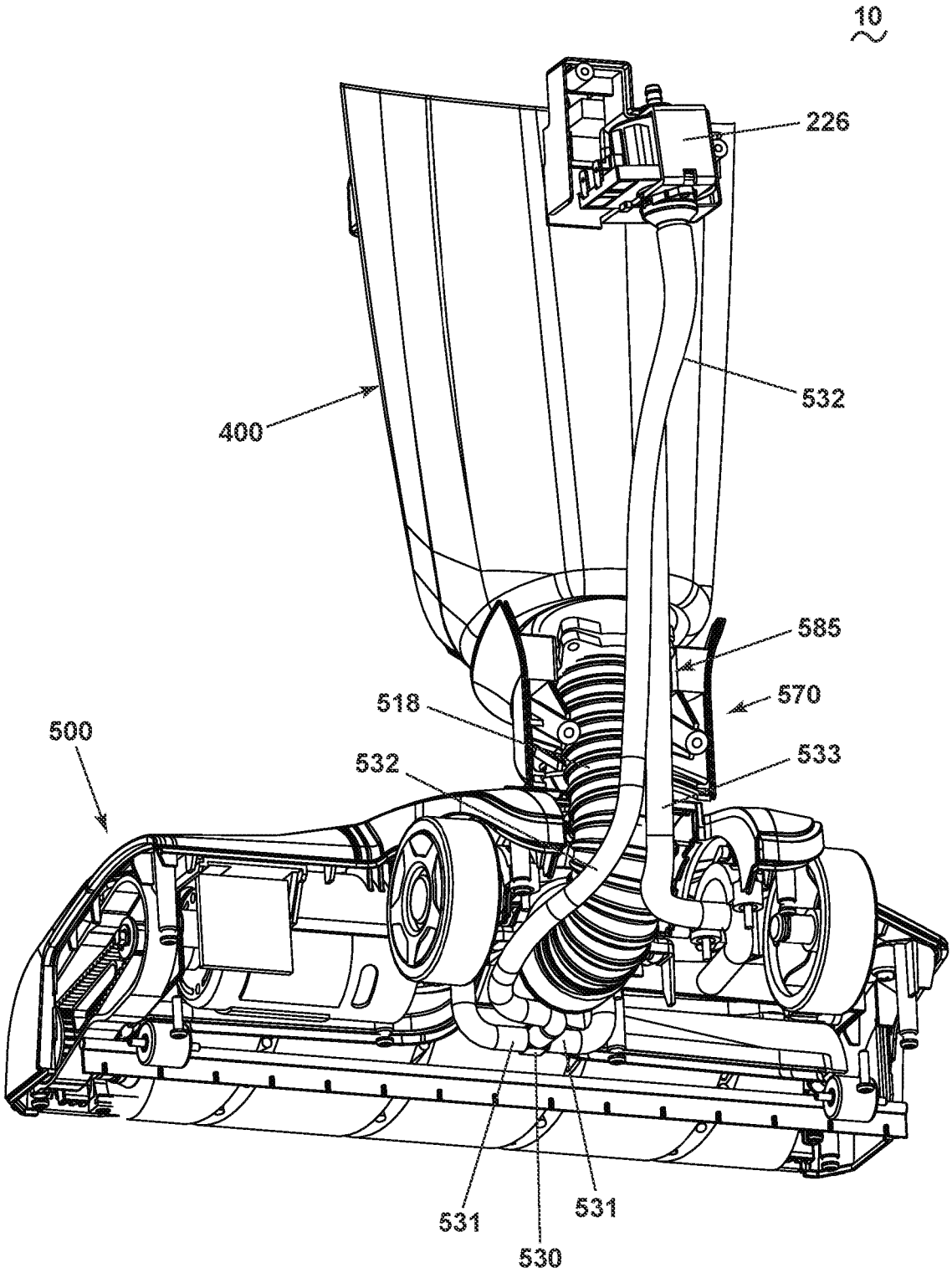
FIG. 17 is a rear perspective view of the surface cleaning apparatus of FIG. 1 with portions removed to show a conduit assembly.

FIG. 17 is a rear perspective view of the surface cleaning apparatus 10 with portions removed to show the conduit assembly 585. In the present example, flexible conduit hose 518 couples dirty tank assembly 400 to foot assembly 500 through a forward portion of pivotable swivel joint assembly 570. Fluid supply conduit 532 and wiring conduit 533 can be provided rearward of flexible conduit hose 518. Fluid supply conduit 532 fluidly couples the pump 226 the T-connector 530 in the foot assembly 500.

Figure 18:
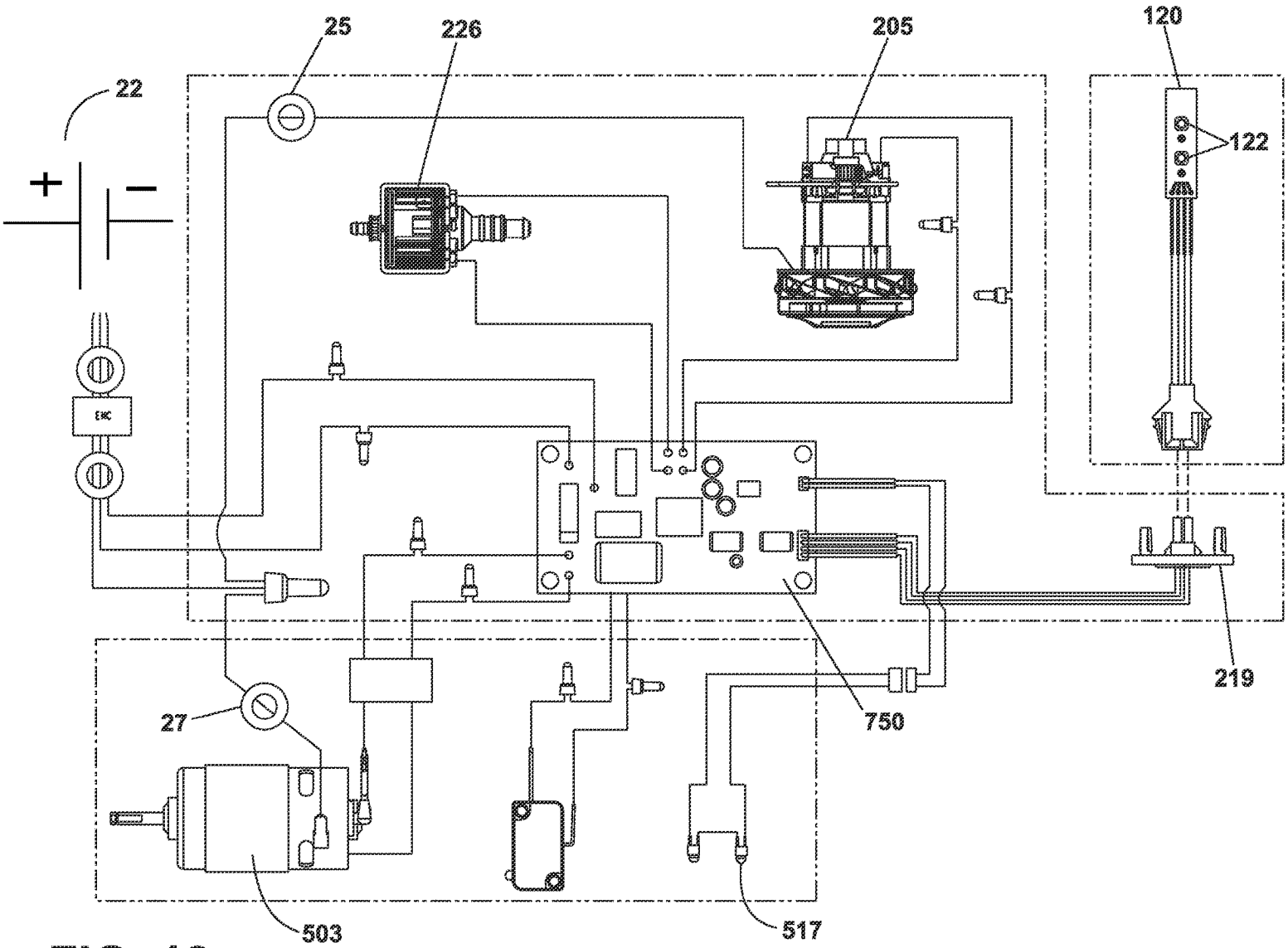
FIG. 18 is a schematic circuit diagram of the surface cleaning apparatus of FIG. 1.

FIG. 18 is a schematic circuit diagram of the surface cleaning apparatus 10. User interface assembly 120 can be operably connected to the various components of cleaner 10 directly or through a central control unit 750. User interface assembly 120 can include one or more actuators and be configured with any combination of buttons, switches, toggles, triggers, or the like to allow a user to select multiple cleaning modes and/or control the fluid delivery and recovery systems. A power source 22, such as a battery 22 can be electrically coupled to the electrical components of the surface cleaning apparatus 10, including the motors 205, 503 and pump 226. Therefore, the surface cleaning apparatus 10 can be considered cordless. A suction power switch 25 between the suction motor/fan assembly 205 and the power source 22 can be selectively closed by the user, thereby activating the suction motor/fan assembly 205. Furthermore, a brush power switch 27 between the brush motor 503 and the power source 22 can be selectively closed by the user, thereby activating the brush motor 503. User interface assembly 120 can be operably coupled to the pump 226 such that an actuator, such as trigger 113, can activate the pump 226 when engaged, thereby powering the pump 226 to deliver fluid to the fluid supply pathway. Actuation of the pump 226 can be operably connected to the LED lights 517 such that actuation of trigger 113 additionally powers LED indicator lights 517 to provide user feedback that fluid is being delivered to the fluid supply pathway.

In one example, user interface assembly 120 of surface cleaning apparatus 10 can be provided with actuators 122 for selecting multiple cleaning modes to be selected by the user. Actuators 122 send a signal to the central control unit 750, which can include a PCBA. The output from the central control unit 750 adjusts the frequency of the solenoid pump 226 to generate the desired flow rate depending on the mode selected. For instance, the surface cleaning apparatus 10 can have a hard floor cleaning mode and a carpet cleaning mode. In the hard floor cleaning mode, the liquid flow rate to the fluid dispenser 554 is less than in the carpet cleaning mode. The liquid flow rate is controlled by the speed of the pump 226. In one non-limiting example, the speed of the pump 226 is controlled in the hard floor cleaning mode so that the liquid flow rate is approximately 50 ml/min and the speed of the pump 226 is controlled in the carpet cleaning mode so that the liquid flow rate is approximately 100 ml/min. Optionally, the surface cleaning apparatus 10 can have a wet scrubbing mode in which the suction motor/fan assembly 205 can be inoperative while brush motor 503 is activated so that the soiled cleaning solution is not removed from the surface to be cleaned.

FIG. 19 is a perspective view of a storage tray 900 for the surface cleaning apparatus 10. Storage tray 900 can be configured to receive the base 14 of the surface cleaning apparatus 10 in an upright, stored position. Storage tray 900 can optionally be adapted to contain a liquid for the purposes of cleaning the interior parts of cleaner 10 and/or receiving liquid from the drain tube 706 (FIG. 16A). In the present example, storage tray 900 is adapted to receive the base 14 and includes a removable brushroll holder 905 provided on an exterior side wall of the tray 900. Alternatively, storage tray 900 can be configured with an integral brushroll holder 905. Here, the brushroll holder 905 can be secured to the storage tray 900 by a retention latch 910. Retention latch 910 can include a sliding lock, clamp, brace, or any other mechanism in which to secure brushroll holder 905 to its position on storage tray 900 while in use and can be biased or otherwise configured to allow a user to release a lock and remove the brushroll holder 905 from storage tray 900. Brushroll holder 905 can be adapted to removably receive one or more brushrolls 546 for the purposes of storage and/or drying. Brushroll holder 905 can include one or more brushroll slots 915 to securely receive brushrolls 546 in a vertical fixed position for drying and storage. Brushroll slots 915 can be fixed or adjustable and can include clamps, rods, or molded receiving positions that can accommodate brushroll 546 with or without the dowel 46 inserted. Alternatively, brushroll holder 905 can include a series of horizontal storage positions such racks, hooks, or clamps (not shown) to secure brushrolls 546 in a horizontal position.

Figure 20:
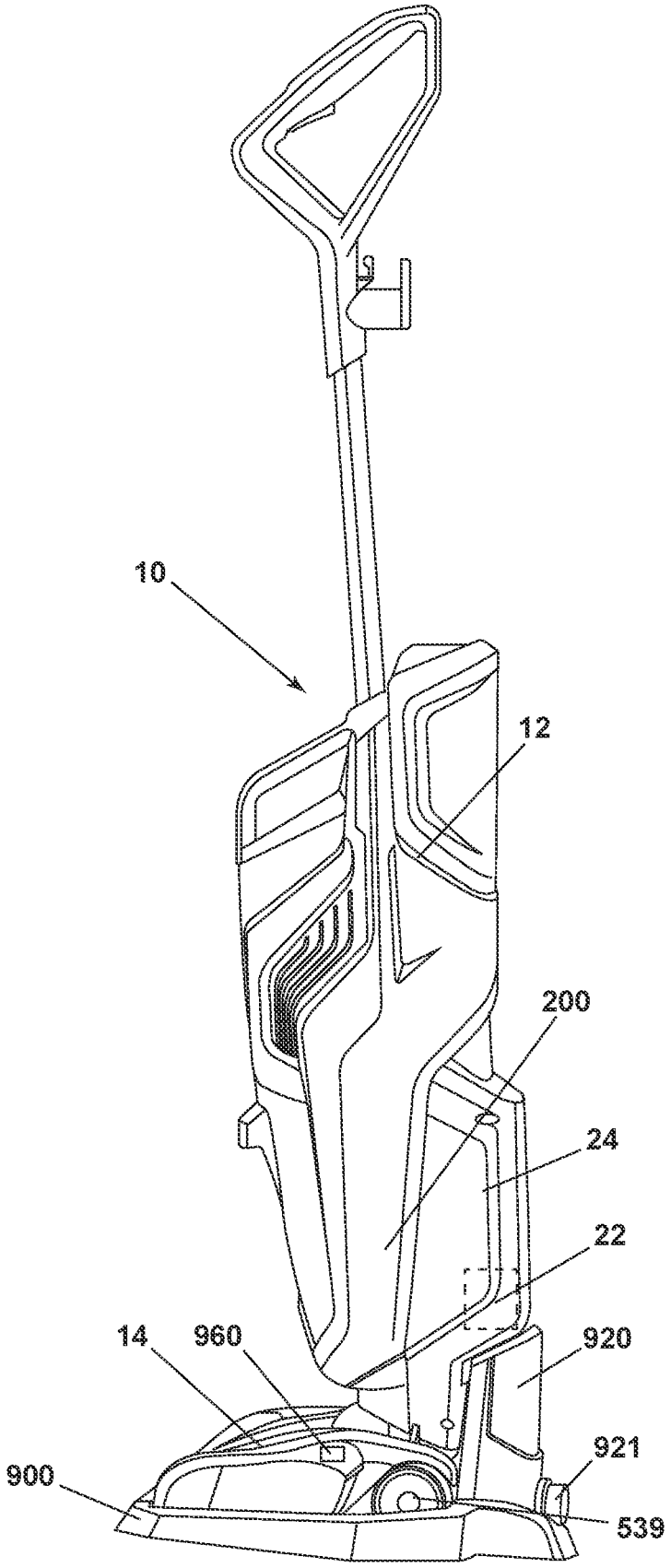
FIG. 20 is a side view of the surface cleaning apparatus docked within the storage tray of FIG. 19 according to various aspects described herein.

FIG. 20 is a side view of the storage tray 900 for the surface cleaning apparatus 10 more clearly illustrating a charging unit 920 provided on the storage tray 900. The charging unit 920 can electrically couple the battery 22 when the surface cleaning apparatus 10 base 14 is seated onto the storage tray 900. Therefore, the storage tray 900 functions as a charging base or a charging tray. An electric coupler 921 can be provided at the rear of the charging unit 920. The electric coupler 921 can electrically couple the charging unit 920 to a power source including, but not limited to, a household outlet. In one example, a cord (not shown) can be coupled with the electric coupler 921 that can connect the electric coupler 921 to the power source.

Also better illustrated in the side view is that a battery housing 24 can be provided on the handle assembly 12 to protect the battery 22 and retain the battery 22 on the surface cleaning apparatus 10. The battery housing 24 can be integral with the handle assembly 12 such that the battery housing 24 forms a portion of the handle assembly 12. Alternatively, the battery housing 24 can be removably coupled with the handle assembly 12. The battery housing 24 and the charging unit 920 of the storage tray 900 can include complementary shapes. In this manner, the battery housing 24 fits against the charging unit 920 in order to couple the battery housing 24 and the charging unit 920.

Figure 21:
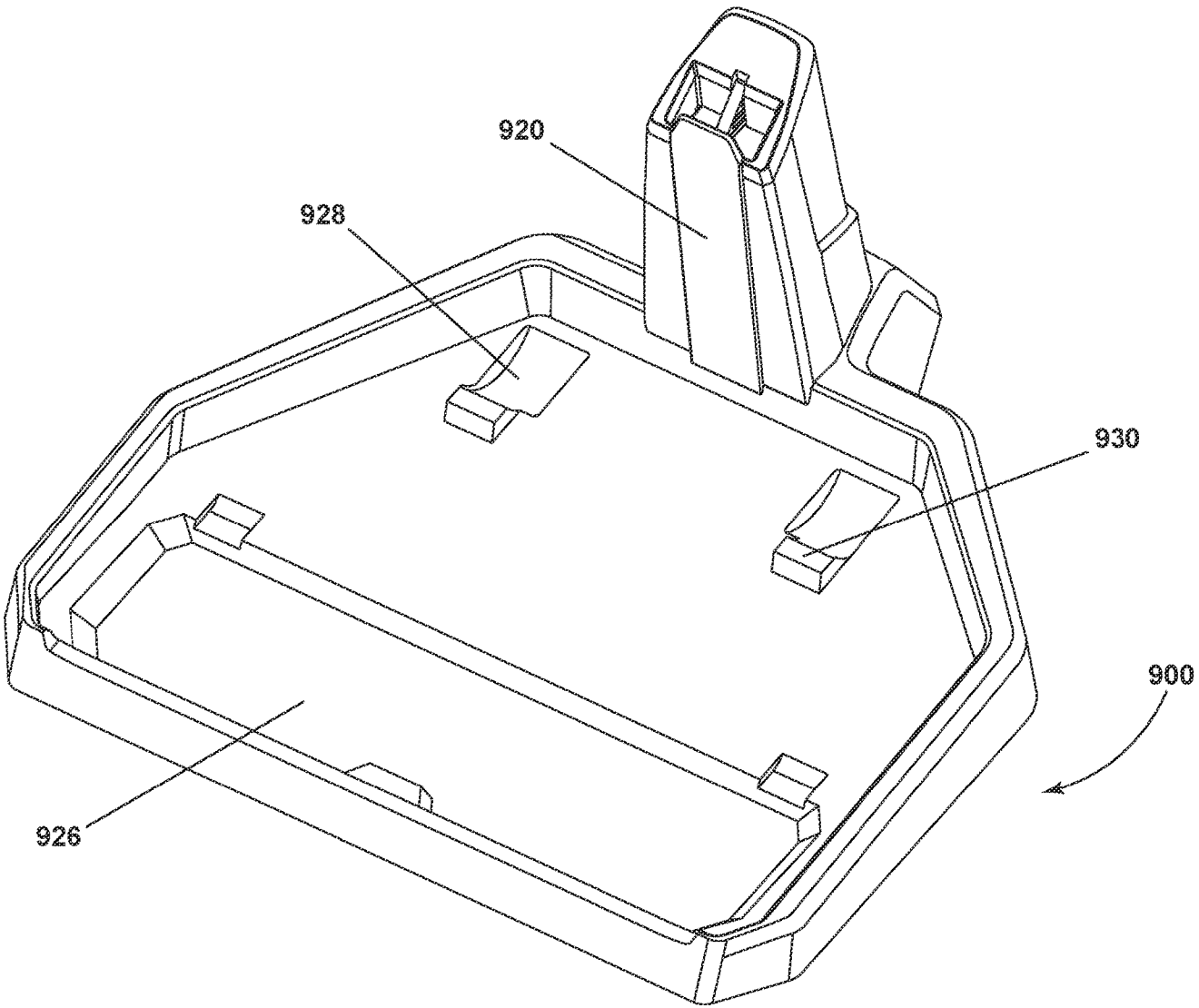
FIG. 21 is a perspective view of the storage tray of FIG. 19 according to various aspects described herein.

FIG. 21 is a perspective view of the storage tray 900 without the surface cleaning apparatus 10 and without the removable brushroll holder 905. A self-cleaning reservoir 926 is provided on the storage tray 900 for use in self-cleaning modes of the surface cleaning apparatus 10. The self-cleaning reservoir 926 can be formed as a recess in the storage tray 900. The reservoir 926 is shaped to fit a brush roll 546 (FIG. 2) when the brush roll 546 is coupled with the surface cleaning apparatus 10 and to retain a cleaning solution. Wheel holders 928 can be formed on the storage tray 900 in order to retain the rear wheels 539 (FIG. 20). The wheel holders 928 can be formed as a recess, or groove in the storage tray 900 and can include a wheel block 930. The wheel block 930 can be a raised portion configured to prevent the rear wheels 539 from rolling out of the wheel holders 928.

Figure 22:
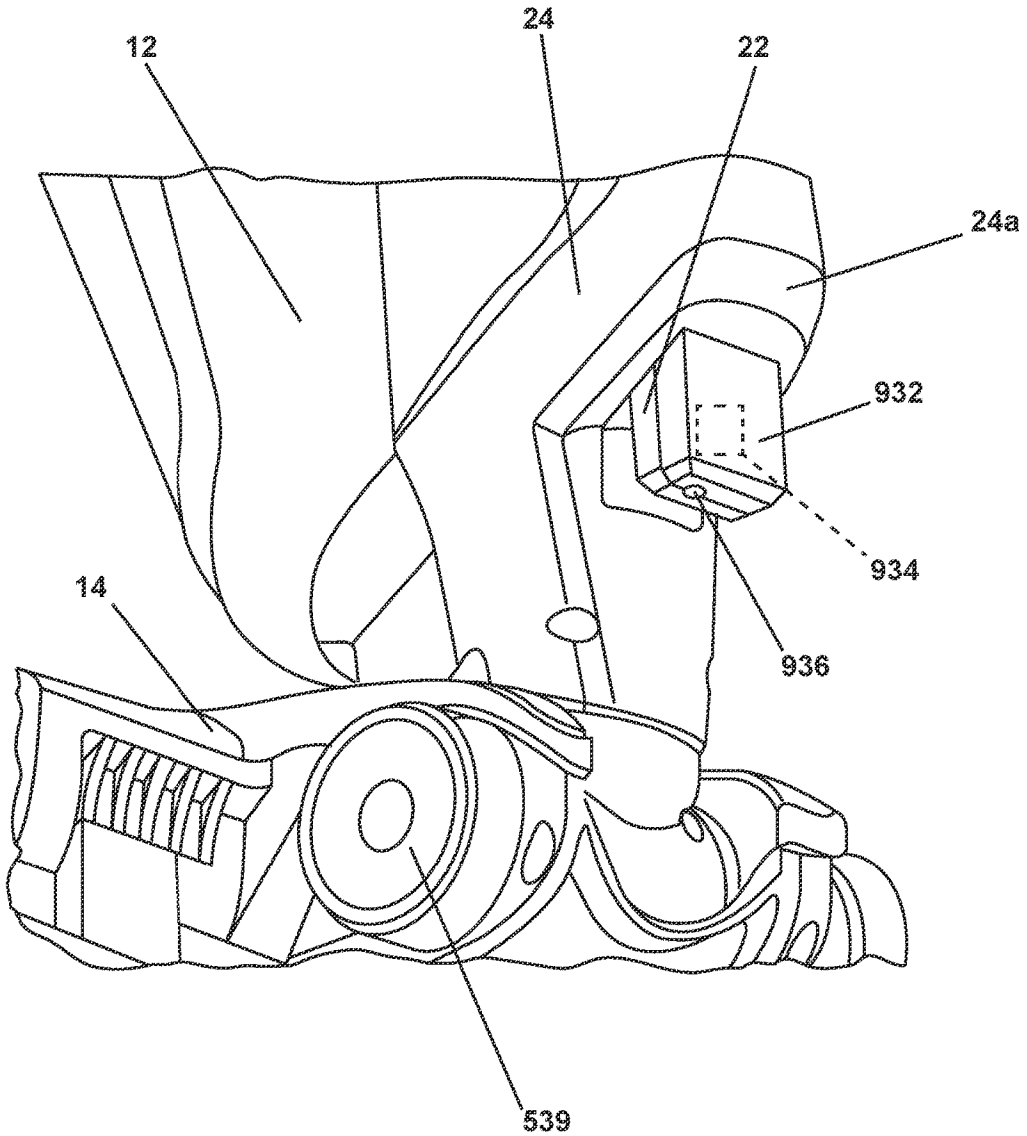
FIG. 22 is a rear, perspective view of the handle assembly of the surface cleaning apparatus according to various aspects described herein.

FIG. 22 shows a rear, perspective view of a lower portion of the handle assembly 12 including the battery housing 24. A battery cover 932 can be disposed on top of the battery 22 to protect the components of the battery 22. In the current embodiment, the battery 22 is fixed or non-removable. A DC jack 934 having a charging contact 942 (FIG. 24) can be provided in the battery 22 and can include a DC jack socket 936. While FIG. 22 illustrates a non-removable battery 22, it is also possible for aspects described herein to include a battery that can be removable from the battery housing 24 such that the battery 22 can be replaced, by a user, with a new battery 22 if need be.

Figure 23:
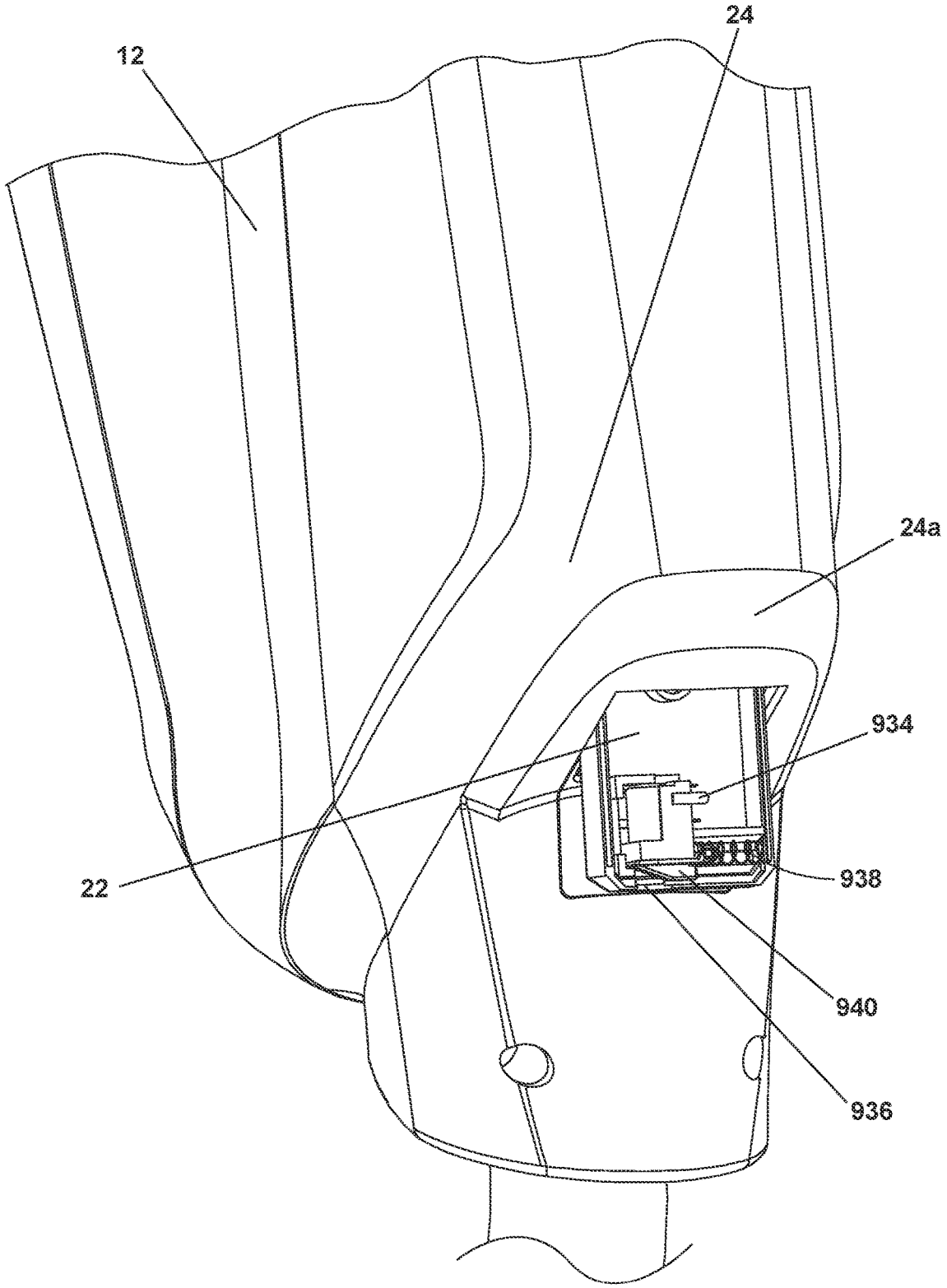
FIG. 23 is a rear, perspective view of the battery housing according to various aspects described herein.

FIG. 23 illustrates the battery 22 without the battery cover 932 in order to more clearly show the components of the battery 22. The DC jack socket 936 can be covered, or closed with a DC jack cover 940 by way of a spring 938. The spring 938 can be compressed, or retained, by the battery cover 932 (FIG. 22) when the battery cover 932 is mounted to the battery 22. Thus, the spring 938 under compression can provide a force on the DC jack cover 940 to hold the DC jack cover 940 in the closed position. FIG. 23 shows the DC jack cover 940 is in the closed position such that the DC jack cover 940 is in alignment with the DC jack socket 936, shielding the DC jack charging contact 942 such that liquid can be prevented from entering the DC jack 934. The spring 938 is partially compressed and normally forces the DC jack cover 940 into the closed position.

Figure 24:
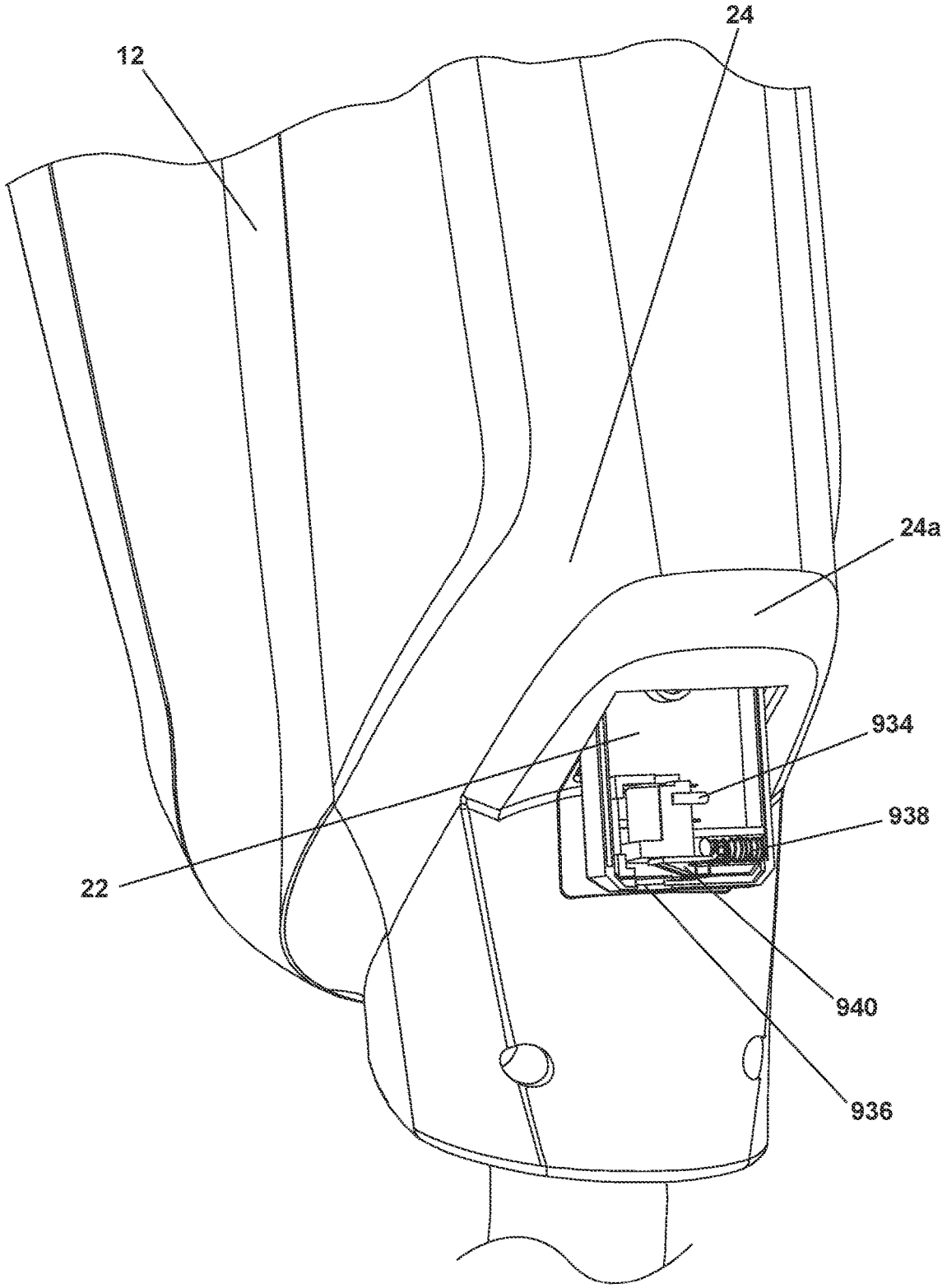
FIG. 24 is a rear, perspective view of the battery housing according to various aspects described herein.

FIG. 24 illustrates the DC jack cover 940 in an open position, where the DC jack cover 940 is moved out of alignment with the DC jack socket 936 thereby exposing the DC jack charging contact 942. To move the DC jack cover 940 from the closed position to the open position, a force can push against a ramp 954 of the DC jack cover 940 to move, or slide, the DC jack cover 940 out of alignment with the DC jack socket 936. While a ramp 954 is shown, the surface cleaning apparatus 10 can include any suitable mating feature configurable to move the DC jack cover 940. In the open position, the spring 938 is further compressed.

Figure 25:
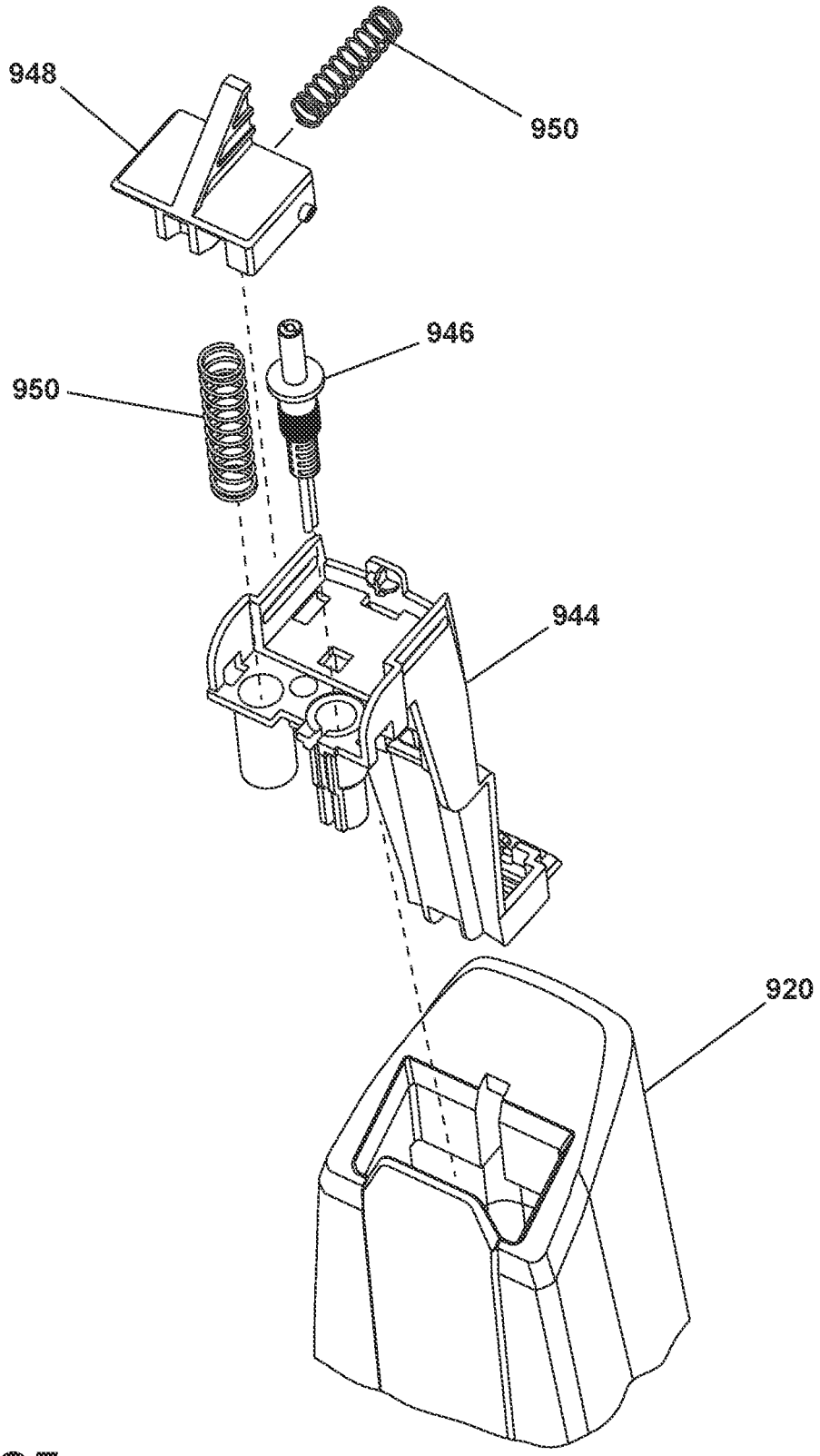
FIG. 25 is an exploded view of the charging unit of the storage tray of FIG. 20 according to various aspects described herein.
Figure 26:
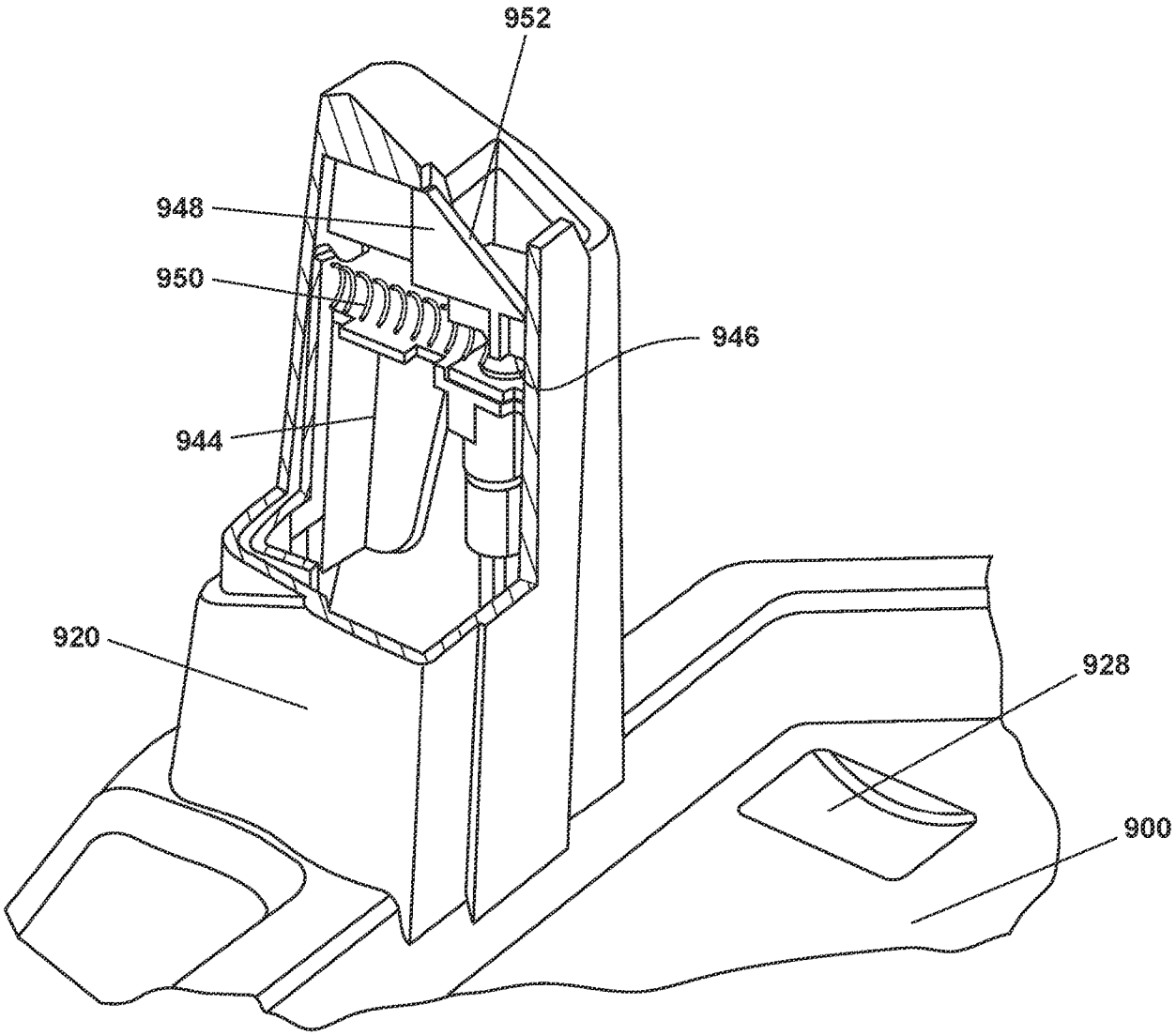
FIG. 26 is a cutaway view of the charging unit of the storage tray of FIG. 20 according to various aspects described herein.

FIG. 25 illustrates an exploded view of the charging unit 920 more clearly showing the components of the charging unit 920. A bracket 944 is provided in the charging unit 920 and includes a charger plug 946 and a plug cover 948. Springs 950 bias the plug cover 948 into a closed position. The closed position (FIG. 26) can include covering, or closing off the charger plug 946. FIG. 26 is a cutaway view of the charging unit 920 more clearly showing the charger plug 946 covered by the plug cover 948 such that the plug cover 948 shields electrical contacts (not shown) provided on the charger plug 946.

Figure 27:
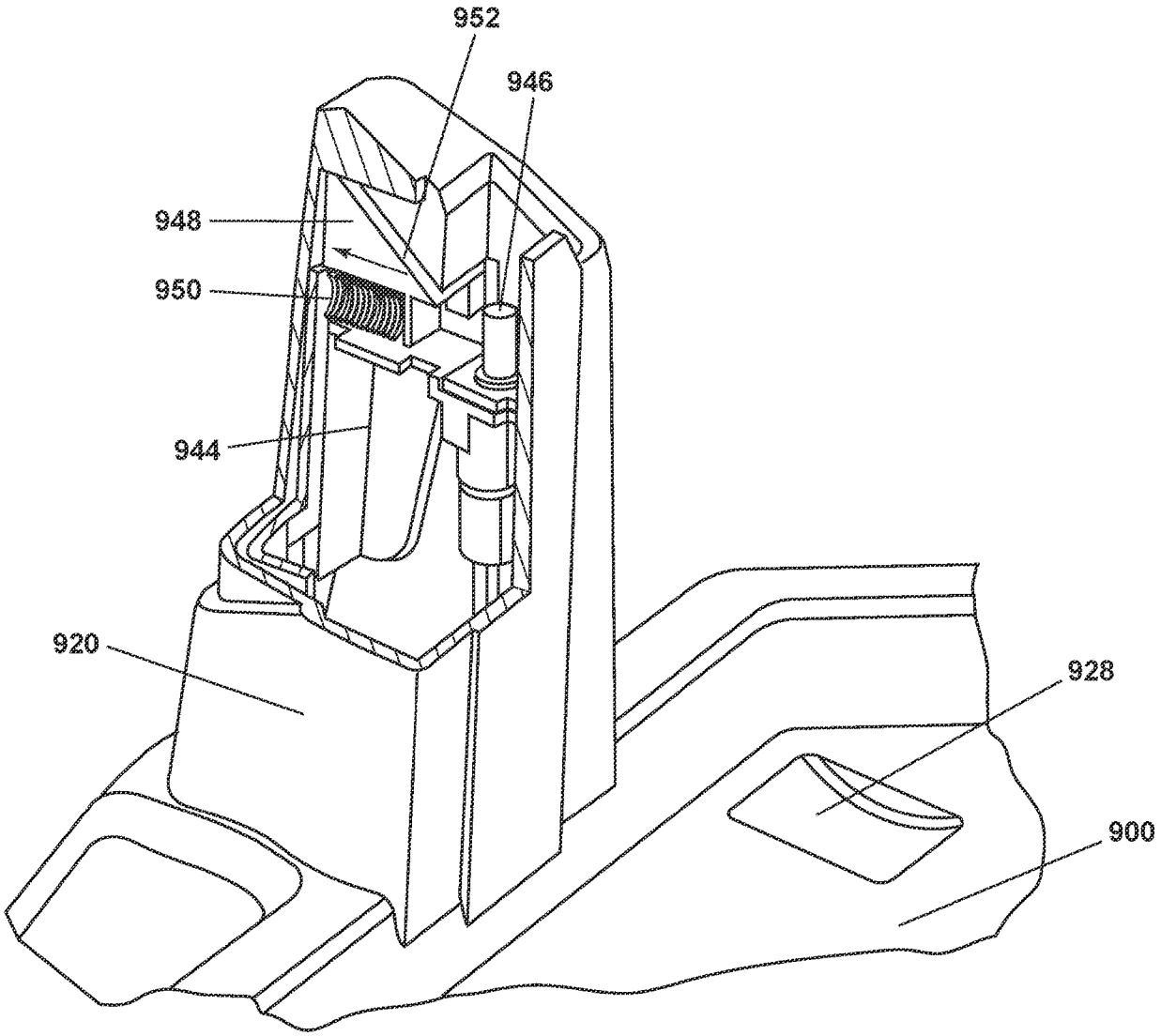
FIG. 27 is a cutaway view of the charging unit of the storage tray of FIG. 20 according to various aspects described herein.
Figure 28:
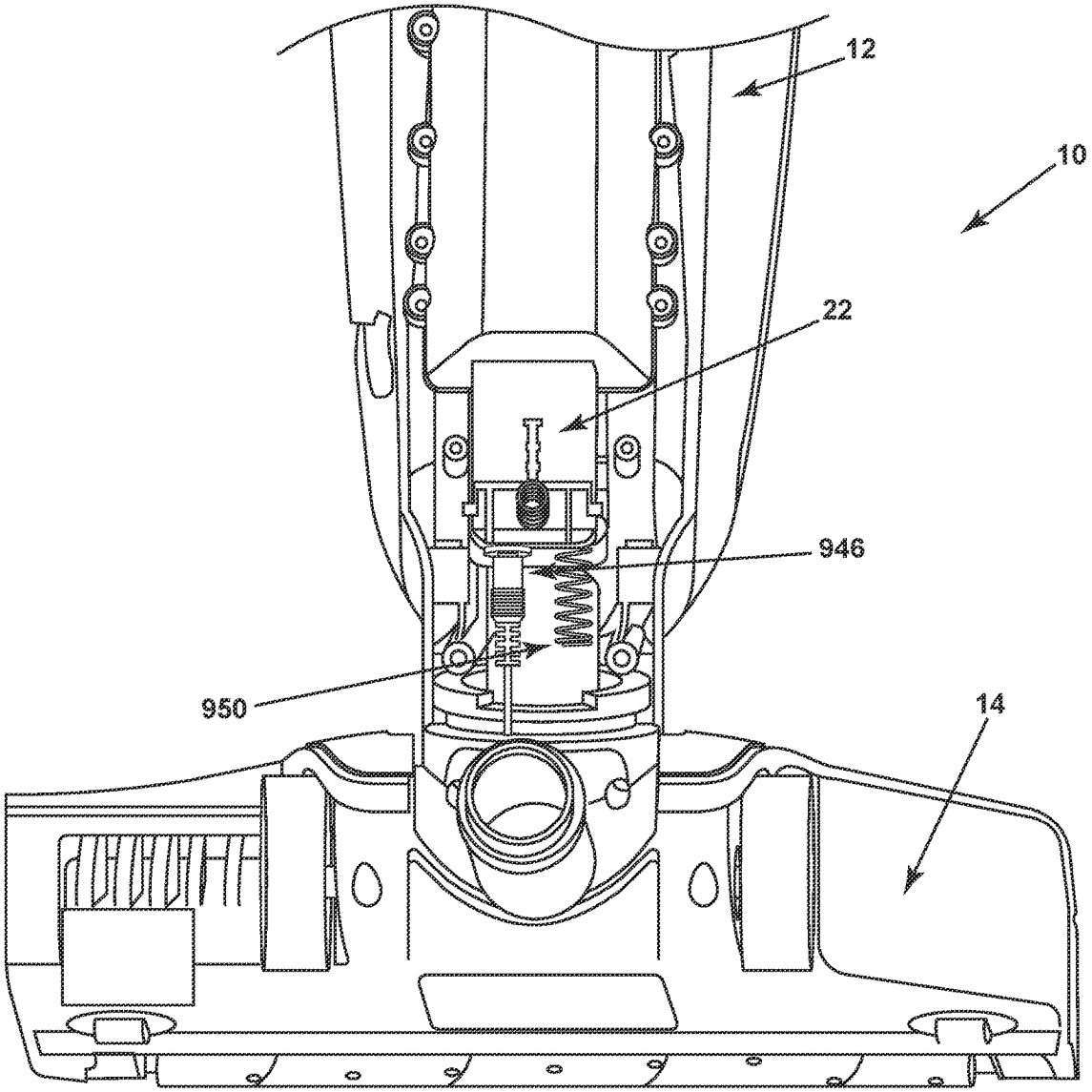
FIG. 28 is a rear view of the surface cleaning apparatus battery according to various aspects described herein.

In order to dock the surface cleaning apparatus 10 within the storage tray 900 for charging, the surface cleaning apparatus 10 is lowered into the storage tray 900 and rear lower portion 24*a* (FIG. 22) of the battery housing 24 can push against a ramp 952 on the plug cover 948, sliding the plug cover 948 rearwardly to expose the charger plug 946. While a ramp 952 is shown, the storage tray 900 can include any suitable mating feature configurable to move the plug cover 948. The rearwardly positioned plug cover 948 and exposed charger plug 946 are illustrated in FIG. 27. As the surface cleaning apparatus 10 continues to be lowered onto the storage tray 900, the charger plug 946 is received within the DC jack socket 936 (FIG. 24). The charger plug 946 can push against the ramp 954 (FIG. 24) on the DC jack cover 940 and force the DC jack cover 940 to slide into the open position (FIG. 24), further compressing the spring 938, such that the DC jack charging contact 942 is exposed and coupled with the charger plug 946 (FIG. 27). The charging plug 946 on the storage tray 900 and DC jack 934 on the surface cleaning apparatus 10 become fully engaged, or electrically connected, when the surface cleaning apparatus 10 is fully seated on the storage tray 900, which is illustrated in FIG. 20. The DC jack socket 936 can be coupled with the charging unit 920 in order to charge the battery 22 via the DC jack 934. FIG. 28 shows the surface cleaning apparatus 10 with the battery housing 24 and storage tray 900 removed to more clearly view the charging plug 946 coupled to the battery 22.

The multi-surface wet surface cleaning apparatus 10 shown in the figures can be used to effectively his remove debris and fluid from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from aspects described herein.

In operation, the multi-surface wet surface cleaning apparatus 10 is prepared for use by coupling the surface cleaning apparatus 10 to the power source 22, and by filling the supply tank 301 with cleaning fluid. A user selects the floor surface type to be cleaned through user interface assembly 120. Cleaning fluid is selectively delivered to the surface to be cleaned via the fluid supply pathway by user-activation of the trigger 113, while the surface cleaning apparatus 10 is moved back and forth over the surface. Pump 226 can be activated by user interface assembly 120. User-activation of trigger 113 activates the pump 226 and fluid is released by clean tank assembly 300 into the fluid delivery pathway through spray tips 554 and onto brushroll 546. The wetted brushroll 546 is wiped across the surface to be cleaned to remove dirt and debris present on the surface.

Activation of the trigger 113 also simultaneously activates LED indicator lights 517 which transmit light through the LED lenses 545 and into nozzle cover 552 along the light pipes 578 to provide an illuminated indication that fluid is being dispensed. The illumination of the LEDs 517 and light pipes 578 indicate to the user the fluid dispenser 554 has been activated and fluid has been dispensed onto the surface to be cleaned.

Simultaneously, brush power switch 27 can activate brushroll 546 to agitate or rotate cleaning fluid into the surface to be cleaned. Such interaction removes the adhered dirt, dust, and debris, which then become suspended in the cleaning fluid. As brushroll 546 rotates, front interference squeegee 560 confronts brushroll 546 in a manner so as to ensure the brush is wetted evenly and cleaning fluid is spread uniformly across the entire length of the brushroll 546. Front interference squeegee 560 can also be configured to simultaneously scrape soiled fluid and debris off the brushroll 546 to be drawn into the suction nozzle assembly 580 and fluid recovery pathway. As the surface cleaning apparatus 10 moves over the surface to be cleaned, soiled cleaning fluid and dirt near the nozzle opening 594 is drawn into the suction nozzle assembly 580 and the fluid recovery pathway when suction motor/fan assembly 205 is activated. Additionally, cleaning fluid and dirt is scraped by the rear wiper squeegee 538 and drawn into the fluid recovery pathway.

Optionally, during operation of the brushroll 546, the suction motor/fan assembly 205 can be inoperative which facilitates a wet scrubbing mode so that the soiled cleaning solution is not removed as the cleaner 10 is moved back and forth across the surface to be cleaned.

During operation of the fluid recovery pathway, the fluid and debris-laden working air passes through the suction nozzle assembly 580 and into the downstream recovery tank 401 where the fluid debris is substantially separated from the working air. The airstream then passes through the suction motor/fan assembly 205 prior to being exhausted from the surface cleaning apparatus 10 through the clean air outlet defined by the vents 213, 214. The recovery tank 401 can be periodically emptied of collected fluid and debris by actuating the latch 430 and removing the dirty tank assembly 400 from the body assembly 200.

When operation has ceased, the surface cleaning apparatus 10 can be locked upright and placed into the storage tray 900 for storage or cleaning. If needed, the suction nozzle assembly 580 can be removed from the foot assembly 500. Brushroll 546 can then be removed from the foot assembly 500 and placed in brushroll holder 905.

The multi-surface wet surface cleaning apparatus 10 can optionally be provided with a self-cleaning mode. The self-cleaning mode can be used to clean the brushroll and internal components of the fluid recovery pathway of surface cleaning apparatus 10. In one aspect, the multi-surface wet surface cleaning apparatus 10 is prepared for cleaning by coupling the surface cleaning apparatus 10 to the power source 22, and by filling the storage tray 900 to a predesignated fill level with a cleaning fluid or water. The user selects the designated cleaning mode from the user interface assembly 120. In one example, locking mechanism 586 is released to pivot upright assembly 12 rearward and the hard floor cleaning mode is selected from the user interface assembly 120 by the user. Brushroll 546 is activated by brush motor 503 while suction motor/fan assembly 205 provides suction to the suction nozzle assembly 580 which draws fluid in storage tray 900 and into the fluid recovery pathway for a predetermined amount of time or until the fluid in storage tray 900 has been depleted. When self-cleaning mode has been completed, surface cleaning apparatus 10 can be returned to the upright and locked position in storage tray 900 and brushroll 546 can be removed and stored as previously described.

An aspect of the disclosure also includes a self-cleaning mode. More specifically, the surface cleaning apparatus 10 can be docked within storage tray 900. A user can fill the reservoir in the storage tray 900 with a cleaning fluid or water to a predetermined or predesignated fill level. It is contemplated that a provided cup can be used to provide the appropriate amount of fluid. Alternatively, a separate reservoir provided on the storage tray 900 or the surface cleaning apparatus 10 may contain the cleaning fluid or water, and when the surface cleaning apparatus 10 is docked within the storage tray 900, a valve can be actuated that allows the reservoir in the storage tray 900 to fill with fluid from the separate reservoir. A momentary switch 960 (FIG. 20) can be provided on the vacuum 10 for selectively actuating the brush motor 503 and the suction motor/fan assembly 205. Selectively actuating can include pressing and holding a "Clean-Out" button (not shown) while the machine is docked in the storage tray 900. When the button is pushed, the brushroll 546 is activated by brush motor 503 while the suction motor/fan assembly 205 provides suction to the suction nozzle assembly 580. This draws fluid from the storage tray 900 into the fluid recovery pathway until the button is released. In this manner, the brushroll 546 and the suction motor/fan assembly 205 are operated simultaneously to clean the brushroll 546 and the air path. The battery of the vacuum 10 can begin to charge after 1 minute of idle time.

In yet another example of a self-cleaning mode, a control panel 111 (FIG. 3) and a PCB 110, 217 (FIG. 4). can automatically energize the pump 226, brush motor 503 and suction motor/fan assembly 205 according to a predetermined cycle. For example, when the surface cleaning apparatus 10 is docked within storage tray 900, the storage tray 900 can send a signal to the surface cleaning apparatus 10 that docking is complete and a self-cleaning mode can be employed. A user can actuate the "Clean-Out" button (not shown), which can include a single press, and the surface cleaning apparatus 10 can automatically dispense a cleaning formula or water solution from the clean tank assembly 300 onto the rotating brushroll 546 and begin to fill the reservoir in the storage tray 900. The dispensing can take approximately 30 seconds. Next, the suction motor/fan assembly 205 can turn on to extract dirty water and debris from the reservoir and brushroll, which can take approximately 10-15 seconds. The surface cleaning apparatus 10 can shut off after a predetermined amount of time, which can be approximately 45 seconds total and begin to charge after 1 minute of idle time.

Figure 29:
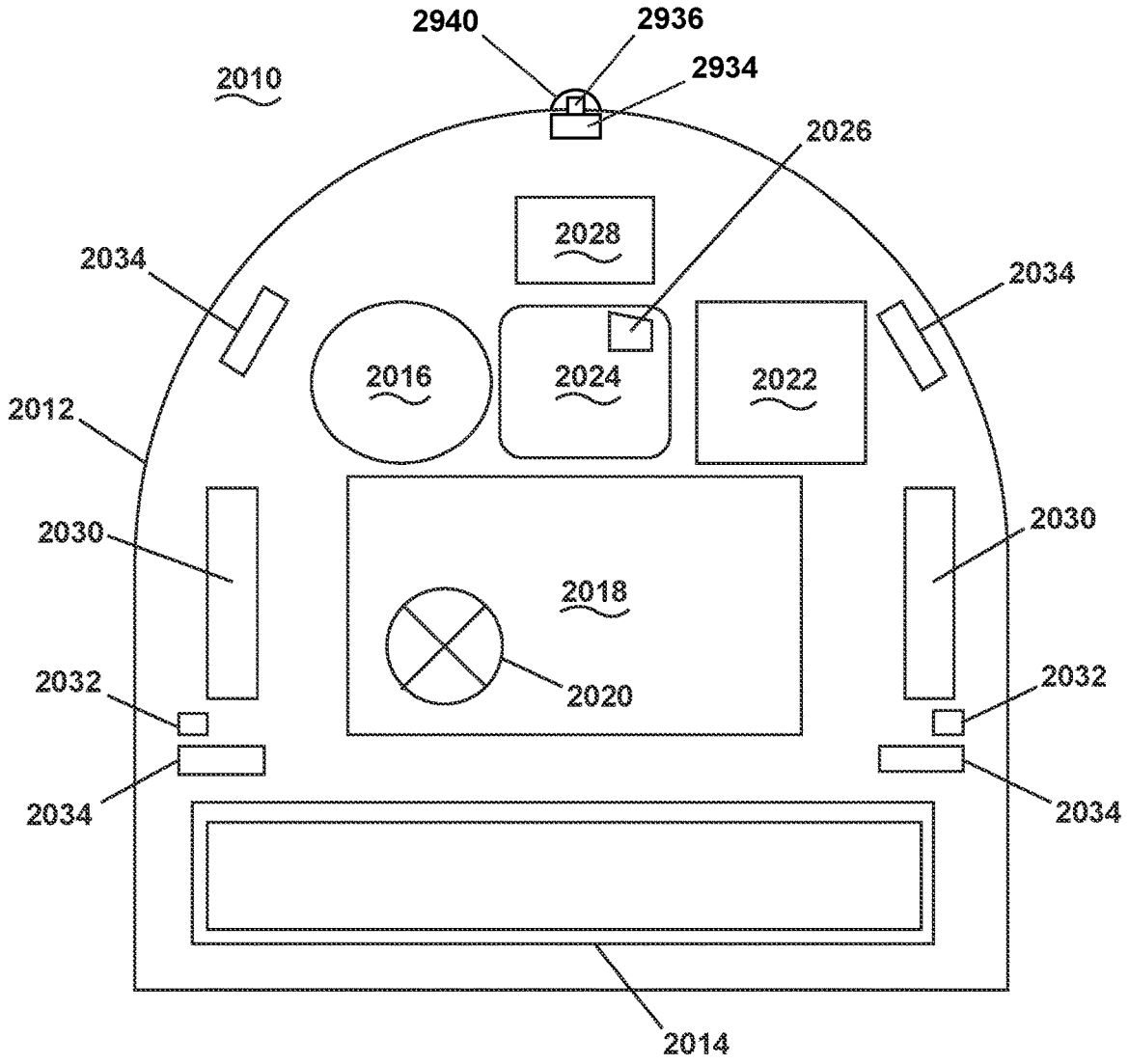
FIG. 29 is a schematic view of an autonomous vacuum cleaner according to various aspects described herein.

While shown and described as an upright vacuum cleaner, it is also possible for aspects to include a robot (autonomous) vacuum cleaner configured to dock within a storage tray. FIG. 29 is a schematic view of an autonomous vacuum cleaner 2010. The autonomous vacuum cleaner 2010 has been illustrated as a robotic vacuum cleaner that mounts the components various functional systems of the vacuum cleaner in an autonomously moveable unit or housing 2012, including components of a vacuum collection system for generating a working air flow for removing dirt (including dust, hair, and other debris) from the surface to be cleaned and storing the dirt in a collection space on the vacuum cleaner, and a drive system for autonomously moving the vacuum cleaner over the surface to be cleaned. While not illustrated, the autonomous floor cleaner 2010 could be provided with additional functional systems, such as a navigation system for guiding the movement of the vacuum cleaner over the surface to be cleaned, a mapping system for generating and storing maps of the surface to be cleaned and recording status or other environmental variable information, and/or a dispensing system for applying a treating agent stored on the vacuum cleaner to the surface to be cleaned. The autonomous or robotic vacuum cleaner can have similar properties to the autonomous or robotic vacuum cleaner described in U.S. Patent Application Publication No. 2018/0078106, published Mar. 22, 2018 and incorporated herein by reference The vacuum collection system can include a working air path through the unit having an air inlet and an air outlet, a suction nozzle 2014, a suction source 2016 in fluid communication with the suction nozzle 2014 for generating a working air stream, and a dirt bin 2018 for collecting dirt from the working airstream for later disposal. The suction nozzle 2014 can define the air inlet of the working air path. The suction source 2016 can be a motor/fan assembly carried by the unit 2012, fluidly upstream of the air outlet, and can define a portion of the working air path. The dirt bin 2018 can also define a portion of the working air path, and include a dirt bin inlet in fluid communication with the air inlet. A separator 2020 can be formed in a portion of the dirt bin 2018 for separating fluid and entrained dirt from the working airstream. Some non-limiting examples of the separator include a cyclone separator, a filter screen, a foam filter, a HEPA filter, a filter bag, or combinations thereof. The suction source 2016 can be electrically coupled to a power source, such as a rechargeable battery 2022. In one example, the rechargeable battery 2022 can be a lithium ion battery. A user interface 2024 having at least a suction power switch 2026 between the suction source 2016 and the rechargeable battery 2022 can be selectively closed by the user, thereby activating the suction source 2016.

Charging contacts (not shown) for the rechargeable battery 2022 can be provided on the main housing 2012. The charging contacts can be provided within a DC jack 2934. The DC jack 2934 can include a DC jack socket 2936 and a DC jack cover 2940 to shield the charging contacts in the DC jack 2934.

A controller 2028 is operably coupled with the various systems of the autonomous vacuum cleaner 2010 for controlling its operation. The controller 2028 is operably coupled with the user interface 2024 for receiving inputs from a user. The controller 2028 can further be operably coupled with various sensors 2032, 2034, 2056, 2108 for receiving input about the environment and can use the sensor input to control the operation of the autonomous vacuum cleaner 2010.

The controller 2028 can, for example, be operably coupled with the drive system for directing the autonomous movement of the vacuum cleaner over the surface to be cleaned. The drive system can include drive wheels 2030 for driving the unit across a surface to be cleaned. The sensors 2032, 2034 and drive system are described in more detail below.

Figure 30:
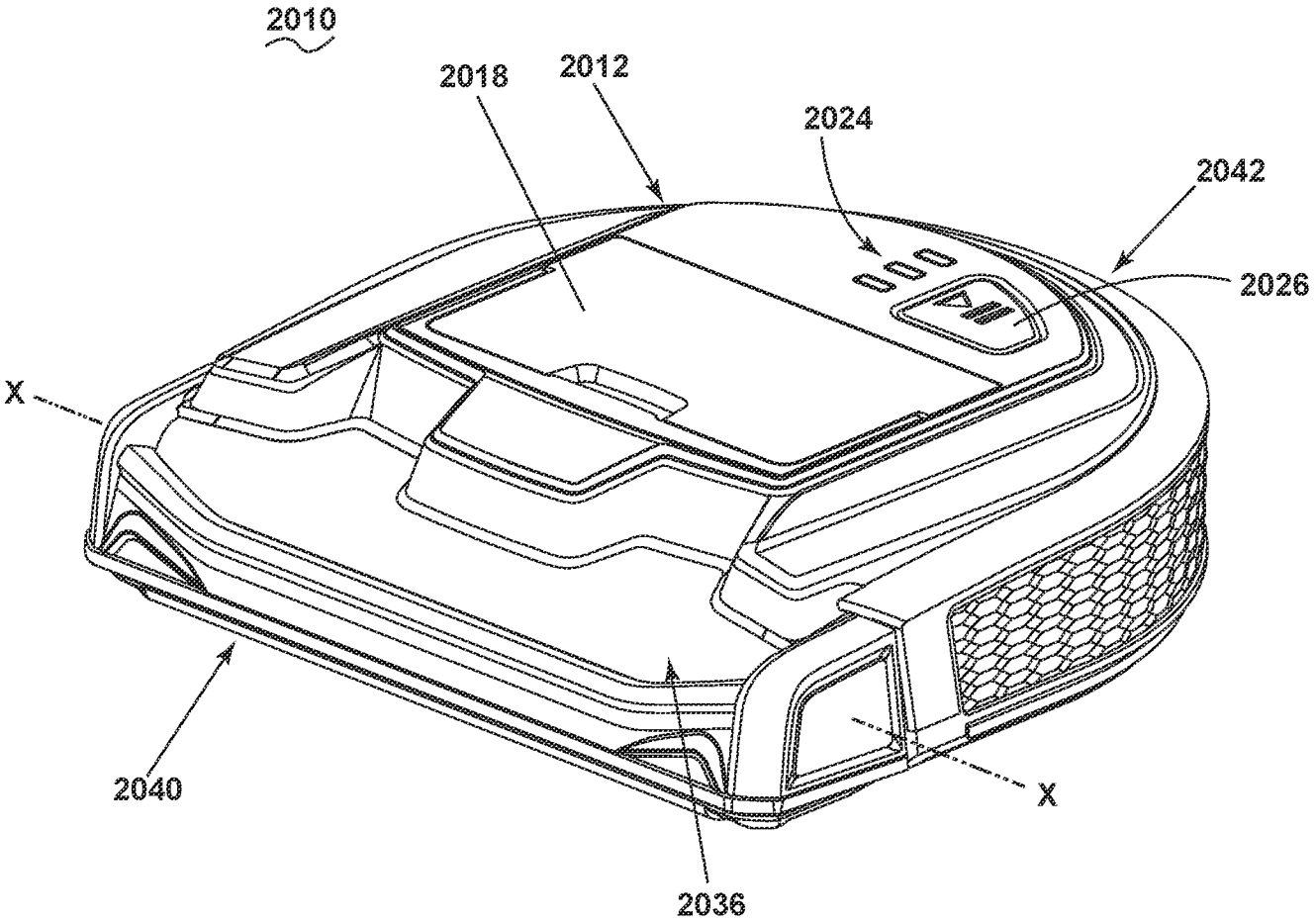
FIG. 30 is a perspective view of the autonomous vacuum cleaner of FIG. 29 according to various aspects described herein.
Figure 31:
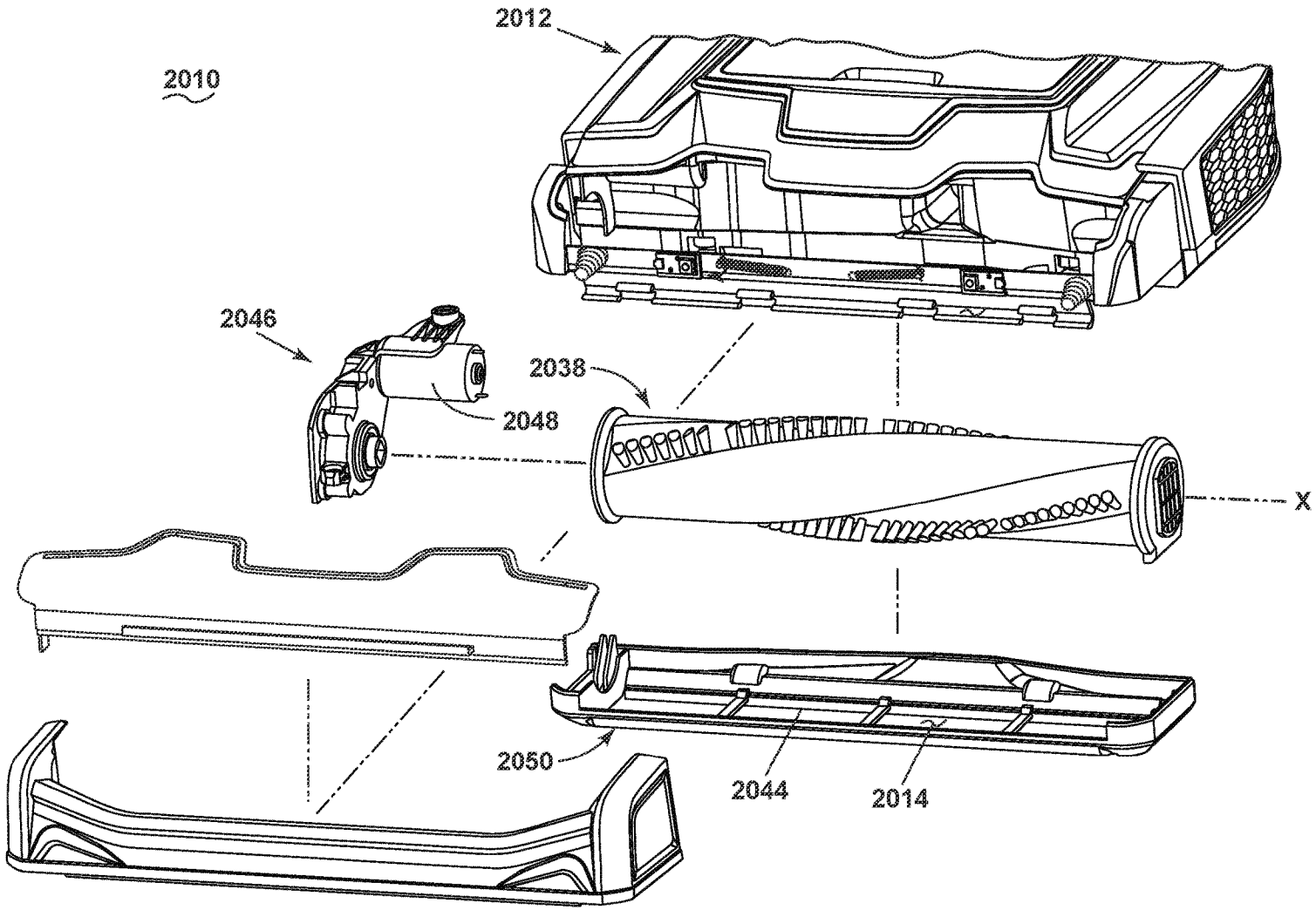
FIG. 31 is an exploded view of a portion of the autonomous vacuum cleaner of FIG. 30 according to various aspects described herein.

With reference to FIGS. 29-31, the autonomous vacuum cleaner 2010 can include a brush chamber 2036 at a front of the autonomous unit 2012 in which an agitator such as a brushroll 2038 is mounted. As used herein, "front" or "forward" and variations thereof are defined relative to the direction of forward travel of the autonomous vacuum cleaner 2010, unless otherwise specified. The brushroll 2038 is mounted for rotation about a substantially horizontal axis X, relative to the surface over which the unit 2012 moves. A sole plate 2050 can at least partially retain the brushroll 2038 in the brush chamber 2036, and has an inlet opening defining the suction nozzle 2014. A wiper blade 2044 can be provided adjacent a trailing edge of the suction nozzle 2014, behind the brushroll 2038 in order to aid in dust collection. The wiper blade 2044 is an elongated blade that generally spans the width of the suction nozzle 2014, and can be supported by the sole plate 2050.

The brushroll 2038 is mounted at the front of the vacuum cleaner 2010, whereas brushrolls on most autonomous vacuum cleaners are mounted near middle of housing and hidden under an opaque plastic housing. The housing 2012 of the illustrated surface cleaning apparatus 10 can be configured to accommodate the brushroll 2038 in the forward location, such as by having an overall "D-shape" when viewed from above, with the housing 2012 having a straight front edge 2040 and a rounded rear edge 2042.

An agitator drive assembly 2046 including a separate, dedicated agitator drive motor 2048 can be provided within the unit 2012 to drive the brushroll 2038 and can include a drive belt (not shown) that operably connects a motor shaft of the agitator drive motor 2048 with the brushroll 2038 for transmitting rotational motion of the motor shaft to the brushroll 2038. Alternatively, the brushroll 2038 can be driven by the suction source 2016.

Due to the D-shaped housing 2012 and position of the brushroll 2038 at the front of the housing 2012, the brushroll 2038 can be larger than brushrolls found on conventional autonomous vacuum cleaners. In one example, the brushroll 2038 can be a "full-size" brushroll that is typically found an upright vacuum cleaner. For example, a brushroll as described in U.S. Patent Application Publication No. 2016/016652, published Jun. 16, 2016, is suitable for use on the autonomous vacuum cleaner 2010 shown. The brushroll 2038 can also be removable from the unit 2012 for cleaning and/or replacement.

The brushroll 2038 can have a diameter that is approximately 8× larger and a length that is approximately 2× larger than for a brushroll found in conventional autonomous vacuum cleaners. The brushroll 2038 can have a diameter of 48 mm and a length of 260.5 mm.

Figure 32:
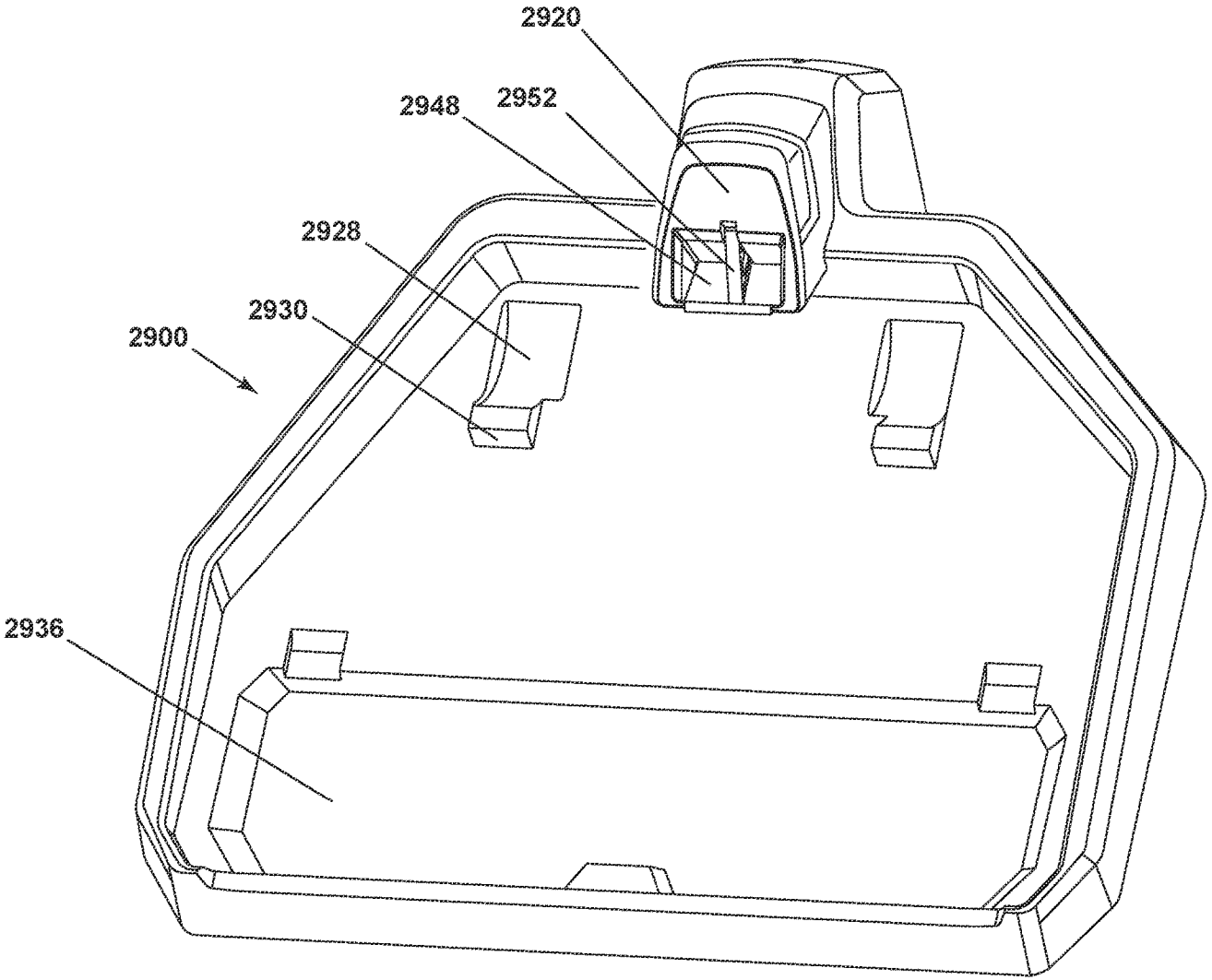
FIG. 32 is a perspective view of a storage tray for the surface cleaning apparatus of FIG. 29 according to various aspects described herein.

FIG. 32 illustrates a storage tray 2900 for receiving the autonomous vacuum cleaner 2010 for charging the autonomous vacuum cleaner 2010. The storage tray 2900 is similar to the storage tray 900; therefore, like parts will be identified with like numerals increased by 2000, with it being understood that the description of the like parts of the storage tray 900 applies to storage tray 2900, unless otherwise noted.

The storage tray 2900 differs from the storage tray 900 with respect to the charging unit 2920. The charging unit 2920 is located and configured to charge the autonomous vacuum cleaner 2010. The charging unit 2920 can be provided with charging contacts within the charger plug (not shown) that correspond, or mate with, the charging contacts on the rechargeable battery 2022 for the autonomous vacuum cleaner 2010 in the same manner than the charging unit 920 can charge the battery 22 on the surface cleaning apparatus 10. For example, the ramp 2952 on the plug cover 2948 on charging unit 2920 can be moved to expose the charger plug when the autonomous vacuum cleaner 2010 is docked in the storage tray 2900. At the same time, the DC jack cover 2940 on the rechargeable battery 2022 can be moved to expose the charging contacts on the DC jack 2934 such that the rechargeable battery 2022 and the storage tray 2900 can be electrically coupled. The brushroll 2038 can be received in the self-cleaning reservoir 2926 in order to be cleaned as previously described for the storage tray 900 and the surface cleaning apparatus 10.

Benefits of aspects described herein can include shielded contacts, i.e. mechanically-actuated retractable covers or shields that are configured to cover electrical contacts on the charging tray and the cleaning apparatus when the cleaning apparatus is not docked on the storage tray. In the illustrated examples, the DC jack cover and the tray cover are both spring-biased to normally block access to the electrical contacts when the vacuum cleaner, or unit, is not docked on the storage tray 900. The plug cover 948 and the DC jack cover 940 prevent liquid from contacting the charging contacts 942 on the surface cleaning apparatus 10 and the charger plug 946 on the storage tray 900. This also prevents user contact with the charging contacts.

Figure 33:
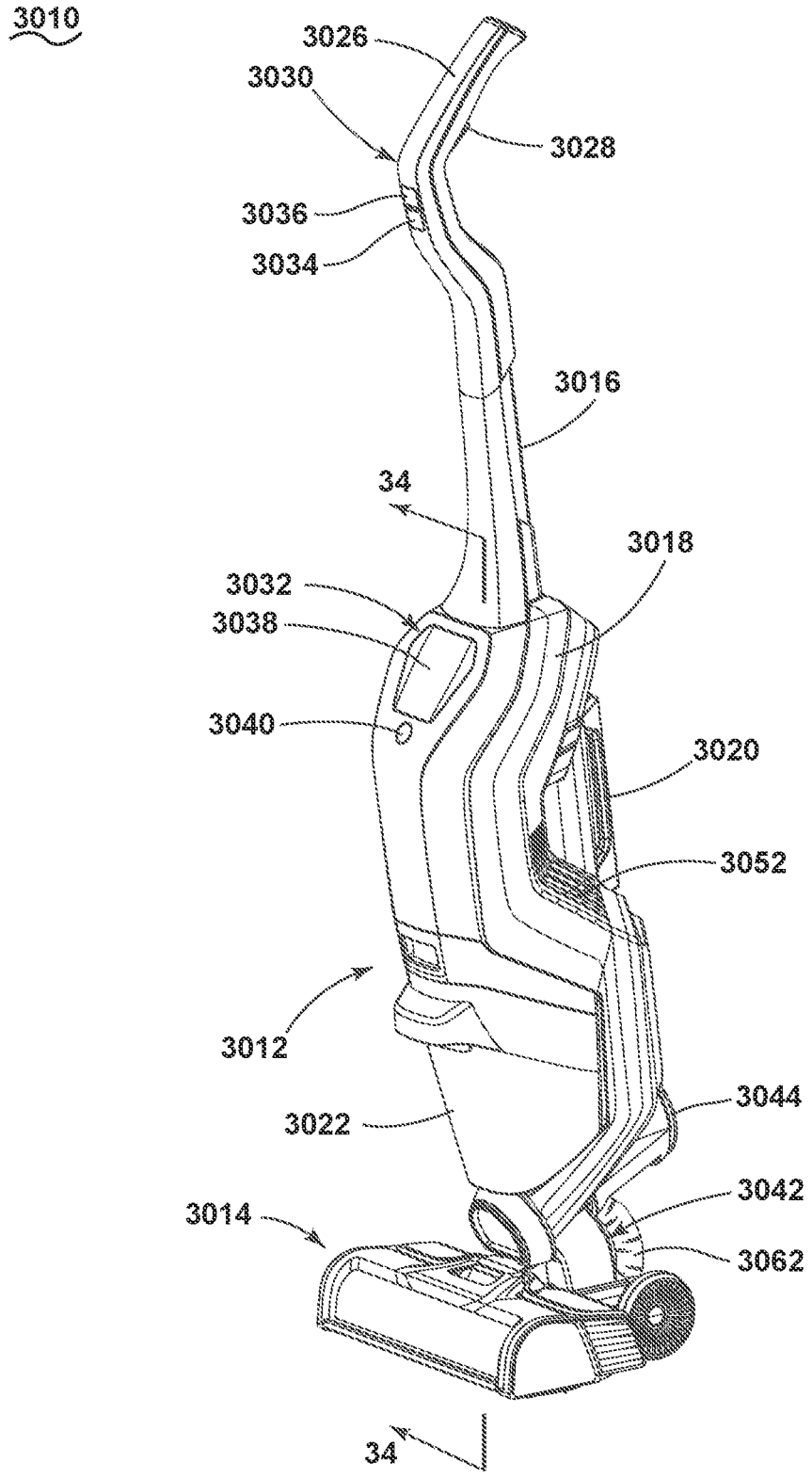
FIG. 33 is a perspective view of a surface cleaning apparatus according to another aspect of the disclosure.

FIG. 33 illustrates a cleaning apparatus 3010 according to another aspect of the present disclosure and which similar to the earlier described apparatus with it being understood that the description of the like parts applies unless otherwise noted.

As illustrated herein, the surface cleaning apparatus 3010 can be an upright multi-surface wet vacuum cleaner having a housing that includes an upright handle assembly or body 3012 and a cleaning head or base 3014 mounted to or coupled with the upright body 3012 and adapted for movement across a surface to be cleaned. The upright body 3012 can include a handle 3016 and a frame 3018. The frame 3018 can include a main support section supporting at least a supply tank 3020 and a recovery tank 3022, and may further support additional components of the body 3012. The surface cleaning apparatus 3010 can include a fluid delivery or supply pathway, including and at least partially defined by the supply tank 3020, for storing cleaning fluid and delivering the cleaning fluid to the surface to be cleaned and a recovery pathway, including and at least partially defined by the recovery tank 3022, for removing the spent cleaning fluid and debris from the surf ace to be cleaned and storing the spent cleaning fluid and debris until emptied by the user.

The handle 3016 can include a hand grip 3026 and a trigger 3028 mounted to the hand grip 3026, which controls fluid delivery from the supply tank 3020 via an electronic or mechanical coupling with the tank 3020. The trigger 3028 can project at least partially exteriorly of the hand grip 3026 for user access. A spring (not shown) can bias the trigger 3028 outwardly from the hand grip 3026. Other actuators, such as a thumb switch, can be provided instead of the trigger 3028.

The surface cleaning apparatus 3010 can include at least one user interface 3030, 3032 through which a user can interact with the surface cleaning apparatus 3010. The user interface 3030 can enable operation and control of the apparatus 3010 from the user's end, and can also provide feedback information from the apparatus 3010 to the user. The user interface 3030, 3032 can be electrically coupled with electrical components, including, but not limited to, circuitry electrically connected to various components of the fluid delivery and recovery systems of the surface cleaning apparatus 3010, as described in further detail below.

In the illustrated aspect, the surface cleaning apparatus 3010 includes a human-machine interface (HMI) 3030 having one or more input controls, such as but not limited to buttons, triggers, toggles, keys, switches, or the like, operably connected to systems in the apparatus 3010 to affect and control its operation. The surface cleaning apparatus IO also includes a status user interface (SUI) 3032 which communicates a condition or status of the apparatus 3010 to the user. The SUI 3032 can communicate visually and/or audibly, and can optionally include one or more input controls. The HMI 3030 and the SUI 3032 can be provided as separate interfaces or can be integrated with each other, such as in a composite use interface, graphical user interface, or multimedia user interface. As shown, the HMI 3030 can be provided at a front side of the hand grip 3026, with the trigger 3028 provided on a rear side of the hand grip 3026, opposite the HMI 3030, and the SUI 3032 can be provided on a front side of the frame 3018, below the handle 3016 and above the base 3014, and optionally above the recovery tank 3022. In other aspects, the HMI 3030 and SUI 3032 can be provided elsewhere on the surface cleaning apparatus 3010.

A moveable joint assembly 3042 can be formed at a lower end of the frame 3018 and moveably mounts the base 3014 to the upright body 3012. The joint assembly 3042 can alternatively include a universal joint, such that the upright body 3012 can pivot about at least two axes relative to the base 3014. Wiring and/or conduits can optionally supply electricity, air and/or liquid (or other fluids) between the base 3014 and the upright body 3012, or vice versa, and can extend though the joint assembly 3042. The supply and recovery tanks 3020, 3022 can be provided on the upright body 3012. The supply tank 3020 can be mounted to the frame 3018 in any configuration. In the present aspect, the supply tank 3020 can be removably mounted at the rear of the frame 3018 such that the supply tank 3020 partially rests in the upper rear portion of the frame 3018 and is removable from the frame 3018 for filling. The recovery tank 3022 can be mounted to the frame 3018 in any configuration. In the present aspect, the recovery tank 3022 can be removably mounted at the front of the frame 3018, below the supply tank 3020, and is removable from the frame 3018 for emptying.

The fluid delivery system is configured to deliver cleaning fluid from the supply tank 3020 to a surface to be cleaned, and can include, as briefly discussed above, a fluid delivery or supply pathway. The cleaning fluid can include one or more of any suitable cleaning fluids, including, but not limited to, water, compositions, concentrated detergent, diluted detergent, etc., and mixtures thereof. For example, the fluid can include a mixture of water and concentrated detergent.

Figure 34:
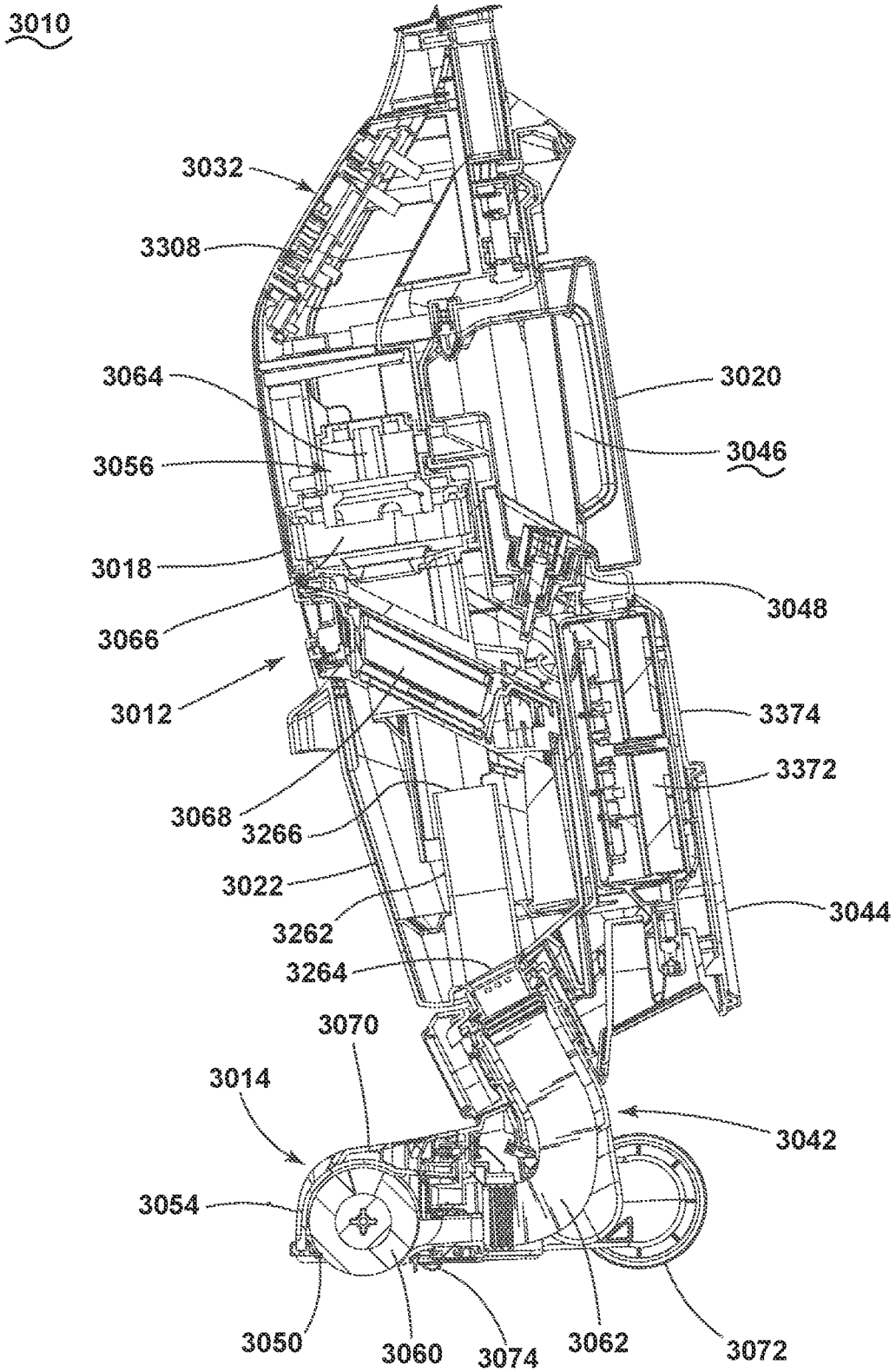
FIG. 34 is a cross-sectional view of the surface cleaning apparatus of FIG. 33 taken through line 34-34.

As better illustrated in FIG. 34, the supply tank 3020 includes at least one supply chamber 3046 for holding cleaning fluid and a supply valve assembly 3048 controlling fluid flow through an outlet of the supply chamber 3046. Alternatively, supply tank 3020 can include multiple supply chambers, such as one chamber containing water and another chamber containing a cleaning agent. For a removable supply tank 3020, the supply valve assembly 3048 can mate with a receiving assembly on the frame 3018 and can be configured to automatically open when the supply tank 3020 is seated on the frame 3018 to release fluid to the fluid delivery pathway.

The recovery system is configured to remove spent cleaning fluid and debris from the surface to be cleaned and store the spent cleaning fluid and debris on the surface cleaning apparatus 3010 for later disposal, and can include, as briefly discussed above, a recovery pathway. The recovery pathway can include at least a dirty inlet 3050 and a clean air outlet 3052 (FIG. 33). The pathway can be formed by, among other elements, a suction nozzle 3054 defining the dirty inlet, a suction source 3056 in fluid communication with the suction nozzle 3054 for generating a working air stream, the recovery tank 3022, and at least one exhaust vent defining the clean air outlet 3052.

The suction nozzle 3054 can be provided on the base 3014 and can be adapted to be adjacent the surface to be cleaned as the base 3014 moves across a surface. A brushroll 3060 can be provided adjacent to the suction nozzle 3054 for agitating the surface to be cleaned so that the debris is more easily ingested into the suction nozzle 3054. While a horizontally-rotating brushroll 3060 is shown herein, in some aspects, dual horizontally-rotating brushrolls, one or more vertically-rotating brushrolls, or a stationary brush can be provided on the apparatus 3010.

The suction nozzle 3054 is further in fluid communication with the recovery tank 3022 through a conduit 3062. The conduit 3062 can pass through the joint assembly 3042 and can be flexible to accommodate the movement of the joint assembly 3042.

The suction source 3056, which can be a motor/fan assembly including a vacuum motor 3064 and a fan 3066, is provided in fluid communication with the recovery tank 3022. The suction source 3056 can be positioned within a housing of the frame 3018, such as above the recovery tank 3022 and forwardly of the supply tank 3020. The recovery system can also be provided with one or more additional filters upstream or downstream of the suction source 3056. For example, in the illustrated aspect, a pre-motor filter 3068 is provided in the recovery pathway downstream of the recovery tank 3022 and upstream of the suction source 3056. A post-motor filter (not shown) can be provided in the recovery pathway downstream of the suction source 3056 and upstream of the clean air outlet 3052.

The base 3014 can include a base housing 3070 supporting at least some of the components of the fluid delivery system and fluid recovery system, and a pair of wheels 3072 for moving the apparatus 3010 over the surface to be cleaned. The wheels 3072 can be provided on a rearward portion of the base housing 3070, rearward of components such as the brushroll 3060 and suction nozzle 3054. A second pair of wheels 3074 can be provided on the base housing 3070, forward of the first pair of wheels 3072.

Electrical components of the surface cleaning apparatus 3010, including the vacuum motor 3064, the pump 3094, and the brush motor 3096 for the brushroll 3060, can be electrically coupled to a power source such as a battery 3372 or a power cord plugged into a household outlet. In the illustrated aspect, the power source includes a rechargeable battery 3372.

In one example, the battery 3372 can be a lithium ion battery. In another exemplary arrangement, the battery 3372 can include a user replaceable battery. As discussed above, the power input control 3034 which controls the supply of power to one or more electrical components of the apparatus 3010, and in the illustrated aspect controls the supply of power to at least the SUI 3032, the vacuum motor 3064, the pump 3094, and the brush motor 3096. The cleaning mode input control 3036 cycles the apparatus 3010 between a hard floor cleaning mode and a carpet cleaning mode. In one example of the hard floor cleaning mode, the vacuum motor 3064, the pump 3094, and the brush motor 3096 are activated, with the pump 3094 operating at a first flow rate. In the carpet cleaning mode, the vacuum motor 3064, the pump 3094, and the brush motor 3096 are activated, with the pump 3094 operating at a second flow rate which is greater than the first flow rate. The self-cleaning mode input control 3040 initiates a self-cleaning mode of operation, one aspect of which is described in detail below. Briefly, during the self-cleaning mode a cleanout cycle can run in which cleaning liquid is sprayed on the brushroll 3060 while the brushroll 3060 rotates. Liquid is extracted and deposited into the recovery tank 3022, thereby also flushing out a portion of the recovery pathway.

With reference to FIG. 34, the controller 3308 can be provided at various locations on the apparatus 3010, and in the illustrated aspect is located in the upright body 3012, within the frame 3018, and is integrated with the SUI 3032. Alternatively, the controller 3308 can be integrated with the HMI 3030 (FIG. 33), or can be separate from both the HMI 3030 and SUI 3032.

The battery 3372 can be located within a battery housing 3374 located on the upright body 3012 or base 3014 of the apparatus, which can protect and retain the battery 3372 on the apparatus 3010. In the illustrated aspect, the battery housing 3374 is provided on the frame 3018 of the upright body 3012. Optionally, the battery housing 3374 can be located below the supply tank 3020 and/or rearwardly of the recovery tank 3022.

Figure 35:
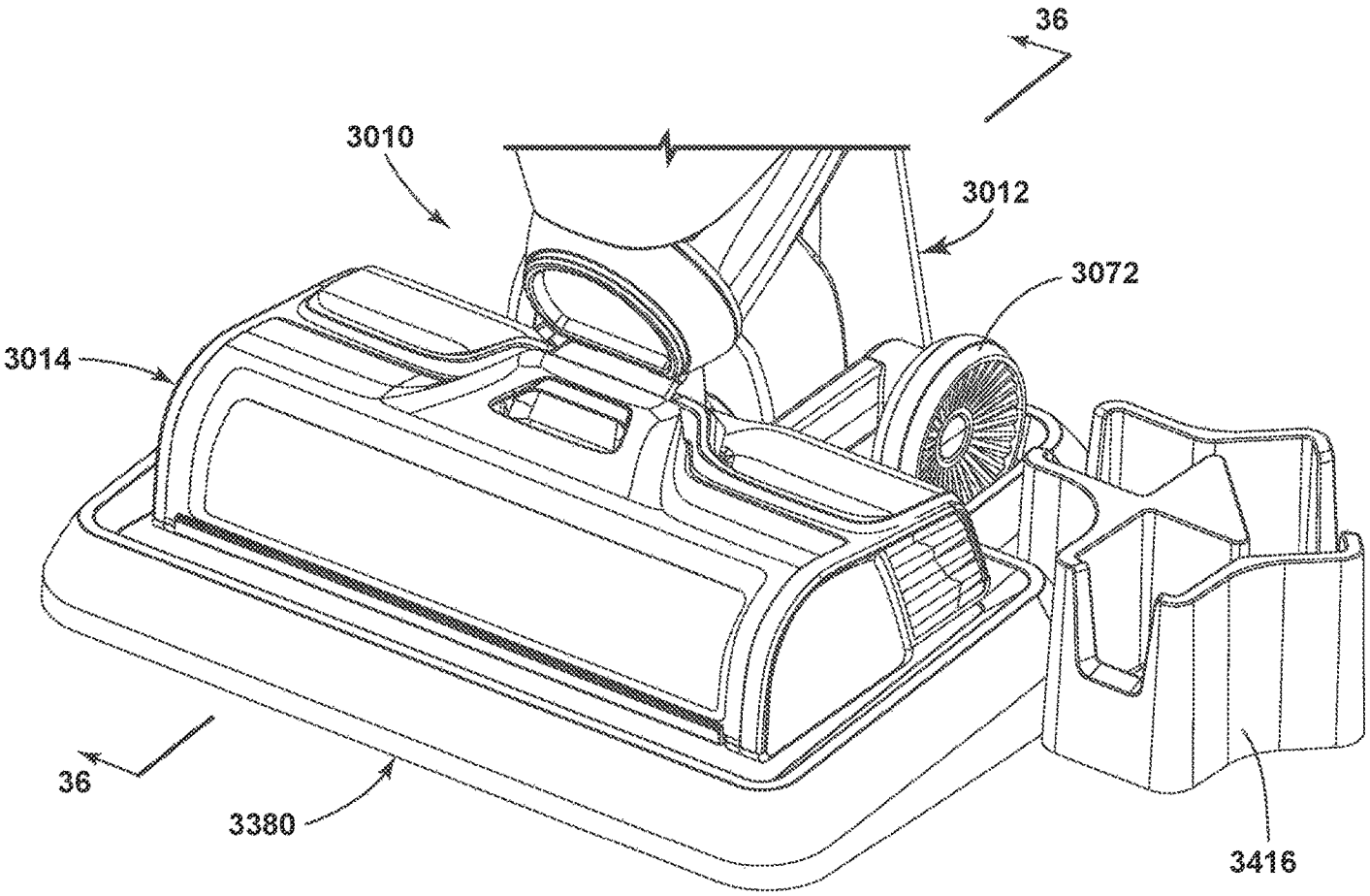
FIG. 35 is an enlarged perspective view of the surface cleaning apparatus of FIG. 33 docked with a storage tray.

Referring to FIG. 35, the surface cleaning apparatus 3010 can optionally be provided with a storage tray 3380 that can be used when storing the apparatus 3010. The storage tray 3380 can be configured to receive the base 3014 of the apparatus 3010 in an upright, stored position. The storage tray 3380 can further be configured for further functionality beyond simple storage, such as for charging the apparatus 3010 and/or for self-cleaning of the apparatus 3010.

Figure 36:
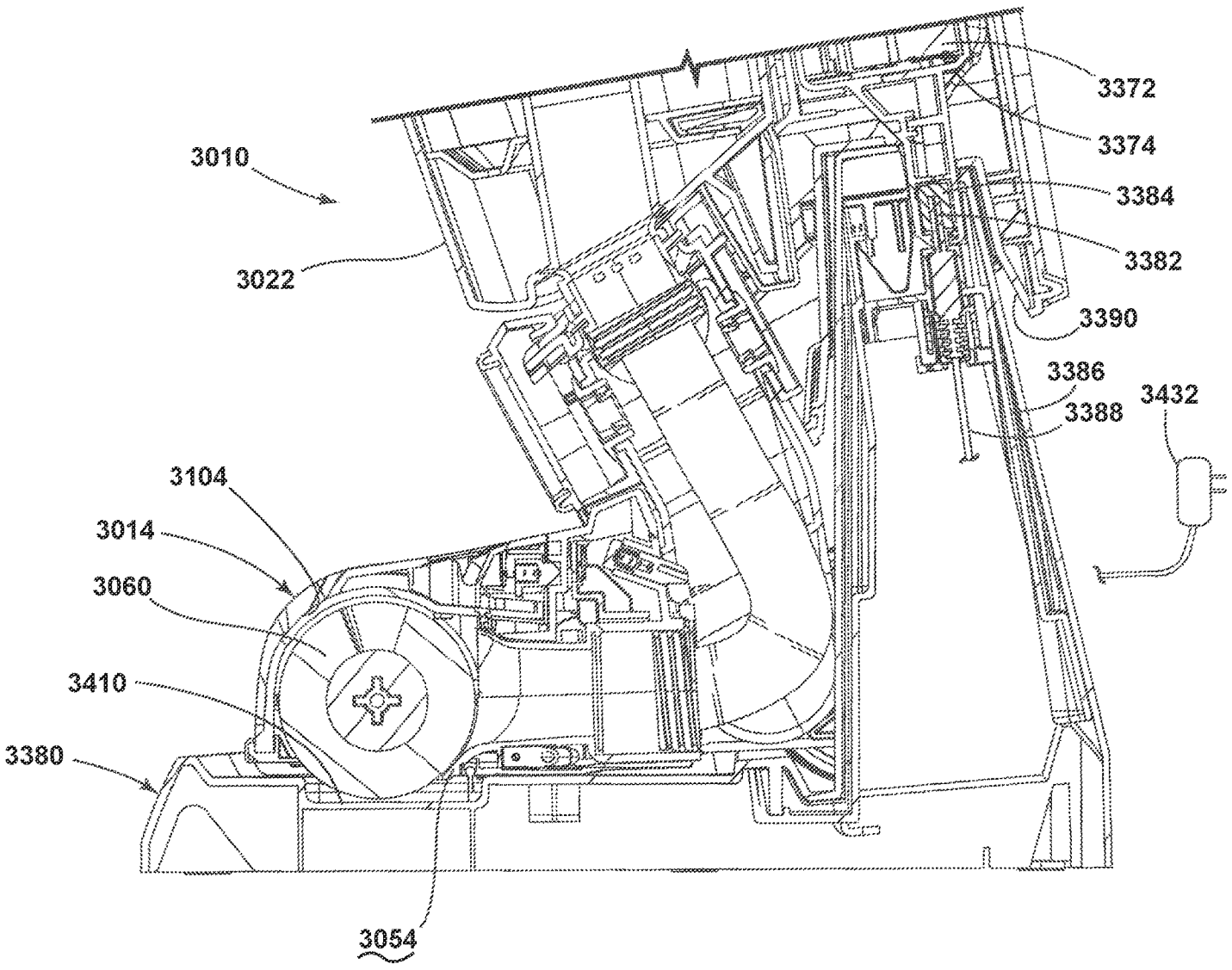
FIG. 36 is an enlarged cross-sectional view of a lower portion of the surface cleaning apparatus docked with the storage tray, taken through line 36-36 of FIG. 19.

Referring to FIG. 36, the storage tray 3380 functions as a docking station for recharging the battery 3372 of the apparatus 3010. The storage tray 3380 can optionally have at least one charging contact 3382, and at least one corresponding charging contact 3384 can be provided on the apparatus 3010, such as on the exterior of the battery housing 3374. When operation has ceased, the apparatus 3010 can be locked upright and placed into the storage tray 3380 for recharging the battery 3372. When the apparatus 3010 is removed from the storage tray 3380, one or both of the charging contacts 3382, 3384 can be shielded, as described in further detail below.

A charging unit 3386 is provided on the storage tray 3380 and includes the charging contacts 3382. The charging unit 3386 can electrically couple with the battery 3372 when the base 3014 of the apparatus 3010 is docked with the storage tray 3380. The charging unit 3386 can be electrically coupled to a power source including, but not limited to, a household outlet. In one example, a cord 388 can be coupled with the charging unit 3386 to connect the storage tray 3380 to the power source. The battery housing 3374 and the charging unit 3386 of the storage tray 3380 can possess complementary shapes, with the battery housing 3374 fitting against the charging unit 3386 to help support the apparatus 3010 on the storage tray 3380. In the illustrated aspect, the battery housing 3374 can include a socket 3390 containing the charging contacts 3384 and the charging unit 3386 can be at least partially received by the socket 3390 when the apparatus 3010 is docked with the tray 3380.

Figure 37:
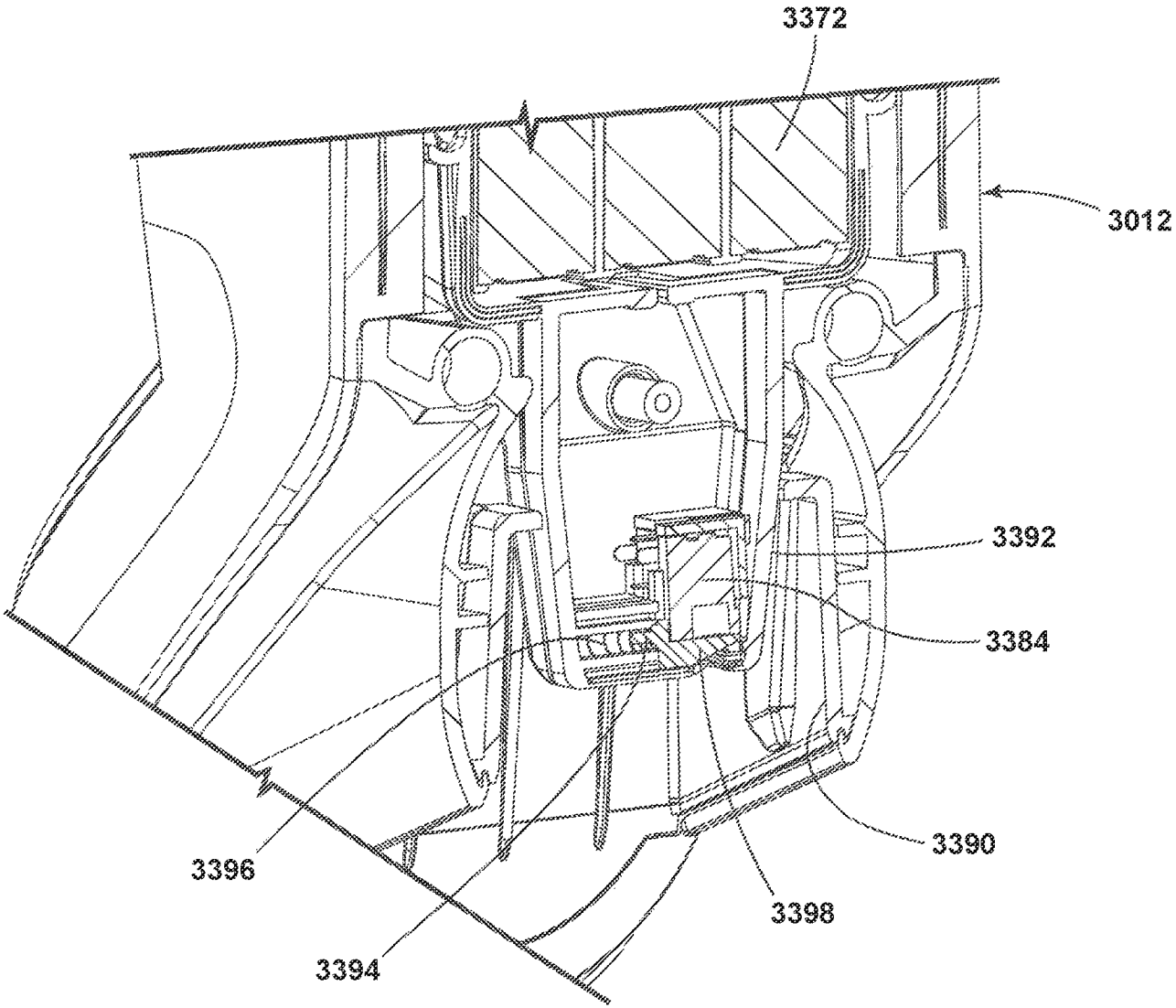
FIG. 37 is an enlarged cross-sectional view of a lower portion of the surface cleaning apparatus.

FIG. 37 is a rear perspective view of a lower portion of the upright body 3012 showing a cross-section through the charging contact 3384 of the battery 3372. A contact casing 3392 can extend downwardly within the socket 3390, and includes the charging contact 3384, which is illustrated as DC connector or socket. The charging contact 3384 or socket can be normally covered, or closed, by a retractable charging contact cover 3394, also referred to herein as battery-side cover.

The battery-side cover 3394 can be slidably mounted to or within the casing 3392 and can be biased to the normally covered position by a spring 3396. When the battery-side cover 3394 is in the closed position, the battery-side cover 3394 shields the charging contact 3384 such that liquid cannot enter the charging contact 3384 or casing 3392.

The battery-side cover 3394 can include a ramp 3398 against which a portion of the storage tray 3380 presses to move the cover 3394 to uncover the charging contact 3384 against the biasing force of the spring 3396. It is noted that while a ramp 3398 is shown, the apparatus 3010 can include any suitable mating feature configurable to move the cover 3394 upon docking, such as a cam or a rack and pinion gear, for example. Alternatively, a linear actuator can be incorporated to move the cover 3394 to the open position upon docking.

Figure 38:
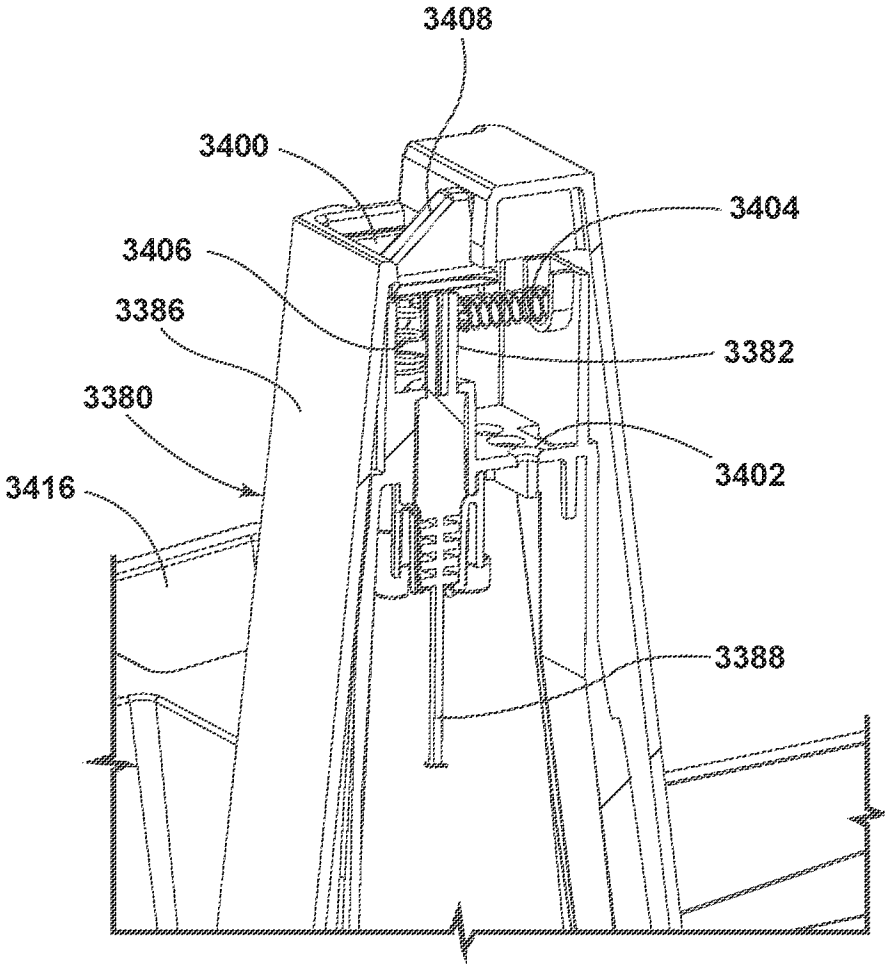
FIG. 38 is an enlarged cross-sectional view of a portion of the storage tray showing a shielded electrical contact of the tray.

Referring to FIG. 38, the charging contact 3382 of the charging unit 3386, which is illustrated as DC connector or plug, can be normally covered, or closed, by a retractable charging contact cover 3400, also referred to herein as tray-side cover. A bracket 3402 can be provided in the charging unit to mount the charging contact or plug 3382 and the cover 3400. The tray-side cover can be biased to the normally covered position by springs 3404, 3406, which bias the cover 3400 rearwardly and upwardly. When the tray-side cover 3400 is in the closed position, the tray-side cover 3400 shields the charging contact 3382 such that liquid cannot enter the charging contact 3382 or charging unit 3386.

The tray-side cover 3400 can include a ramp 3408 against which a portion of the apparatus 3010 presses to move the cover 3400 to uncover the charging contact 3382 against the biasing force of the springs 3404, 3406. It is noted that while a ramp 3408 is shown, the apparatus 3010 can include any suitable mating feature configurable to move the cover 3400 upon docking, such as a cam or a rack and pinion gear, for example. Alternatively, a linear actuator can be incorporated to move the cover 3400 to the open position upon docking.

Figure 39:
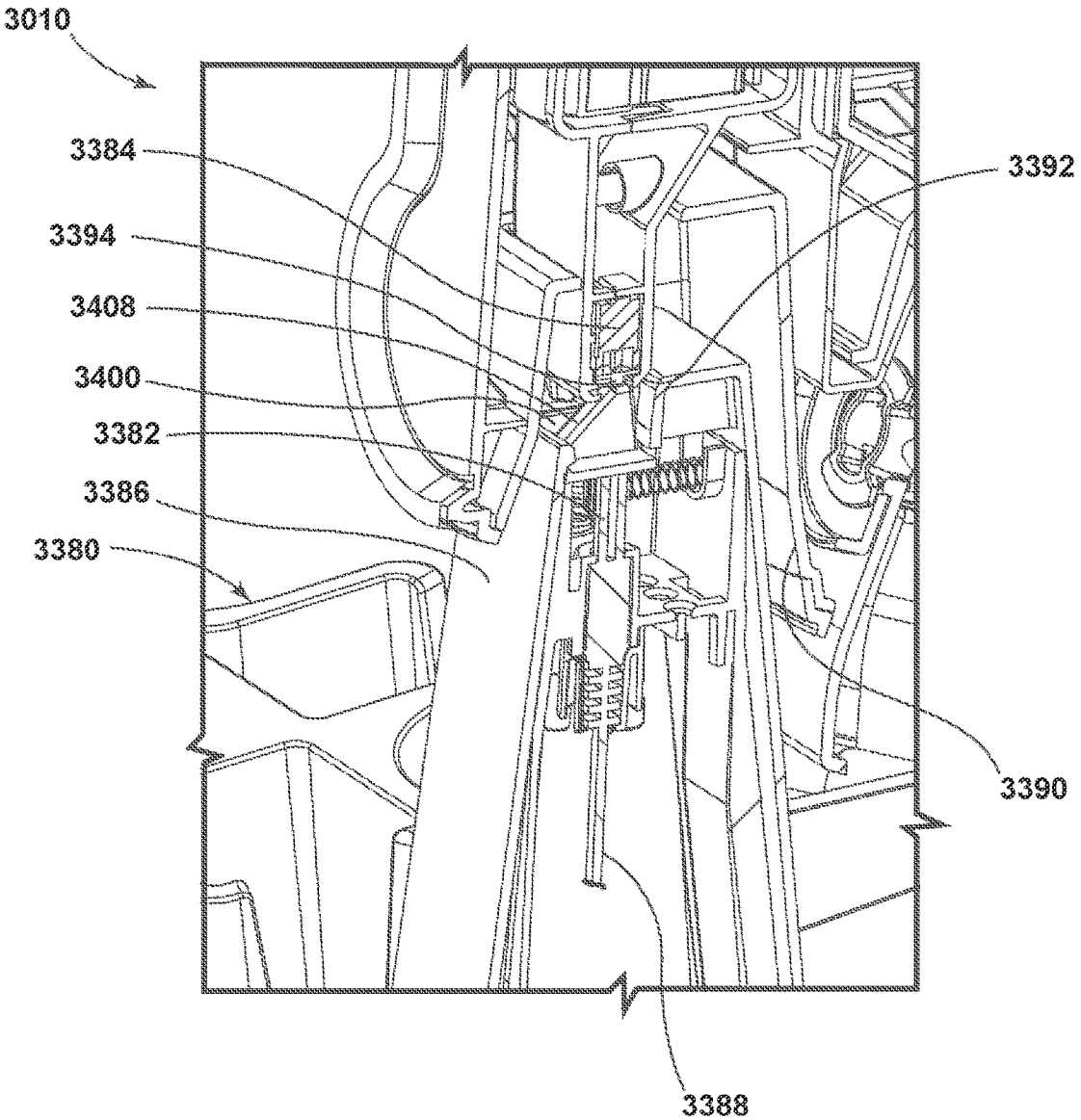
FIGS. 39-41 illustrate a docking operation of the surface cleaning apparatus with the storage tray.
Figure 40:
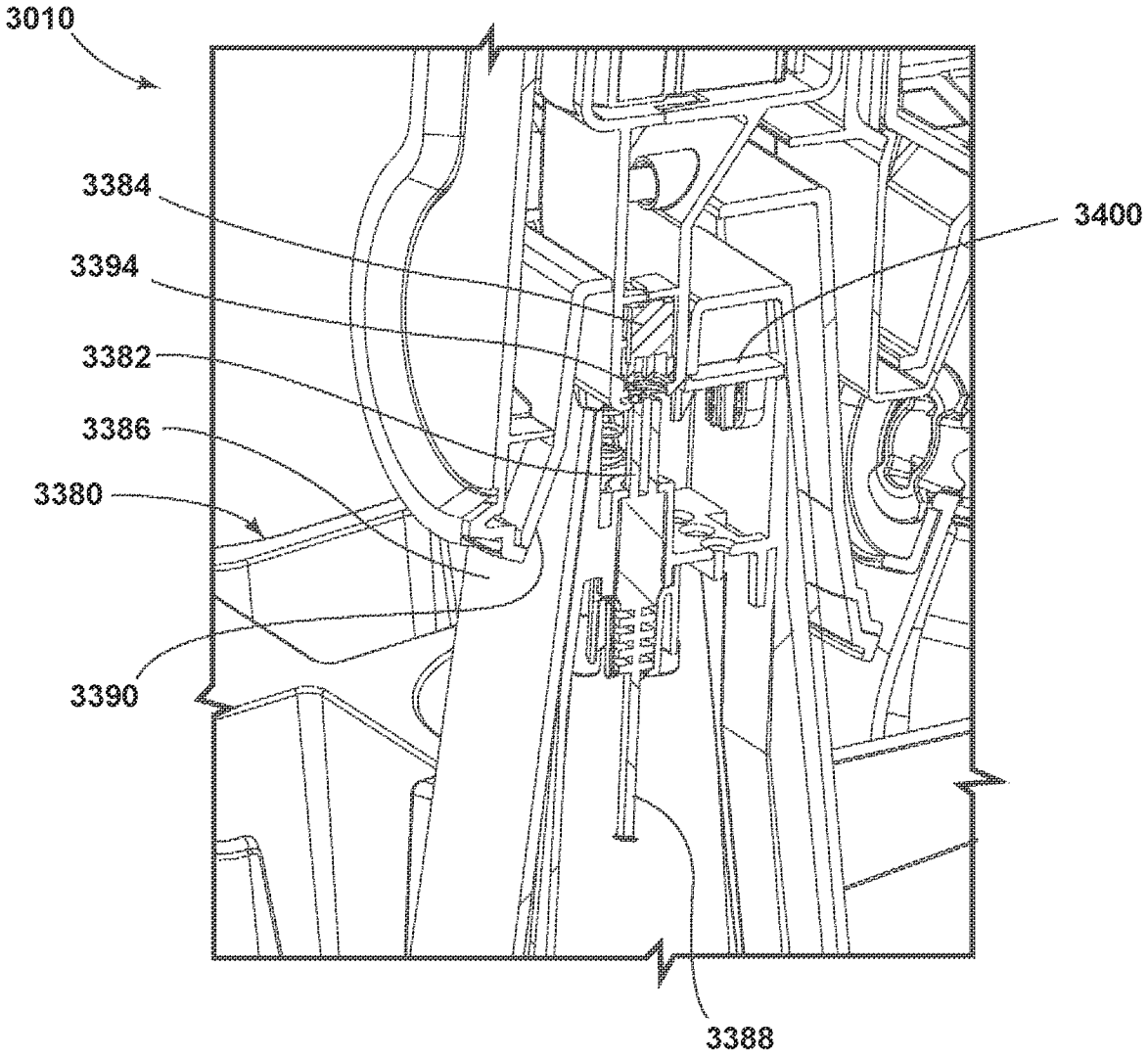
Figure 41:
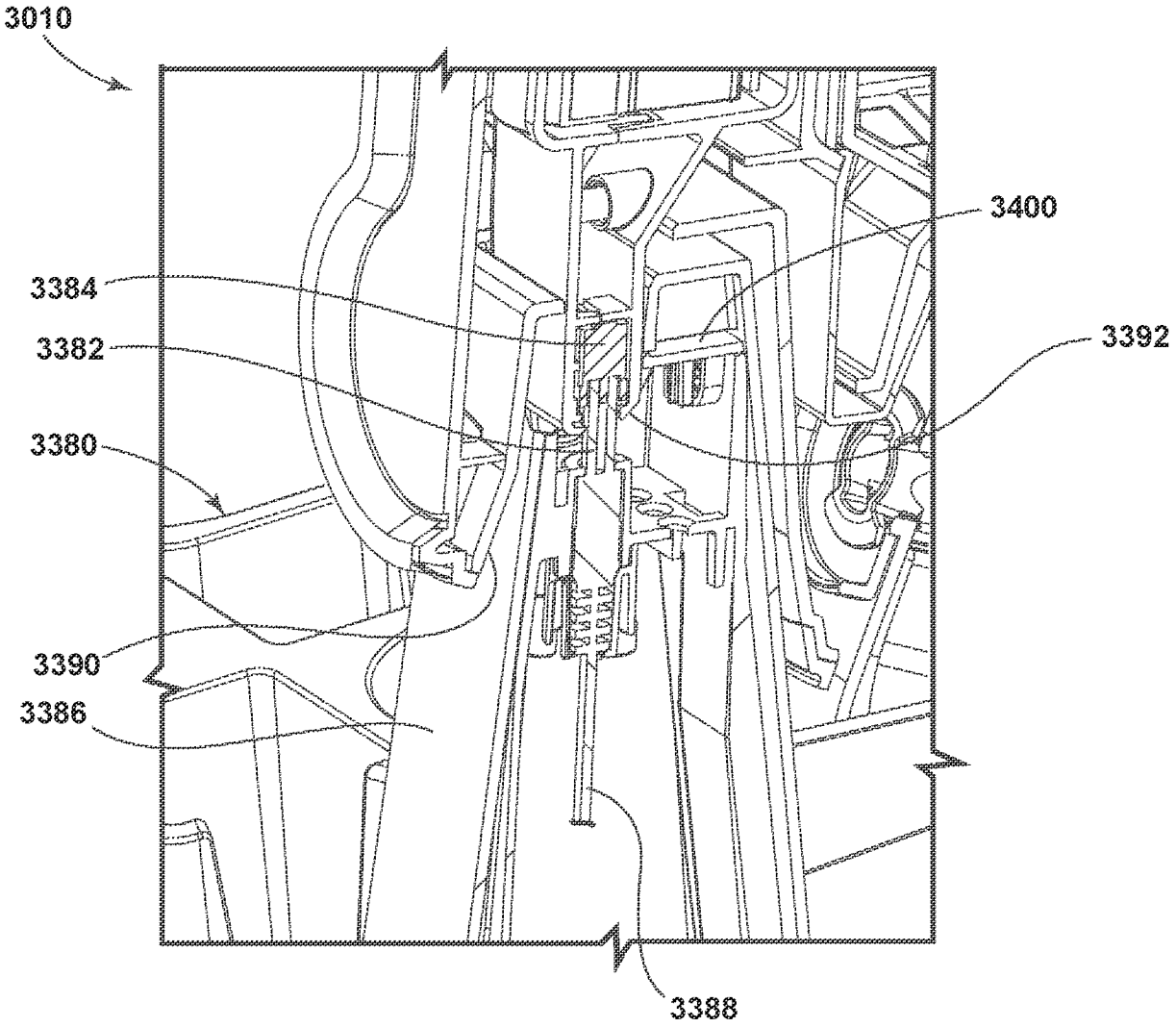

Docking the apparatus 3010 with the storage tray 3380 can automatically move the covers 3394, 3400 to an uncovered or open position, an example of which is shown in FIGS. 39-41, in which the charging contacts 3382, 3384 can be coupled, i.e. by the socket 3384 receiving the plug 382. In one aspect, in order to dock the apparatus 3010 within the storage tray 3380 for charging, the apparatus 3010 is lowered into the storage tray 3380 as shown in FIG. 39 and the casing 3392 pushes against the ramp 3408 on the tray-side cover 3400, sliding the cover 3400 forwardly to expose the charging contact or plug 3382. As the apparatus 3010 continues to be lowered onto the storage tray 3380, the exposed plug 3382 presses against the ramp 3398 on the battery-side cover 3394, as shown in FIG. 40, sliding the cover 3394 laterally to expose the charging contact or socket 3384. Continued lowering of the apparatus 3010 plugs the plug 3382 into the socket 3384, as shown in FIG. 41. The charging plug 3382 on the storage tray 3380 and socket 3384 on the apparatus 3010 become fully engaged, or electrically connected, when the apparatus 3010 is fully seated on the storage tray 3380.

Referring back to FIGS. 35-37, during use, the apparatus 3010 can get very dirty, particularly in the brush chamber and extraction pathway, and can be difficult for the user to clean. The storage tray 3380 can function as a cleaning tray during a self-cleaning mode of the apparatus 3010, which can be used to clean the brushroll 3060 and internal components of the fluid recovery pathway of apparatus 3010. Self-cleaning using the storage tray 3380 can save the user considerable time and may lead to more frequent use of the apparatus 3010. The storage tray 3380 can optionally be adapted to contain a liquid for the purposes of cleaning the interior parts of apparatus 3010 and/or receiving liquid that may leak from the supply tank 3020 while the apparatus 10 is not in active operation. When operation has ceased, the apparatus 3010 can be locked upright and placed into the storage tray 3380 for cleaning. The apparatus 3010 is prepared for self-cleaning by filling the storage tray 3380 to a predesignated fill level with a cleaning liquid, such as water. The user can select the self-cleaning mode via the input control 3040 (FIG. 33).

In one example, during the self-cleaning mode, the vacuum motor 3064 and brush motor 3096 are activated, which draws cleaning liquid in the storage tray 3380 into the fluid recovery pathway. The self-cleaning mode can be configured to last for a predetermined amount of time or until the cleaning liquid in storage tray 3380 has been depleted. Example of self-cleaning cycles and storage trays are disclosed in U.S. patent application Ser. No. 15/994,040, filed May 31, 2018, which is incorporated herein by reference in its entirety.

The tray 3380 can physically support the entire apparatus 3010. More specifically, the base 3014 can be seated in the tray 3380. The tray 3380 can have a recessed portion in the form of a sump 3410 in register with at least one of the suction nozzle 3054 or brushroll 3060. Optionally, the sump 3410 can sealingly receive the suction nozzle 3054 and brushroll 3060, such as by sealingly receiving the brush chamber 3104. The sump 3410 can fluidly isolate, or seal, the suction nozzle 3054 and fluid distributor (not shown) within the brush chamber 3104 to create a closed loop between the fluid delivery and fluid extraction systems of the apparatus 3010. The sump 3410 can collect excess liquid for eventual extraction by the suction nozzle 3054. This also serves to flush out a recovery pathway between the suction nozzle 3054 and the recovery tank 3022.

Figure 42:
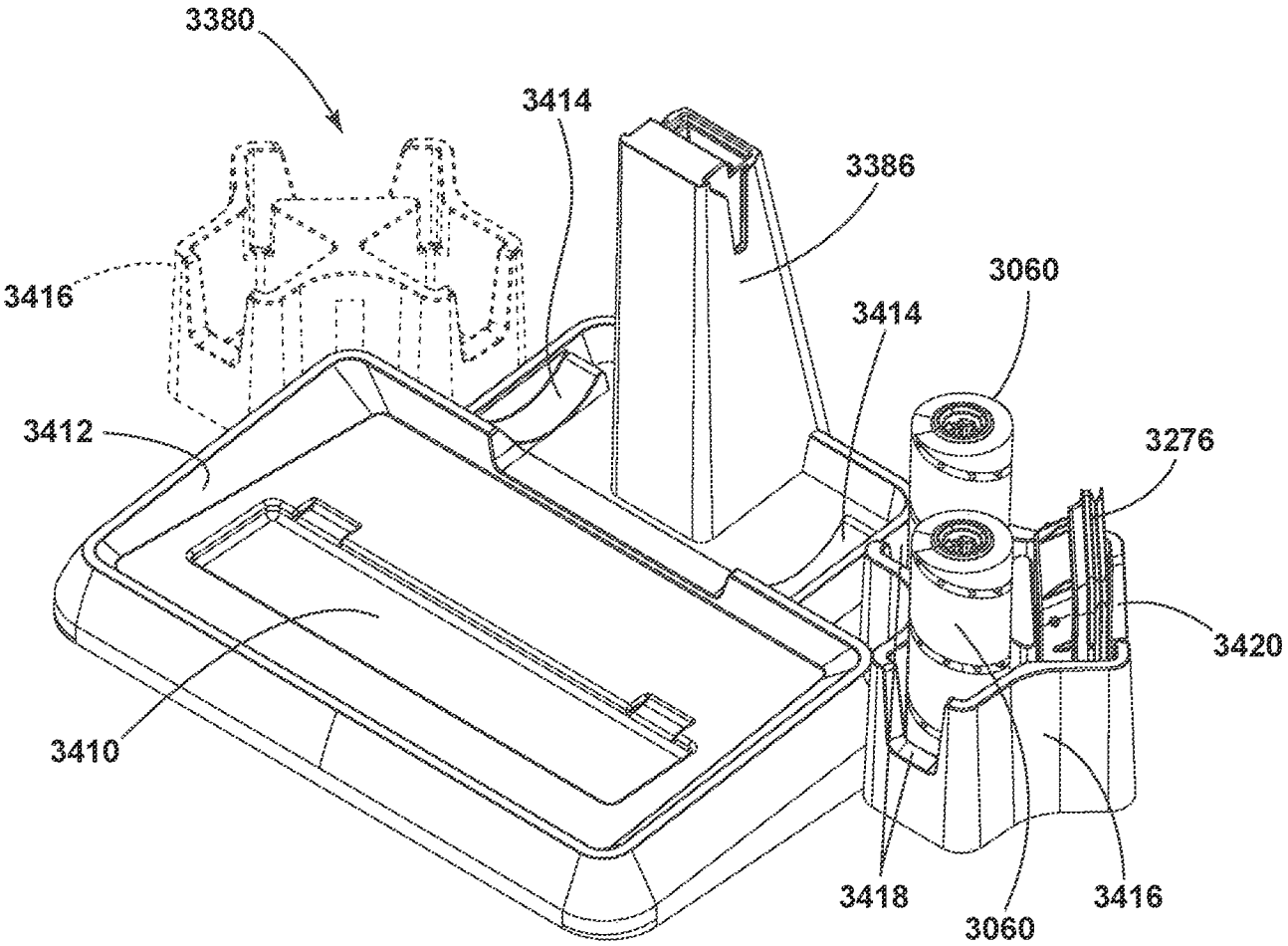
FIG. 42 is a perspective view of the storage tray from FIG. 35.

FIG. 42 is a perspective view of the storage tray 3380. The tray 3380 can include guide walls 3412 extending upwardly and configured to align the base 3014 (FIG. 36) within the tray 3380. A rear portion of the tray 3380 can include wheel holders 3414 for receiving the rear wheels 3072 of the apparatus 3010. The wheel holders 3414 can be formed as a recess, or groove in the storage tray 3380, and can be provided on opposite lateral sides of the charging unit 3386.

Optionally the storage tray 3380 can include a removable accessory holder 3416 for storing one or more accessories for the apparatus 3010. The accessory holder 3416 can be provided on an exterior side wall of the tray 3380, and can be removably mounted to the tray 3380. The tray 380 can optionally be provided with a mounting location on either lateral side of the tray 3380 to allow the user some flexibility in where the accessory holder 3416 is attached. FIG. 42 includes an accessory holder 3416 in phantom line showing one optional alternative mounting location. The mounting locations can include a retention latch, sliding lock, clamp, brace, or any other mechanism in which to secure accessory holder 3416 on the storage tray 3380 Alternatively, storage tray 3380 can be configured with a non-removable or integral accessory holder 3416.

The illustrated accessory holder 3416 can removably receive one or more brushrolls 3060 and/or one of more filters 3276 for the purposes of storage and/or drying. Accessory holder 3416 can include one or more brushroll slots 3418 to securely receive brushrolls 3060 in a vertical fixed position for drying and storage. Brushroll slots 3418 can be fixed or adjustable and include clamps, rods, or molded receiving positions that can accommodate brushroll 3060 with or without the dowel 3110 inserted. Accessory holder 3416 can include at least one filter slot 3420 to securely receive filter 3276 in a vertical fixed position for drying and storage. Alternatively, accessory holder 3416 can store the brushrolls 3060 and filter 3276 in a variety of other positions.

Figure 43:
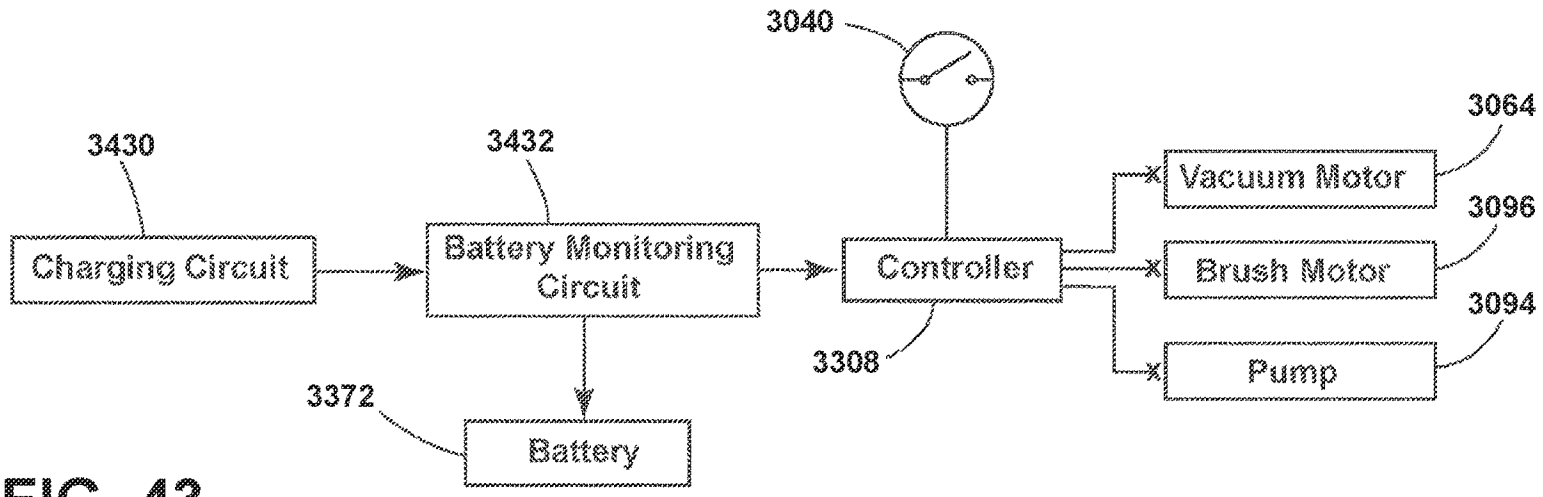
FIG. 43 is a block diagram for the surface cleaning apparatus, showing a condition when the surface cleaning apparatus is docked with the storage tray for recharging.

FIG. 43 is a block diagram for the apparatus 3010, showing a condition when the apparatus 3010 is docked with the storage tray 3380 for recharging. The apparatus 3010 includes a battery charging circuit 3430 that controls recharging of the battery 3372. When the apparatus 3010 is docked with the storage tray 3380 the battery charging circuit 3430 is active and the battery 3372 is charged. In at least some aspects of the storage tray 3380, the tray 3380 includes power cord 388 plugged into a household outlet, such as by a wall charger 3432 having, for example an operating power of 35 W. However, during a self-cleaning cycle during which the vacuum motor 3064, pump 3094, and brush motor 3096 are all energized, the required power draw can far exceed the operating power of the wall charger. In one example, the required power draw for the vacuum motor 3064, pump 3094, and brush motor 3096 can be 200-250 W. The apparatus 3010 can include a battery monitoring circuit 3432 for monitoring the status of the battery 3372 and individual battery cells contained therein. Feedback from the battery monitoring circuit 3432 is used by the controller 3308 to optimize the discharging and recharging process, as well as for displaying battery charge status on the SUI 3032.

Figure 44:
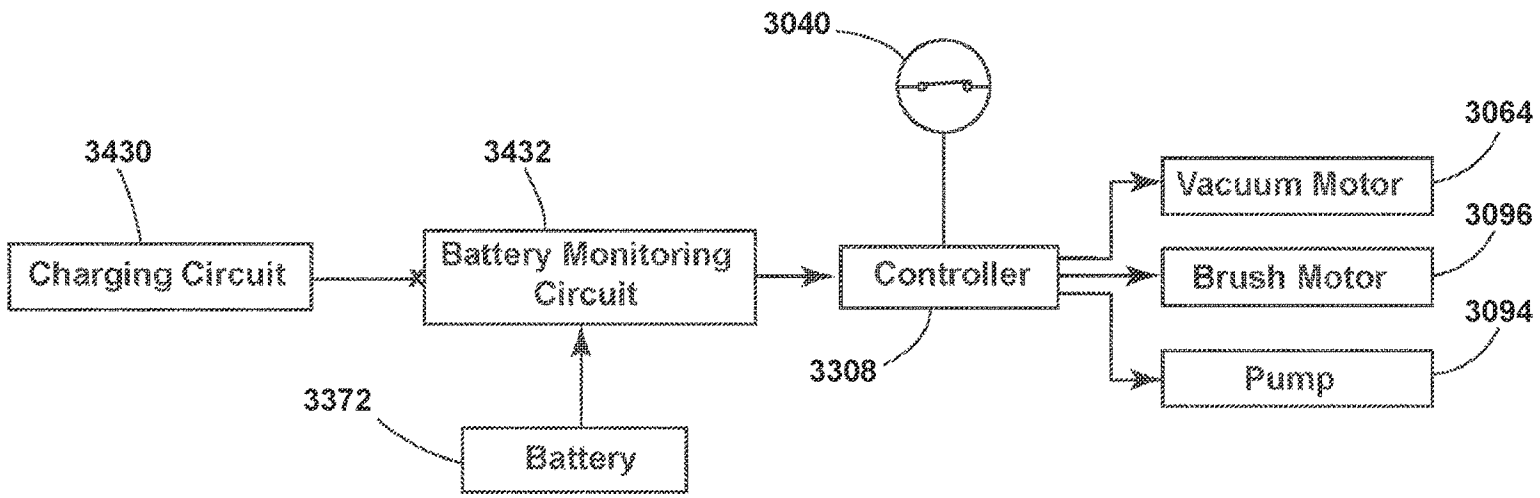
FIG. 44 shows the block diagram of FIG. 43 in a condition when the surface cleaning apparatus is docked with the storage tray in a self-cleaning mode.

Referring to FIG. 44, the block diagram shows a condition when the apparatus 3010 is docked with the storage tray 3380 in the self-cleaning mode. Depressing the self-cleaning mode input control 3040 disables or shuts off the battery charging circuit 3430, and allows the apparatus 3010 to energize and be powered by the onboard battery 3472. The apparatus 3010 then automatically cycles through the self-cleaning mode, and during this cycle the battery charging circuit 3430 remains disabled, i.e. the battery 3372 does not recharge during the self-cleaning mode. This operational behavior is beneficial because if the battery charging circuit 3430 is not disabled and power not supplied by the battery 3472 during the self-cleaning mode, a much higher capacity and more expensive wall charger is required to power the apparatus during the self-cleaning mode.

Figure 45:
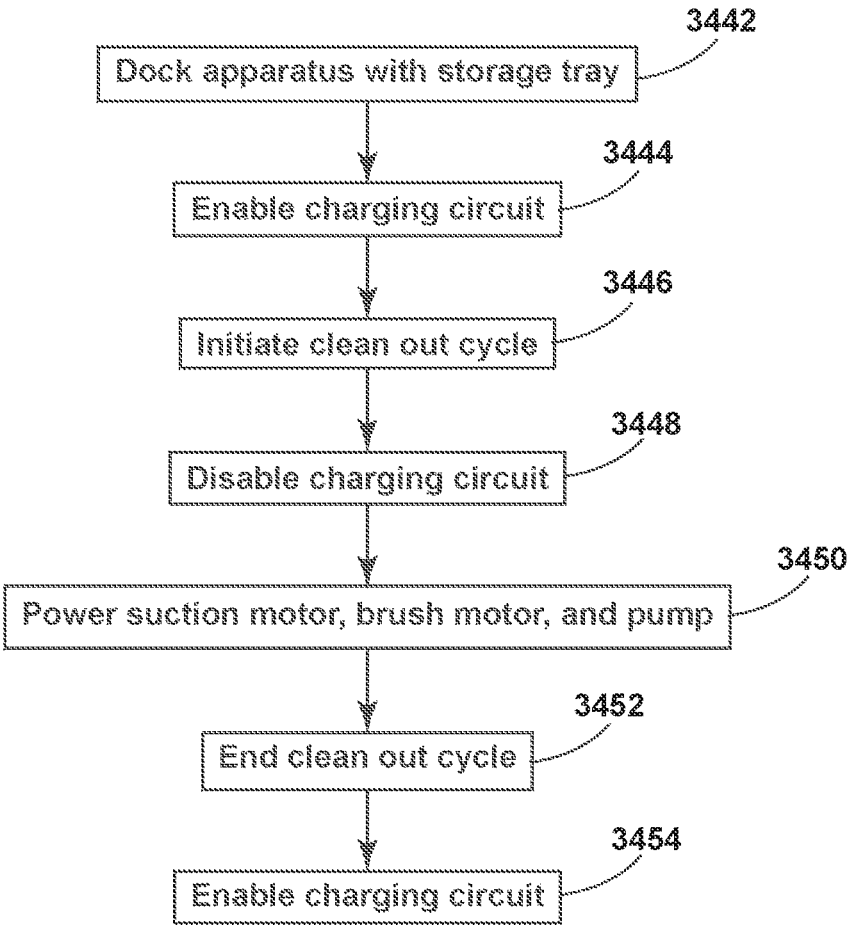
FIG. 45 is a flow chart showing one example of a self-cleaning method for the surface cleaning apparatus.

FIG. 45 depicts one aspect of the disclosure of a self-cleaning method 3440 for the apparatus 3010 using the storage tray 3380. In use, a user at 3442 docks the apparatus 3010 with the storage tray 3380. The docking may include parking the base 3014 on the cleaning tray 3380 and creating a sealed cleaning pathway between the brush chamber 3104 and the suction nozzle 3054.

At step 3444, the charging circuit 3430 is enabled when the apparatus 3010 is docked with the tray 3380 and the charging contacts 3382, 3384 couple. When the charging circuit 3430 is enabled, the battery 3372 may begin being recharged.

At step 3446, the self-cleaning cycle is initiated, with the user initiating the cycle by pressing the self-cleaning mode input control 3040 on the SUI 3032. The self-cleaning cycle may be locked-out by the controller 3308 when the apparatus 3010 is not docked with the storage tray 3380 to prevent inadvertent initiation of the self-cleaning cycle.

At step 3448, upon initiation of the self-cleaning cycle, such as upon the user pressing the self-cleaning mode input control 3040, the charging circuit 3430 is disabled, i.e. the battery 3372 ceases to recharge.

Pressing the input control 3040 at step 3446 can energize one or more components of the apparatus 3010 that are powered by the onboard battery 3472. The self-cleaning cycle may begin at step 3450 in which the pump 3094 is active to deliver cleaning solution from the supply tank 3020 to the distributor (not shown) that sprays the brushroll 3060. During step 3450, the brush motor 3096 can also activate to rotate the brushroll 3060 at while applying cleaning fluid to the brushroll 3060 to flush the brush chamber 3104 and cleaning lines, and wash debris from the brushroll 3060. The self-cleaning cycle may use the same cleaning fluid normally used by the apparatus 3010 for surface cleaning, or may use a different detergent focused on cleaning the recovery system of the apparatus 3010.

The vacuum motor can be actuated during or after step 3450 to extract the cleaning fluid via the suction nozzle 3054. During extraction, the cleaning fluid and debris from the sump 3410 in the tray 3380 is sucked through the suction nozzle 3054 and the downstream fluid recovery path. The flushing action also cleans the entire fluid recovery path of the apparatus 3010, including the suction nozzle 3054 and downstream conduits.

At step 3452, the self-cleaning cycle ends. The end of the self-cleaning cycle can be time-dependent, or can continue until the recovery tank 3022 is full or the supply tank 3020 is empty. For a timed self-cleaning cycle, the pump 3094, brush motor 3096, and vacuum motor 3064 are energized and de-energized for predetermined periods of time. Optionally, the pump 3094 or brush motor 3096 can pulse on/off intermittently so that any debris is flushed off of the brushroll 3060 and extracted into the recovery tank 3022. Optionally, the brushroll 3060 can be rotated at slower or faster speeds to facilitate more effective wetting, shedding of debris, and/or spin drying. Near the end of the cycle, the pump 3094 can de-energize to end fluid dispensing while the brush motor 3096 and vacuum motor 3064 can remain energized to continue extraction. This is to ensure that any liquid remaining in the sump 3410, on the brushroll 3060, or in the fluid recovery path is completely extracted into the recovery tank 3022. After the end of the self-cleaning cycle, the changing circuit 3430 is enabled to continue to recharging the battery 3472 at step 3454.

To the extent not already described, the different features and structures of the various embodiments of the invention, may be used in combination with each other as desired, or may be used separately. That one vacuum cleaner is illustrated herein as having all of these features does not mean that all of these features must be used in combination, but rather done so here for brevity of description. Furthermore, while the surface cleaning apparatus 10 shown herein has an upright configuration, the vacuum cleaner can be configured as a canister or portable unit. For example, in a canister arrangement, foot components such as the suction nozzle assembly 580 and brushroll can be provided on a cleaning head coupled with a canister unit. Still further, the vacuum cleaner can additionally have steam delivery capability. Thus, the various features of the different embodiments may be mixed and matched in various vacuum cleaner configurations as desired to form new embodiments, whether or not the new embodiments are expressly described.

Further aspects of the disclosure are provided by the subject matter of the following clauses:

A cleaning system, comprising a surface cleaning apparatus, comprising a housing adapted for contacting a surface of a surrounding environment to be cleaned a suction source, a suction nozzle assembly provided on the housing and defining a suction nozzle in fluid communication with the suction source, and a rechargeable battery mounted within the housing and electrically coupled to the suction source and configured to enable cordless operation of the surface cleaning apparatus and an apparatus charging contact electrically coupled with the rechargeable battery and a cleaning tray, comprising a tray body configured to at least partially underlie at least a portion of the housing, a charging unit operably coupled to the cleaning tray and electrically couplable to a power source configured to operably couple and charge the rechargeable battery of the surface cleaning apparatus, the charging unit comprising: at least one tray charging contact located on a portion of the tray body; and a moveable tray cover operably coupled to the tray body and configured to move between a covered position wherein the at least one tray charging contact is covered and an opened position wherein the at least one tray charging contact is accessible.

The cleaning system of any preceding clause wherein the apparatus charging contact includes a DC socket.

The cleaning system of any preceding clause wherein the surface cleaning apparatus further comprises a moveable battery cover operably coupled to the housing and moveable between a covered position wherein the apparatus charging contact is covered and an opened position wherein the apparatus charging contact is accessible.

The cleaning system of any preceding clause wherein the moveable battery cover is slidably mounted to a battery casing at least partially retaining the rechargeable battery to the housing of the surface cleaning apparatus.

The cleaning system of any preceding clause further comprising a biasing element located between the moveable battery cover and the battery casing and providing a force to bias the moveable battery cover to the covered position.

The cleaning system of any preceding clause wherein the moveable battery cover includes a first ramped surface.

The cleaning system of any preceding clause wherein the moveable tray cover further comprises a mating surface upon which the first ramped surface applies force when the surface cleaning apparatus is docked with the cleaning tray.

The cleaning system of any preceding clause wherein the mating surface is a second ramped surface extending upwards from the moveable tray cover.

The cleaning system of any preceding clause wherein the power source is a household outlet.

The cleaning system of any preceding clause wherein the cleaning tray further comprises at least one biasing element operably coupled to the moveable tray cover and configured to provide a biasing force on the moveable tray cover towards the covered position.

The cleaning system of any preceding clause wherein the at least one biasing element comprises two springs providing biasing force in a plurality of directions.

The cleaning system of any preceding clause wherein the surface cleaning apparatus further comprises a fluid delivery and recovery system, comprising: a fluid supply tank adapted to hold a supply of fluid, a fluid dispenser in fluid communication with the fluid supply tank, and a recovery tank in fluid communication with the suction nozzle.

The cleaning system of any preceding clause wherein the surface cleaning apparatus further comprises an agitator located within the suction nozzle.

The cleaning system of any preceding clause wherein the tray body further comprises a recessed portion configured to receive the suction nozzle and the agitator.

The cleaning system of any preceding clause wherein the cleaning tray further comprises an insert selectively received within at least a portion of the recessed portion and configured to engage the agitator.

The cleaning system of any preceding clause wherein a sealed cleaning pathway is formed to the recovery tank and fluid is dispensed from the fluid dispenser within a brush chamber of the housing to wash out the brush chamber, nozzle, and an airflow pathway between the suction nozzle and recovery tank.

The cleaning system of any preceding clause wherein the housing of the surface cleaning apparatus further comprises a base receivable within the tray body.

The cleaning system of any preceding clause wherein the tray body further comprises guide walls extending upwardly and configured to align the base within the tray body.

The cleaning system of any preceding clause wherein the tray body further comprises wheel wells configured to receive wheels of the surface cleaning apparatus.

The cleaning system of any preceding clause wherein the surface cleaning apparatus is one of an upright vacuum cleaner, a multi-surface floor cleaner, a robotic vacuum, a canister vacuum, a portable deep cleaner, an upright deep cleaner, or a commercial extractor.

A cleaning tray for a surface cleaning apparatus having a body and a base assembly with a suction nozzle and an agitator, comprising a tray body configured to at least partially underlie the base and at least one of the suction nozzle or the agitator, a charging unit operably coupled to the cleaning tray and electrically couplable to a power source configured to operably couple and charge a battery of the surface cleaning apparatus, the charging unit comprising at least one tray charging contact located on a portion of the tray body; and a moveable tray cover operably coupled to the tray body and configured to move between a covered position wherein the at least one tray charging contact is covered and an opened position wherein the at least one tray charging contact is accessible.

The cleaning tray of any preceding clause wherein the power source is a household outlet.

The cleaning tray of any preceding clause further comprising at least one biasing element operably coupled to the moveable tray cover and configured to provide a biasing force on the moveable tray cover towards the covered position.

The cleaning tray of any preceding clause wherein the at least one biasing element comprises two springs providing biasing force in a plurality of directions The cleaning tray of any preceding clause wherein the moveable tray cover further comprises a mating surface upon which a portion of the surface cleaning apparatus applies force when docked.

The cleaning tray of any preceding clause wherein the mating surface is a ramped surface extending upwards from the moveable tray cover.

The cleaning tray of any preceding clause wherein the tray body further comprises a recessed portion configured to receive the suction nozzle and the agitator and the tray body having guide walls extending upwardly and configured to align the base assembly of the surface cleaning apparatus within the cleaning tray.

The cleaning tray of any preceding clause further comprising an insert selectively received within at least a portion of the recessed portion and configured to engage the agitator.

The cleaning tray of any preceding clause wherein a sealed cleaning pathway is formed to a downstream recovery container within the surface cleaning apparatus and fluid is dispensed from a distributor within a brush chamber of the base to wash out the brush chamber, nozzle, and an airflow pathway between the suction nozzle and recovery container.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A surface cleaning apparatus, comprising:

an upright body comprising a handle and a frame, the frame comprising a main support section supporting a selectively removable supply tank and a selectively removable recovery tank, the handle defining an upper distal end;

a base operably coupled with a lower end of the upright body, a suction nozzle provided with the base at a forward portion;

a recovery system comprising the suction nozzle, a suction source in fluid communication with the suction nozzle for generating a working air stream, and the selectively removable recovery tank;

a fluid delivery system comprising the selectively removable supply tank and a fluid distributor provided on the base;

an agitator selectively receivable within the base;

a first wiper configured to interface with a portion of the agitator;

a second wiper mounted to the base behind the agitator and adapted to at least selectively contact a surface as the base moves across the surface to be cleaned in an operational position; and a rechargeable battery provided at a rearward portion of the upright body, the rechargeable battery configured to selectively supply power to the suction source.

2. The surface cleaning apparatus of claim 1 wherein the upright body further comprises a battery housing provided on a rear side of the frame and the rechargeable battery is provided within the battery housing.

3. The surface cleaning apparatus of claim 2 wherein at least a portion of the battery housing is integral with the frame.

4. The surface cleaning apparatus of claim 2 wherein the rechargeable battery is selectively removable from the battery housing.

5. The surface cleaning apparatus of claim 2, further comprising a cover disposed on top of the rechargeable battery and adapted to provide protection thereof.

6. The surface cleaning apparatus of claim 2 wherein the rechargeable battery is rechargeable when located within the battery housing.

7. The surface cleaning apparatus of claim 1 wherein the selectively removable recovery tank is located on a forward side of the main support section.

8. The surface cleaning apparatus of claim 7 wherein the rechargeable battery is located rearwardly of the selectively removable recovery tank.

9. The surface cleaning apparatus of claim 1 wherein the upright body is pivotally coupled to the base.

10. The surface cleaning apparatus of claim 9 wherein the base further comprises a base housing and a removable nozzle assembly selectively coupled to the base housing, the removable nozzle assembly defining the forward portion and the removable nozzle assembly comprising a nozzle housing at least partially defining a brush chamber.

11. The surface cleaning apparatus of claim 10, further comprising a nozzle latch releasably securing the removable nozzle assembly to the base housing, wherein the nozzle latch is selectively received in a latch receiver on the base housing and biased to a latched position.

12. The surface cleaning apparatus of claim 11 wherein the agitator is a brushroll selectively receivable within the brush chamber, the brushroll rotatable therein about a brushroll axis.

13. The surface cleaning apparatus of claim 12, further comprising a brushroll motor provided in the base and operably coupled to the brushroll and electrically coupled to the rechargeable battery, the brushroll motor adapted to provide a driving force to rotate the brushroll about the brushroll axis.

14. The surface cleaning apparatus of claim 12 wherein the fluid delivery system further comprises a pump fluidly coupling the selectively removeable supply tank and the fluid distributor and the pump is electrically coupled to the rechargeable battery.

15. The surface cleaning apparatus of claim 1 wherein the suction nozzle is in fluid communication with the selectively removable recovery tank through a conduit and the conduit is flexible to accommodate movement of the upright body in relation to the base.

16. The surface cleaning apparatus of claim 1 wherein the selectively removable recovery tank comprises:

a container forming a collection chamber for the recovery system, the container defining an open top;

a tank inlet formed at a lower end of the container;

a hollow standpipe extending upwardly from the tank inlet and comprising a pipe outlet at an upper end thereof; and a lid assembly sized for receipt on the container and at least partially enclosing the open top, the lid assembly including an air outlet and supporting a filter at the air outlet.

17. The surface cleaning apparatus of claim 16, further comprising a latch assembly provided on a forward side of the lid assembly, the latch assembly including a latch body biased via a spring toward a latched position wherein a protrusion of the latch body is received in a recess of the upright body.

18. The surface cleaning apparatus of claim 1 wherein the handle comprises a handle pipe having a lower end received in main support section and a hand grip including at least one input control adapted to control a supply of power to one or more electrical components and a fluid dispenser actuator located on the hand grip and operably coupled to the fluid delivery system to control a dispensing of fluid.

19. A cleaning system, comprising:

a surface cleaning apparatus according to claim 1; and a cleaning tray, comprising a tray body configured to at least partially underlie at least a portion of the housing.

20. The cleaning system of claim 19 wherein the surface cleaning apparatus further comprises charging contacts electrically coupled with the rechargeable battery and the cleaning tray further comprises a charging unit operably coupled to the cleaning tray and electrically couplable to a power source configured to operably couple and charge the rechargeable battery of the surface cleaning apparatus, the charging unit comprising at least one tray charging contact located on a portion of the tray body and a moveable tray cover operably coupled to the tray body and configured to move between a covered position wherein the at least one tray charging contact is covered and an opened position wherein the at least one tray charging contact is accessible.

21. A surface cleaning apparatus, comprising:

an upright body comprising a handle and a frame, the frame comprising a main support section supporting a selectively removable supply tank and a selectively removable recovery tank, the handle defining an upper distal end;

a base operably coupled with a lower end of the upright body, wherein the upright body is pivotally coupled to the base, a suction nozzle provided with the base at a forward portion;

a recovery system comprising the suction nozzle, a suction source in fluid communication with the suction nozzle for generating a working air stream, and the selectively removable recovery tank, wherein the suction nozzle is in fluid communication with the selectively removable recovery tank through a conduit and the conduit is flexible to accommodate pivotal movement of the upright body in relation to the base;

a fluid delivery system comprising the selectively removable supply tank and a fluid distributor provided on the base;

an agitator selectively receivable within the base; a first wiper configured to interface with a portion of the agitator;

a second wiper mounted to the base behind the agitator and adapted to at least selectively contact a surface as the base moves across the surface to be cleaned in an operational position; and a rechargeable battery provided at rearward a portion of the upright body, the rechargeable battery configured to selectively supply power to the suction source.

* * * * *